US007748886B2

(12) United States Patent
Pazula et al.

(10) Patent No.: US 7,748,886 B2
(45) **Date of Patent: *Jul. 6, 2010**

(54) INCANDESCENT AND LED LIGHT BULBS AND METHODS AND DEVICES FOR CONVERTING BETWEEN INCANDESCENT LIGHTING PRODUCTS AND LOW-POWER LIGHTING PRODUCTS

(75) Inventors: Bruce Raymond Pazula, Broadview Heights, OH (US); Joseph John Janos, Wadsworth, OH (US); George J. Uhler, Wadsworth, OH (US); Jeffrey Richard Dross, Cleveland Heights, OH (US)

(73) Assignee: The L.D. Kichler Co., Cleveland, OH (US)

( * ) Notice: Subject to any disclaimer, the term of this patent is extended or adjusted under 35 U.S.C. 154(b) by 384 days.

This patent is subject to a terminal disclaimer.

(21) Appl. No.: 11/684,401

(22) Filed: Mar. 9, 2007

(65) Prior Publication Data

US 2009/0103331 A1 Apr. 23, 2009

Related U.S. Application Data

(63) Continuation-in-part of application No. 11/032,807, filed on Jan. 10, 2005, now Pat. No. 7,316,499, and a continuation-in-part of application No. 11/033,090, filed on Jan. 10, 2005, now Pat. No. 7,090,390.

(60) Provisional application No. 60/781,445, filed on Mar. 10, 2006.

(51) Int. Cl.
*H01R 33/02* (2006.01)

(52) U.S. Cl. ..... 362/650; 362/353; 362/377; 362/378

(58) Field of Classification Search ..... 362/378, 362/377, 353, 433, 435, 437, 441, 443, 448, 362/457, 446, 649, 650, 651; 439/226, 236, 439/336

See application file for complete search history.

(56) References Cited

U.S. PATENT DOCUMENTS

| | | | |
|---|---|---|---|
| 4,858,089 | A | 8/1989 | Pietro |
| 5,073,845 | A | 12/1991 | Aubrey |
| 5,286,216 | A | 2/1994 | Volz |
| 5,463,540 | A | 10/1995 | Jones |
| 5,980,072 | A | 11/1999 | Zirkle |

(Continued)

OTHER PUBLICATIONS

Office Action dated Mar. 27, 2009, in connection with corresponding Canadian patent application No. 2,579,077.

Viva Green Lighting Model SU13 Product Specification, Shanghai Viva Eco. Electronics and Technology Co., Ltd., Revised May 11, 2004.

(Continued)

*Primary Examiner*—John A Ward
(74) *Attorney, Agent, or Firm*—Calfee, Halter & Griswold LLP

(57) ABSTRACT

An irreversible electrical base for irreversibly converting an incandescent lighting product to a low-power lighting product is provided. Various methods of converting an incandescent lighting product to a low-power lighting product and converting a low-power lighting product to an incandescent lighting product, are provided. Various non-threaded incandescent light bulbs, non-threaded halogen incandescent light bulbs, and non-threaded LED-based light bulbs are provided. A keyless lighting fixture having an insert and twist connector is provided.

18 Claims, 50 Drawing Sheets

U.S. PATENT DOCUMENTS

| | | | | |
|---|---|---|---|---|
| 6,099,144 | A | 8/2000 | Klaus | |
| 6,113,433 | A | 9/2000 | Al-Turki | |
| 7,090,390 | B2 * | 8/2006 | Pazula | 362/650 |
| 7,104,828 | B1 | 9/2006 | Lin | |
| 2004/0264187 | A1 | 12/2004 | Vanderschuit | |

OTHER PUBLICATIONS

Viva Green Lighting VIVA CFS Spec List—ES, Shanghai Viva Eco. Electronics and Technology Co.

International Search Report and Written Opinion for PCT/US2005/031164 dated Apr. 5, 2006.

* cited by examiner

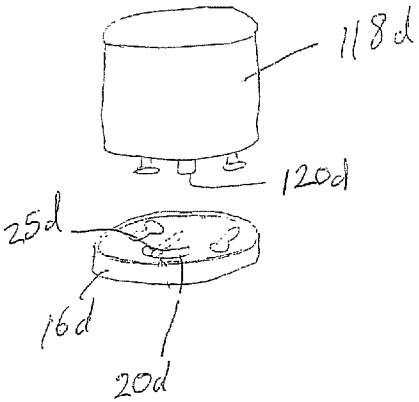
Fig. 11D
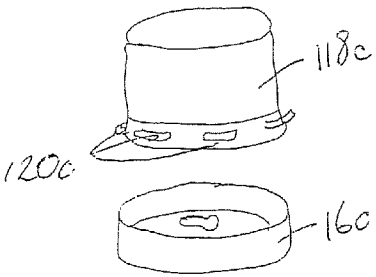
Fig. 11C
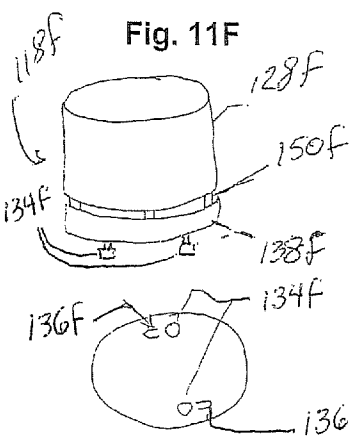
Fig. 11F
Fig. 11G
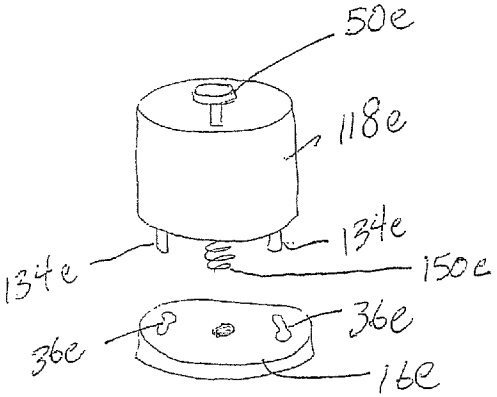
Fig. 11E Left and Right Sides Front and Back Top Bottom

A-19 BULB

Left and Right Sides

Front and Back

Top

Bottom

A-19 BULB

Tall

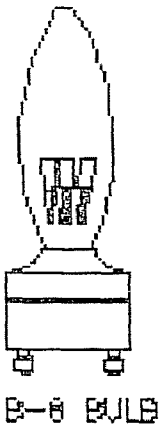
Fig. 20S
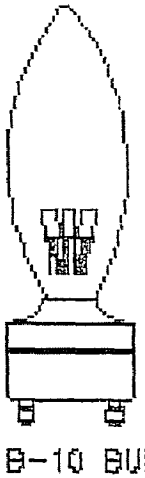
Fig. 20T
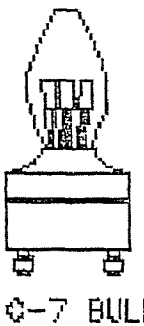
Fig. 20U
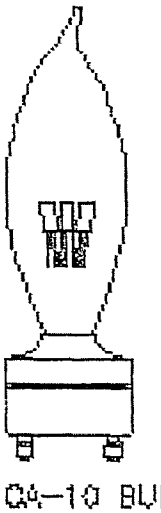
Fig. 20V
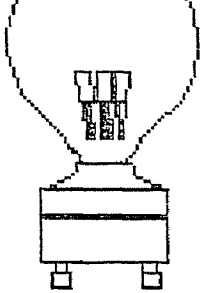
Fig. 20W
Fig. 20X RIB OR CAM THAT WOULD PUSH INCANDESCENT CONTACT AWAY FROM OPENING FURTHER ISOLATING (DISABLING)

KEYLESS FIXTURE ALTERNATES
FINISH WHITE
BW
Crossbar
Canopy
Cup
ballast
bulb
3502

SIMPLE KEYLESS ALTERNATIVE
Pull chain
SW
SW
Internal Switch
3502

KEYLESS ALTERNATIVE WITH PULL-SWITCH
Fitter Portion
Shade
Opening
3502

6" BALL FIXTURE WITH PULL-SWITCH

INCANDESCENT AND LED LIGHT BULBS AND METHODS AND DEVICES FOR CONVERTING BETWEEN INCANDESCENT LIGHTING PRODUCTS AND LOW-POWER LIGHTING PRODUCTS

CROSS REFERENCE TO RELATED APPLICATIONS

This application claims priority to, and any other benefit of, U.S. Provisional Patent Application Ser. No. 60/781,446, filed on Mar. 10, 2006 and entitled Incandescent And Led light Bulbs And Methods And Devices For Converting Between Incandescent Lighting Products And Fluorescent Lighting Products, which is incorporated herein by reference. This application is a continuation-in-part of U.S. patent application Ser. No. 11/032,807, filed Jan. 10, 2005 and entitled Methods For Converting Incandescent Lighting Products to Fluorescent Lighting Products, and a continuation-in-part of U.S. patent application Ser. No. 11/033,090 filed Jan. 10, 2005 and entitled Removable Incandescent Light Bulb Base Permitting Conversion to Fluorescent Lighting Products, now U.S. Pat. No. 7,090,390, all three of which are hereby incorporated herein by reference. This application is also related to U.S. Provisional Application Ser. No. 60/605,597, filed on Aug. 30, 2004, and entitled Methods and Systems for Converting Incandescent Lighting Products to Fluorescent Lighting Products, and PCT Patent Application No. PCT/US05/31164 filed on Aug. 30, 2005, both of which are hereby incorporated herein by reference.

FIELD OF THE INVENTION

The present invention relates generally to lighting fixtures and portables, and more particularly to converting an incandescent lighting fixture or portable to a lower power fluorescent lighting fixture or portable (such as fluorescent or LED), to replaceable incandescent light bulb bases to facilitate this conversion, and to fixtures and portables that are capable of undergoing this conversion.

BACKGROUND OF THE INVENTION

As known in the art, fluorescent light bulbs generally are more energy-efficient than conventional incandescent light bulbs. At the same time, however, incandescent light bulbs may have advantages over fluorescent light bulbs. For example, incandescent light bulbs tend to be less expensive than fluorescent bulbs and do not require a ballast, as fluorescent bulbs do. Accordingly, on some occasions fluorescent bulbs may be preferable to incandescent bulbs, on other occasions incandescent bulbs are preferable, and on other occasions, either will suffice. In this time of energy conservation, it is common for energy-efficient products to be certified as energy efficient by various organizations, e.g., ENERGY STAR ("a government-backed program helping businesses and individuals protect the environment through superior energy efficiency").

It is known to have fluorescent bulbs with built-in ballasts for use in incandescent light bulb sockets; however lighting products (i.e., lighting fixtures and/or lighting portables) with standard incandescent light bulb sockets may face hurdles in becoming certified as energy-efficient because one can readily use incandescent bulbs in the medium bases (Edison bases) of such lighting products.

SUMMARY OF THE INVENTION

In one exemplary embodiment of the present invention, a method of converting an incandescent lighting product to a lower-energy lighting product is provided, comprising: providing an incandescent lighting product having a frame carrying at least one electrical lighting base, the at least one electrical lighting base removably receiving a removable incandescent bulb socket, the at least one electrical lighting base also capable of removably receiving a lower-energy light source in place of the removable incandescent bulb socket, and the at least one base having an associated removable incandescent bulb socket; removing the at least one removable incandescent bulb socket from the at least one electrical lighting base; and coupling at least one lower-energy light source to the at least one electrical lighting base carried by the frame in place of a removed incandescent bulb socket to permit the lighting product to be used as a lower-energy lighting product.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention, wherein:

FIG. 11C is a schematic isometric view of an additional exemplary means for preventing a removable incandescent bulb socket or non-threaded incandescent bulb from being re-coupled to an electrical lighting base;

FIG. 11D is a schematic isometric view of an additional exemplary means for preventing a removable incandescent bulb socket or non-threaded incandescent bulb from being re-coupled to an electrical lighting base;

FIG. 11E is a partially exploded schematic isometric view of an additional exemplary means for preventing a removable incandescent bulb socket or non-threaded incandescent bulb from being re-coupled to an electrical lighting base;

FIGS. 11F and 11G are schematic isometric and bottom views of an additional exemplary means for preventing a removable incandescent bulb socket or non-threaded incandescent bulb from being re-coupled to an electrical lighting base;

FIGS. 17A-17D are views of an exemplary non-threaded light bulb design, the light bulb being preferably circular in cross section, wherein:

FIG. 17A is a left or right side view of the light bulb;

FIG. 17B is a front or back view of the light bulb;

FIG. 17C is a top view of the light bulb; and

FIG. 17D is a bottom view of the light bulb;

FIGS. 18A-18D are views of an exemplary non-threaded light bulb design with an extended base portion, the light bulb being preferably circular in cross section, wherein:

FIG. 18A is a left or right side view of the light bulb;

FIG. 18B is a front or back view of the light bulb;

FIG. 18C is a top view of the light bulb; and

FIG. 18D is a bottom view of the light bulb;

DETAILED DESCRIPTION OF THE INVENTION

Figure 1B:
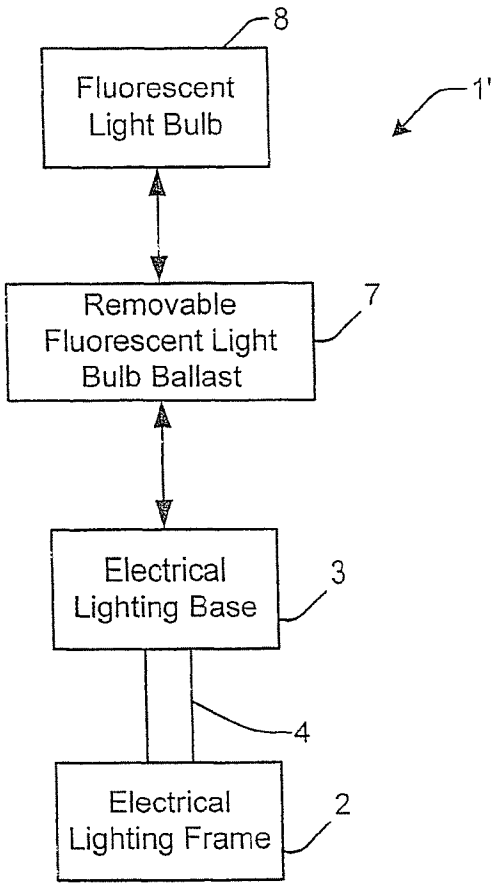
FIGS. 1A and 1B are schematic block diagrams of exemplary lighting products according to the present invention.

The following includes definitions of exemplary terms used throughout the disclosure. Both singular and plural forms of all terms fall within each meaning. Except where noted otherwise, capitalized and non-capitalized forms of all terms fall within each meaning:

As used herein, "electrical lighting base" includes, but is not limited to necessarily require, a structure carried by a lighting product frame that is proximate and providing support for removable lighting members, such as sockets and ballasts. An "electrical lighting base" preferably also provides electricity to removable lighting members, lighting sockets and ballasts. In the alternative, an electrical lighting base may provide mechanical support for removable lighting members and electricity is provided via separate conductors, e.g., a wire with a connector being connected to a mating connector on the removable lighting member. The term "electrical lighting base" as used herein is contrasted with common "bases" of lamps or other portables, which tend to be at the bottom of the lamp or portable and that provide mechanical support and stability, e.g., by being relatively heavy and/or by being flared at the bottom.

As used herein, "circuit" (synonymous with "logic" as used herein) includes, but is not limited to necessarily require, hardware, firmware, software and/or combinations of each to perform a function(s) or an action(s). For example, based on a desired application or needs, a circuit may include a software controlled microprocessor, discrete logic such as an application specific integrated circuit (ASIC), or other programmed logic device. A circuit may also be fully embodied as software.

As used herein, "circuit communication" indicates a communicative relationship between devices, logic, and/or circuits. Direct electrical, electromagnetic, and optical connections and indirect electrical, electromagnetic, and optical connections are examples of circuit communication. Two devices are in circuit communication if a signal from one is received by the other, regardless of whether the signal is modified by some other device. For example, two devices separated by one or more of the following-amplifiers, filters, transformers, optical isolators, digital or analog buffers, analog integrators, other electronic circuitry, fiber optic transceivers, Bluetooth communications links, 802.11 communications links, or even satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, e.g., a CPU, are in circuit communication.

As used herein, "preferably" indicates one optional configuration or characteristic, and in accordance with the ordinary meaning of that term does not indicate that that the configuration or characteristic is mandatory or the only possible configuration or characteristic.

The present invention is directed toward systems and methods for converting incandescent lighting products to lower-energy lighting products and preferably for irreversibly converting incandescent lighting products to lower-energy lighting products. Exemplary systems, methods, and devices are directed toward converting incandescent lighting products to fluorescent lighting products and preferably for irreversibly converting incandescent lighting products to fluorescent lighting products. Other exemplary systems, methods, and devices of the present invention are directed toward converting incandescent lighting products to LED lighting products and preferably for irreversibly converting incandescent lighting products to LED lighting products. Although many of the more detailed explanations of exemplary systems, methods, and devices herein are in the context of converting incandescent lighting products to fluorescent lighting products, it is to be understood that, based on the teachings herein, all of those exemplary fluorescent systems, methods, and devices apply equally well to converting incandescent lighting products to LED lighting products, with LED bulbs replacing fluorescent bulbs in those examples, and LED drivers replacing fluorescent ballasts in those examples. Similarly, it is to be understood that, based on the teachings herein, all of those exemplary fluorescent systems, methods, and devices apply equally well to converting incandescent lighting products to lower-energy lighting products (including low-energy), with lower-energy (including low-energy) light sources replacing fluorescent bulbs in those examples, and appropriate drivers for lower-energy (including low-energy) light sources replacing fluorescent ballasts in those examples. Thus, the present invention is directed toward systems and methods for converting incandescent lighting products to virtually any lower-energy lighting products and preferably for irreversibly converting incandescent lighting products to virtually any lower-energy lighting products.

Figure 1A:
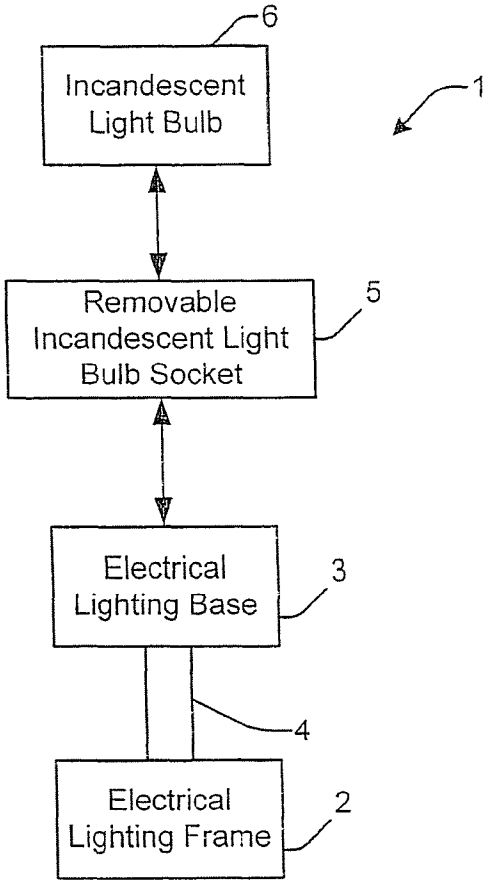

Referring now to the drawings, FIGS. 1A and 1B are high-level block diagrams showing exemplary lighting products 1 and 1' (i.e., lighting fixtures and/or portables) according to the present invention. Exemplary lighting product 1 comprises a frame or body 2 directly or indirectly carrying at least one electrical lighting base 3. The base 3 may be carried by one or more structures, e.g., carried by at least one arm 4, of the lighting product 1. Alternatively, the base may be disposed directly in a lighting frame in a wall or ceiling, for example, to provide recessed lighting, or in a variety of other products and arrangements, such as, for example, track lighting, ceiling fan lighting, and landscape lighting. The base 3 removably receives and is electrically coupled to, a removable incandescent bulb socket 5, which accepts an incandescent light bulb 6. Electricity powering the incandescent light bulb 6 is provided via the electrical lighting base 3 to the socket 5. As shown in FIG. 1B, the electrical lighting base 3 also removably receives a fluorescent light bulb ballast 7 for a fluorescent light bulb 8. The fluorescent light bulb ballast 7 is preferably removable to permit replacement when the ballast fails. Electricity powering the fluorescent light bulb 8 is provided via the lighting base 3 to the ballast 7. Preferably, the electrical lighting base 3 may be both mechanically coupled and electrically coupled to the removable incandescent bulb socket 5 and/or the removable ballast 7, e.g., the base 3 has openings for accepting and retaining electrical contacts (not shown in FIGS. 1A and 1B) of the removable incandescent bulb socket 5 and the ballast 7.

According to an exemplary method of the present invention, lighting products having at least one of such bases 3 are preferably provided, preferably with corresponding removable incandescent light bulb sockets 5 in place (with or without incandescent light bulbs 6 installed). On the one hand, for incandescent use, the product may be used without regard to the base 3 or socket 5; incandescent bulbs 6 are installed and the product may be used. On the other hand, for fluorescent use, the removable incandescent bulb sockets 5 may be removed from the base 3 and replaced with fluorescent ballasts 7 and fluorescent bulbs 8. Preferably, the removal of the removable incandescent bulb sockets 5 and replacement with fluorescent ballasts 7 and fluorescent bulbs 8 may be done by virtually anyone, with or without special tools or equipment, including by personnel in a distribution chain for the lighting product and/or by an installer and/or by an end user. The ballasts 7 are preferably removable ballasts.

Preferably the removable incandescent bulb socket 5 may be removed from the base 3 and replaced with a fluorescent ballast 7, preferably a removable ballast 7. The removable incandescent bulb socket 5 and the removable ballast 7 may be freely exchanged, with one being removed from the base 3 and the other being coupled to the base 3 in its place. In the alternative, according to the present invention it may be helpful, e.g., for energy-efficiency certification, to prevent a removable incandescent bulb socket 5 from being re-coupled (e.g., reconnected) to the electrical lighting base 3 when either (i) the removable incandescent bulb socket 5 has been removed from the electrical lighting base 3 or (ii) a fluorescent lighting ballast has been coupled to the electrical lighting base 3, or (iii) both the removable incandescent bulb socket 5 has been removed from the electrical lighting base 3 and a fluorescent lighting ballast has been coupled to the electrical lighting base 3, or responsive to some other low-energy usage triggering event.

This may be accomplished by any one or more means for preventing a removable incandescent bulb socket 5 from being re-coupled to the electrical lighting base 3, e.g., (a) any one or more spring-loaded electrical contacts associated with the base 3 and/or socket 5 and/or ballast 7 that initially provide electricity to the bulb 6, but that extend or retract when any of the three foregoing conditions are met to effectively prevent a removable incandescent bulb socket 5 from being mechanically and/or electrically re-coupled to the electrical lighting base 3; and/or (b) any one more spring-loaded pins, cams (rotating or sliding pieces), guides, or other structures associated with the base 3 and/or socket 5 and/or ballast 7 that initially are out of the way, but that extend or retract to physically interfere with other structures when any of the three foregoing conditions are met to effectively prevent a removable incandescent bulb socket 5 from being mechanically and/or electrically re-coupled to the electrical lighting base 3; and/or (c) a bulb socket 5 that separates into two or more pieces, rendering it unusable, during the process of meeting any of any of the three foregoing conditions, e.g., the socket 5 breaks into two or more pieces when it is removed from or released from the base 3; and/or (d) any one more spring-loaded pins, cams, guides, or other structures associated with the base 3 and/or socket 5 and/or a non-removable ballast that initially are out of the way, but that extend or retract to physically interfere with other structures when any of the three foregoing conditions are met to effectively prevent the non-removable ballast from being removed from the base 3 (in this case the removable incandescent bulb socket 5 is prevented from being reconnected to the electrical lighting base 3 by the fluorescent ballast 7, which is prevented from being removed and which blocks the socket 5 from being re-coupled to the base 3); and/or (e) any one more rings, bands, bridges, ties, tape, films, or other structures associated with the base 3 and/or socket 5 that initially affix the socket 5 to the base 3 so that the socket 5 is mechanically and electrically coupled to the base 3, which are rings, bands, bridges, ties, tape, films, or other structures cut or otherwise severed or disengaged when any of the three foregoing conditions are met (e.g., in order to do so) so that there is not sufficient structure to reconnect the removable incandescent bulb socket 5 in mechanical connection and/or electrical reconnection to the electrical lighting base 3; and/or (f) electronic circuitry in the base 3 and/or socket 5 (and/or perhaps somewhere else in the lighting product, e.g., in the base portion of a portable or in the plate of a fixture) that prevents an incandescent light bulb socket from properly functioning once one of the three foregoing conditions has been met (all not shown in FIGS. 1A and 1B). This circuitry may detect energy usage levels of the lighting product, or a part thereof, and/or detect signals generated by a functioning fluorescent lighting ballast, and responsively thereafter prevent higher-energy usage, as would be expected to permit an incandescent light bulb to function.

In the exemplary method of the present invention discussed above, it is preferable for any bases 3 and/or any removable incandescent light bulb sockets 5 and/or any fluorescent light ballasts 7 to include one or more of the foregoing means for preventing a removable incandescent bulb socket 5 from being reconnected to the electrical lighting base 3 when either (i) the removable incandescent bulb socket 5 has been removed from the electrical lighting base 3 or (ii) a fluorescent lighting ballast (with or without an integral fluorescent bulb) has been coupled to the electrical lighting base 3, or (iii) both the removable incandescent bulb socket 5 has been removed from the electrical lighting base 3 and a fluorescent lighting ballast (with or without an integral fluorescent bulb) has been coupled to the electrical lighting base 3, or responsive to some other low-energy usage triggering event.

Figure 2:
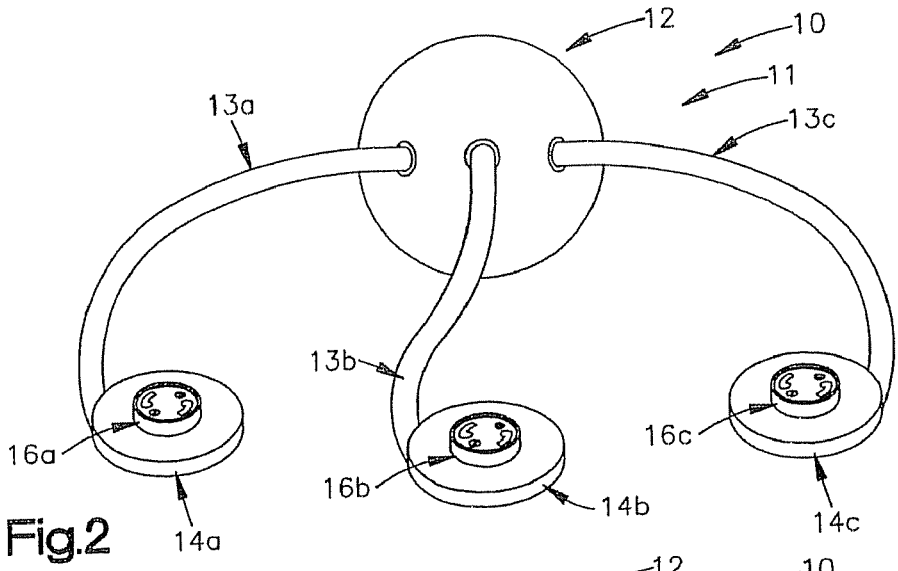
FIGS. 2, 3A, and 3B are front views of exemplary lighting fixtures according to the present invention.
Figure 3A:
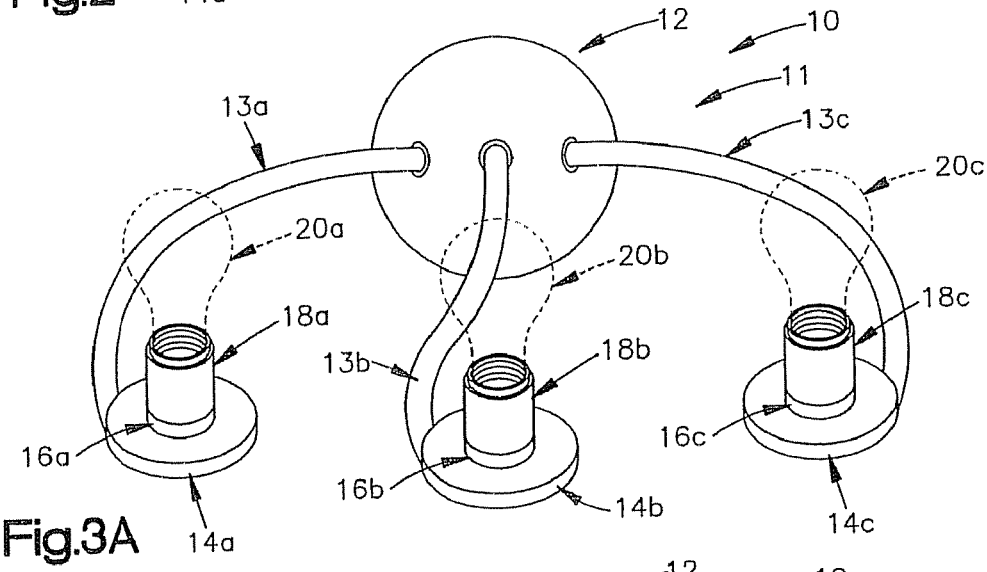
Figure 3B:
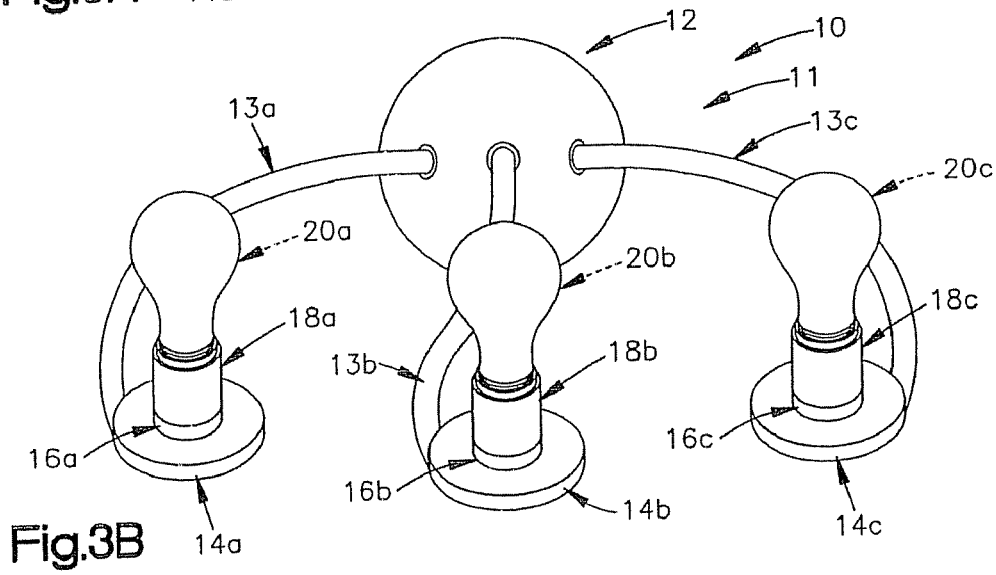

FIG. 2 and FIGS. 3A and 3B illustrate an exemplary lighting fixture 10 of the present invention in various configurations. The exemplary lighting fixture 10 shown has a frame 11, having a body 12 and three arms 13*a*, 13*b*, and 13*c*, with each arm 13*a*, 13*b*, and 13*c* carrying a bobeche 14, also known as a socket cup holder 14 (referred to as bobeches 14*a*, 14*b*, and 14*c*, respectively), each of which bobeche 14 in turn carries an electrical lighting base 16 (referred to as base 16*a*, 16*b*, and 16*c*, respectively). Thus, the frame 11 carries at least one electrical lighting base 16, with each of the three arms 16 carrying an electrical lighting base 16. In the configurations of FIGS. 3A and 3B, the bases 16*a*, 16*b*, and 16*c* are shown coupled to three removable incandescent bulb sockets 18*a*, 18*b*, and 18*c*, and in turn, the three incandescent bulb sockets 18*a*, 18*b*, and 18*c* are removably receiving three incandescent light bulbs 20*a*, 20*b*, and 20*c*. It will be appreciated that lighting fixtures of the invention may have any number of and configuration of aims and bases. Lighting products according to the present invention are preferably shipped in the configuration of FIG. 3A, with the removable incandescent light bulb sockets 18 connected to the bases 16, ready to install and accept incandescent light bulbs for incandescent lighting; although they also be shipped in other configurations, such as the configuration of FIG. 2 having an associated removable incandescent bulb socket shipped separately or therewith for coupling to each base 16 at a later point in time.

Figure 4:
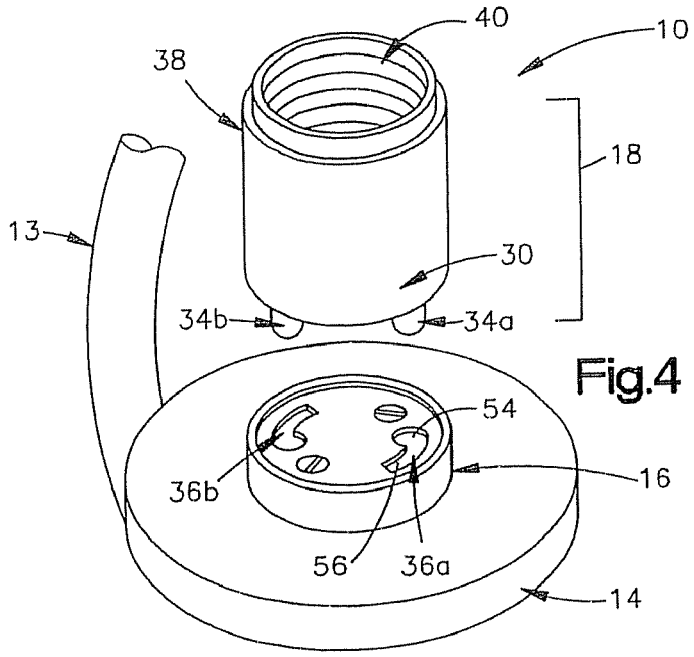
FIG. 4 is an enlarged view of the electrical lighting base and removable incandescent bulb socket of the exemplary lighting fixtures shown in FIGS. 3A and 3B.
Figure 5:
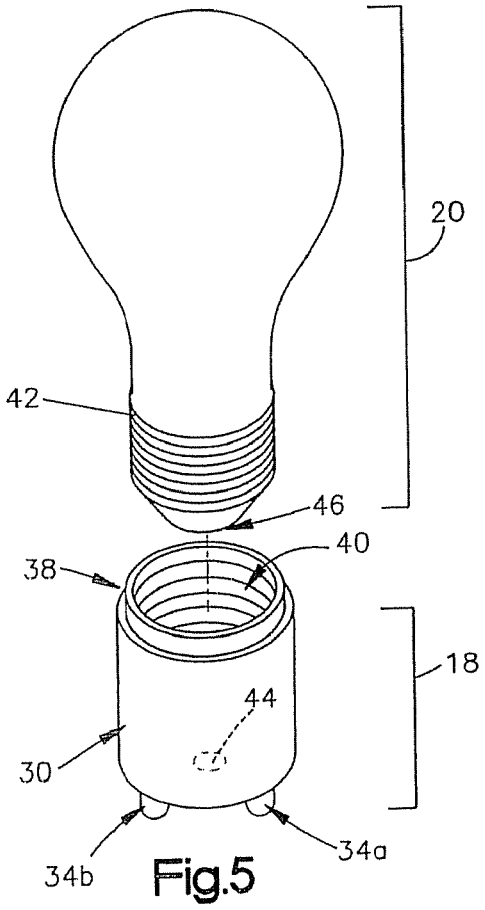
FIGS. 5 and 6 are additional views of the bulb socket shown in FIGS. 1, 2, and 4, with incandescent light bulbs.
Figure 6:
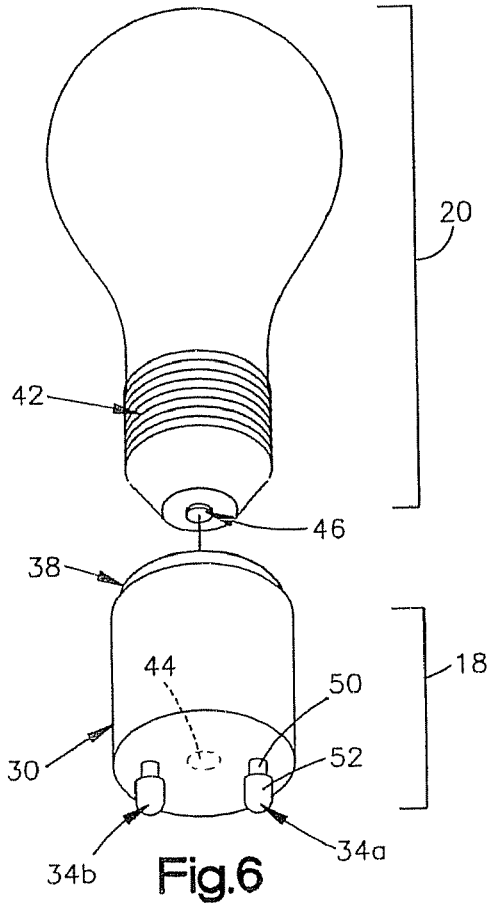

FIGS. 4-6 illustrate the electrical lighting base 16 and incandescent bulb socket 18 of the exemplary lighting fixtures shown in FIGS. 3A and 3B. The base 16 is shown being carried by a bobeche 14, which is carried by arm 13 of frame 11. The base 16 is adapted to removably receive a first end 30 of an incandescent bulb socket 18 to preferably both mechanically couple and electrically couple the socket 18 to the base 16. The first end 30 of socket 18 may be adapted to be removably received by the base 16 in any desirable manner. For example, in the configuration shown in FIG. 4, the first end 30 of the incandescent bulb socket 18 has two extensions (pins or pillars 34*a* and 34*b*) extending from the first end 30 of the incandescent bulb socket 18. In the particular embodiment shown, the longitudinal axes of the pins 34*a* and 34*b* are preferably substantially parallel to the longitudinal axis of the incandescent bulb socket 18. The exemplary base 16 of FIG. 4 has two openings 36*a* and 36*b* adapted to removably receive pins 34*a* and 34*b*.

The incandescent bulb socket 18 also has a second end 38 that is adapted to receive and deliver electricity to an incandescent light bulb 20. The second end 38 of socket 18 also has an opening with threads 40 to removably engage threads 42 on an incandescent light bulb 20 to deliver electricity to the incandescent light bulb 20 as known to those skilled in the art. Inside the socket 18 is a central contact 44, which preferably lies along the axis of the threads 40 (i.e., screw thread contact 40) and contacts a central contact 46 (i.e., electrical foot contact 46 a/k/a base contact 46) of light bulb 20 to provide electricity to the light bulb when the light bulb has been screwed into place, as known to those skilled in the art.

Pins 34*a*, 34*b* are preferably electrical conductors that provide electricity from the base 16 to the socket 18 for light bulb 20. Wiring or other electrical conductors electrically connect one of the pins 34 to the threads 40 and separate wiring or other conductors electrically connect the other of the pins 34 to the central contact 44. Pins 34*a*, 34*b* preferably both mechanically couple and electrically couple the socket 18 to the base 16. In the exemplary configuration shown, the incandescent bulb socket 18 is removably coupled to the base 16 by inserting the extensions 34*a* and 34*b* into the openings 36*a* and 36*b* and turning the incandescent bulb socket 18 in a clockwise manner relative to the base 16. The openings 36 in base 16 preferably have associated electrical contacts electrically coupled to wiring (or other conductors) passing through or adjacent arm 13. These electrical contacts of base 16 engage pins 34*a*, 34*b* to provide electricity to the base 16 to the socket 18 for the light bulb 20.

More specifically to FIGS. 4 and 6, the pins 34*a*, 34*b* of the exemplary incandescent light bulb socket 18 are shown having two portions, a narrower portion 50 and wider portion 52. Similarly, the openings 36*a*, 36*b* of base 16 also have a wider portion 54 and a narrower portion 56. The wider portion 54 of openings 36*a*, 36*b* are sized to accommodate the wider portion 52 of one or more pins 34*a*, 34*b*. The wider portion 54 of openings 36*a*, 36*b* may be about 0.23" or some other dimension larger than the wider portion 52 of one or more pins 34*a*,

34*b*. Similarly, the wider portion 52 of one or more pins 34*a*, 34*b* may be about 0.19" or some other dimension smaller than the wider portion 54 of openings 36*a*, 36*b*. The narrower portion 50 of openings 36*a*, 36*b* are sized to accommodate the narrower portion 50 of one or more pins 34 but not to permit the wider portion 52 of one or more pins 34 to pass through. The narrower portion 50 of openings 36*a*, 36*b* may be about 0.14" or some other dimension larger than the narrower portion 50 of one or more pins 34 and smaller than the wider portion 52 of one or more pins 34. Similarly, the narrower portion 50 of one or more pins 34 may be about 0.13" or some other dimension smaller than the narrower portion 50 of openings 36*a*, 36*b*. The pins 34*a*, 34*b* may be first and second electrical contacts having central axes that are positioned so that their central axes are approximately parallel and are spaced about 23 mm apart. Similarly, the Thus, in the exemplary configuration shown, the incandescent bulb socket 18 is removably coupled to the base 16 by (a) aligning the removable socket 18 with respect to the base 16 so that the longitudinal axes of the pins 34*a*, 34*b* are directed toward the wider portion 54 of openings 36*a*, 36*b*, (b) inserting the pins 34 into the openings 36 so that the wider portion 52 of pins 34*a*, 34*b* are entirely within the openings 36*a*, 36*b*, and (c) turning the incandescent bulb socket 18 in a clockwise manner relative to the base 16 so that the narrower portion 50 of openings 36*a*, 36*b* engage the narrower portion 50 of pins 34*a*, 34*b* and in such a manner that the wider portion 52 of pins 34*a*, 34*b* are prevented from being withdrawn, thus removably retaining the socket 18. Preferably, the wider portion 52 of pins 34*a*, 34*b* is placed in physical contact with the electrical contacts within the openings 36 to provide electricity to the socket 18 for the light bulb 20. The removable incandescent bulb sockets 18*a*-18*c* may be any suitable dimensions and virtually any shape and be made of any of many acceptable heat-resistant materials, such as Bakelite polymer, porcelain, or ceramic, and may preferably be a material rated for use at temperatures from 100° C.-150° C. The bases 16*a*-16*c* also may be any suitable dimensions and virtually any shape and be made of any of many acceptable any of many acceptable heat-resistant materials, such as Bakelite polymer or ceramic. The material(s) selected for the electrical lighting bases 16*a*-16*c* and removable incandescent bulb sockets 18*a*-18*c* are both preferably resistant to temperatures generated by ordinary incandescent light bulbs having a tungsten filament (~90° C.), e.g., a housing made of a ceramic material or Bakelite polymer.

The electrical lighting base, such as the exemplary electrical lighting base 16 FIG. 4, may have an extern al ridge or skirt 515 on an outer diameter of an upper surface of the base 16. This skirt 515, sized to match the outer diameter of a corresponding bulb socket or non-threaded bulb, may facilitate proper alignment of the socket 18 with the base 16 during assembly, for engagement of the pins 34*a*, 34*b* with the corresponding openings 36*a*, 36*b* may facilitate alignment of the socket 18 with the base 16 during assembly, positioning the pins 34*a*, 34*b* to properly align with the openings 36*a*, 36*b*.

The electrical lighting base 16 of FIG. 4 may have the same configuration from as a VIVA GREEN LIGHTING brand model 3.07.03.30025(6) electrical lighting base (i.e., the base portion of VIVA GREEN LIGHTING brand removable fluorescent ballasts/base pairs, e.g., VIVA GREEN LIGHTING brand models SU13, SU16, SU23, etc.) (available from Shanghai VIVA Eco. Electronics & Technology Co., Ltd.) modified to be made of a material resistant to temperatures generated by ordinary incandescent light bulbs having a tungsten filament (~90° C.), e.g., made of a ceramic material or Bakelite polymer. In the alternative, however, the electrical lighting base 16 may also comprise one or more of the foregoing means for preventing a removable incandescent bulb socket 18 from being reconnected to the electrical lighting base 16 when either (i) the removable incandescent bulb socket 18 has been removed from the electrical lighting base 16 or (ii) a fluorescent lighting ballast has been coupled to the electrical lighting base 16, or (iii) both the removable incandescent bulb socket 18 has been removed from the electrical lighting base 16 and a fluorescent lighting ballast has been coupled to the electrical lighting base 16, or responsive to some other low-energy usage triggering event (none of which are found in the VIVA GREEN LIGHTING brand model 3.07.03.30025(6) electrical lighting base).

Figure 7:
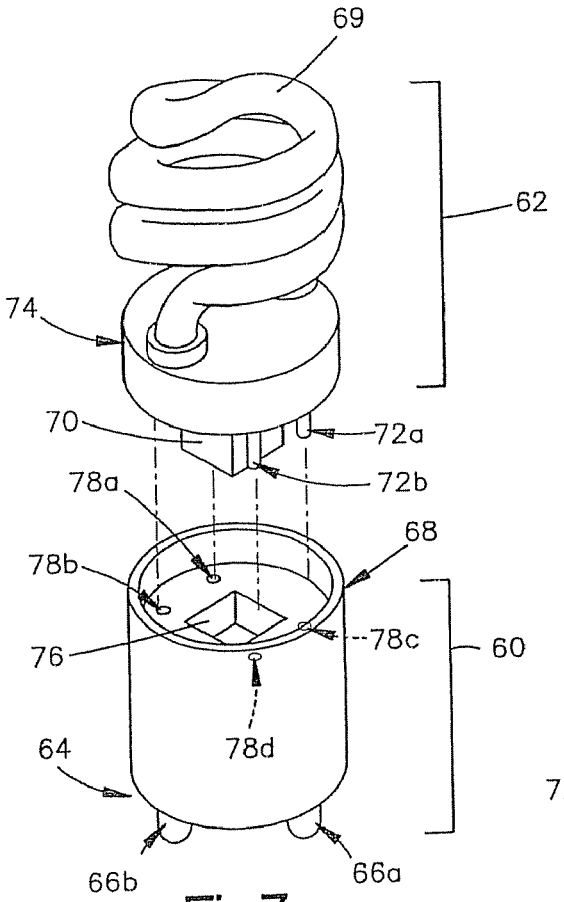
FIGS. 7 and 8 are views of a fluorescent light bulb and ballast.
Figure 8:
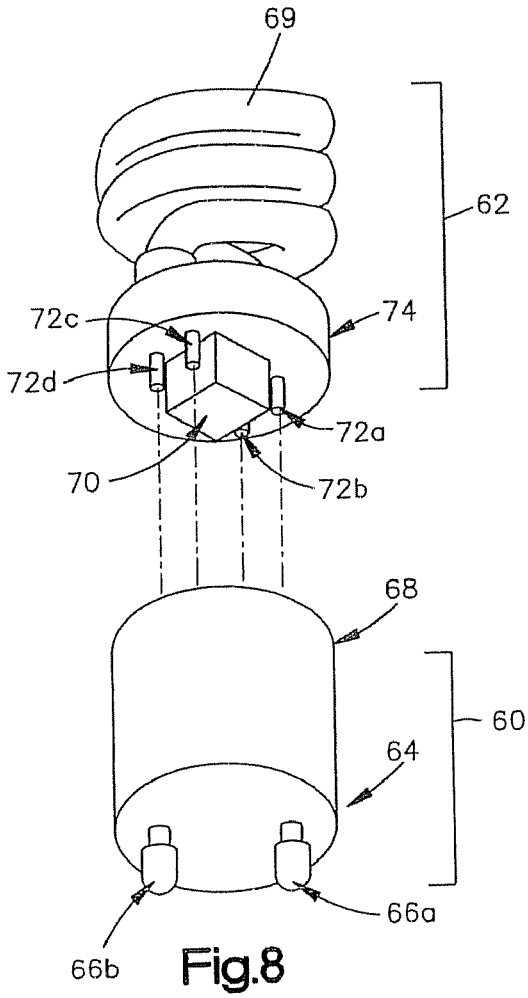

FIGS. 7 and 8 illustrate an exemplary removable ballast 60 and fluorescent light bulb 62 used in accordance with the various methods of the invention. The ballast 60 has a first end 64 that is adapted to be removably received by an electrical lighting base 16. In the particular embodiment shown, the first end 64 has two extensions (pins 66*a*, 66*b*) extending from the first end 64 of the ballast 60. Preferably, the longitudinal axes of the pins 66*a* and 66*b* are substantially parallel to a longitudinal axis of the ballast 60. In the embodiment shown, the external portion of pins 66*a*, 66*b* are substantially the same configuration (i.e., wider and narrower portions) as pins 34*a*, 34*b* of incandescent bulb socket 18 to permit the ballast 60 to be removably coupled to the base 16 by inserting the extensions 66*a* and 66*b* into the openings 36*a* and 36*b* and turning the ballast 60 in a clockwise manner relative to the base 16. The electrical contacts of base 16 engage pins 66*a*, 66*b* to provide electricity to the ballast circuitry within ballast 60.

The ballast 60 also has a second end 68 that is adapted to receive and deliver electricity to a fluorescent light bulb 62. In the particular illustrative embodiments shown, the fluorescent light bulb 62 has a tube 69, an alignment key 70 and four conductors 72*a*, 72*b*, 72*c*, and 72*d* extending from a first end 74 of the fluorescent light bulb 62. Preferably, the longitudinal axes of the extensions 70, 72*a*, 72*b*, 72*c*, and 72*d* are substantially parallel to the longitudinal axis of the ballast 60. Conductors 72*a*-72*d* are preferably contacts that extend into the fluorescent lamp, as known to those in the art. Finally, the second end 68 of the ballast 60, has five openings: opening 76, which accepts alignment key 70 and openings 78*a*, 78*b*, 78*c*, 78*d*, each of which accepts one of the conductors 72*a*-72*d*. As known to those skilled in the art, the ballast 60 provides proper voltages via contacts associated with openings 78*a*-78*d* to conductors 72*a*-72*d* to cause the gases within tube 69 to provide illumination. A suitable ballast is available from VIVA GREEN LIGHTING as model 3.07.03.30022 ballast (i.e., the ballast portion of VIVA GREEN LIGHTING brand removable fluorescent ballasts/base pair model SU13). Suitable fluorescent light bulbs compatible with this ballast are also available from Shanghai VIVA Eco. Electronics & Technology Co., Ltd. In the alternative, however, the ballast 60 may also comprise one or more of the foregoing means for preventing a removable incandescent bulb socket from being reconnected to the electrical lighting base when a fluorescent lighting ballast has been coupled to the electrical lighting base 16, or responsive to some other low-energy usage triggering event (none of which are found in the VIVA GREEN LIGHTING brand model 3.07.03.30022 ballast).

Figure 9:
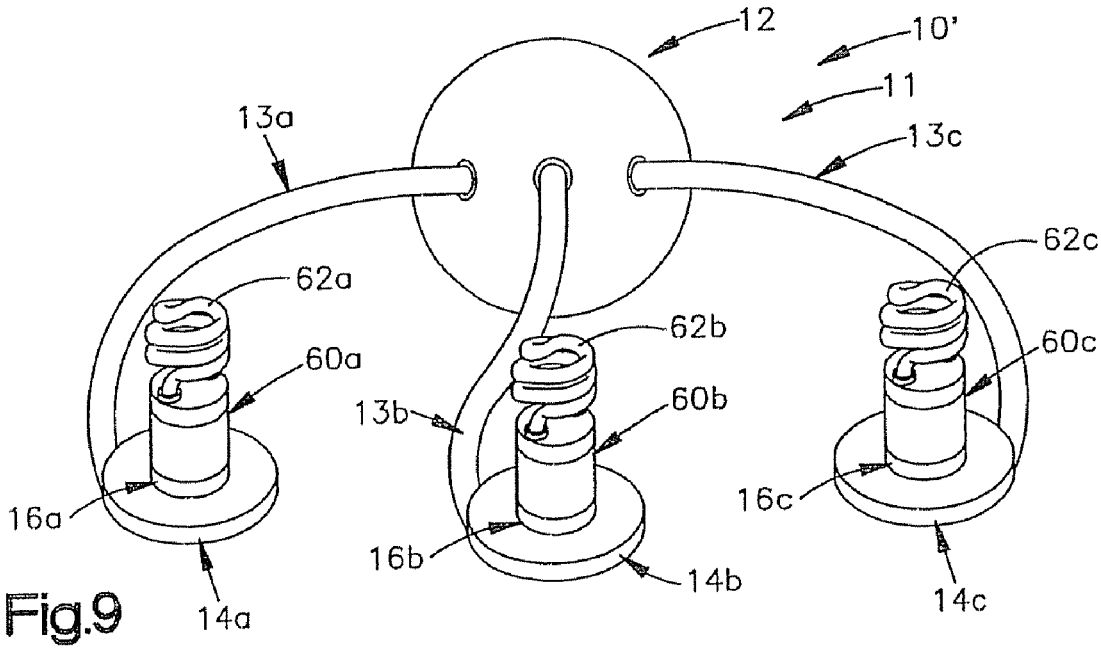
FIG. 9 is a side view of an exemplary fluorescent light fixture.
Figure 10:
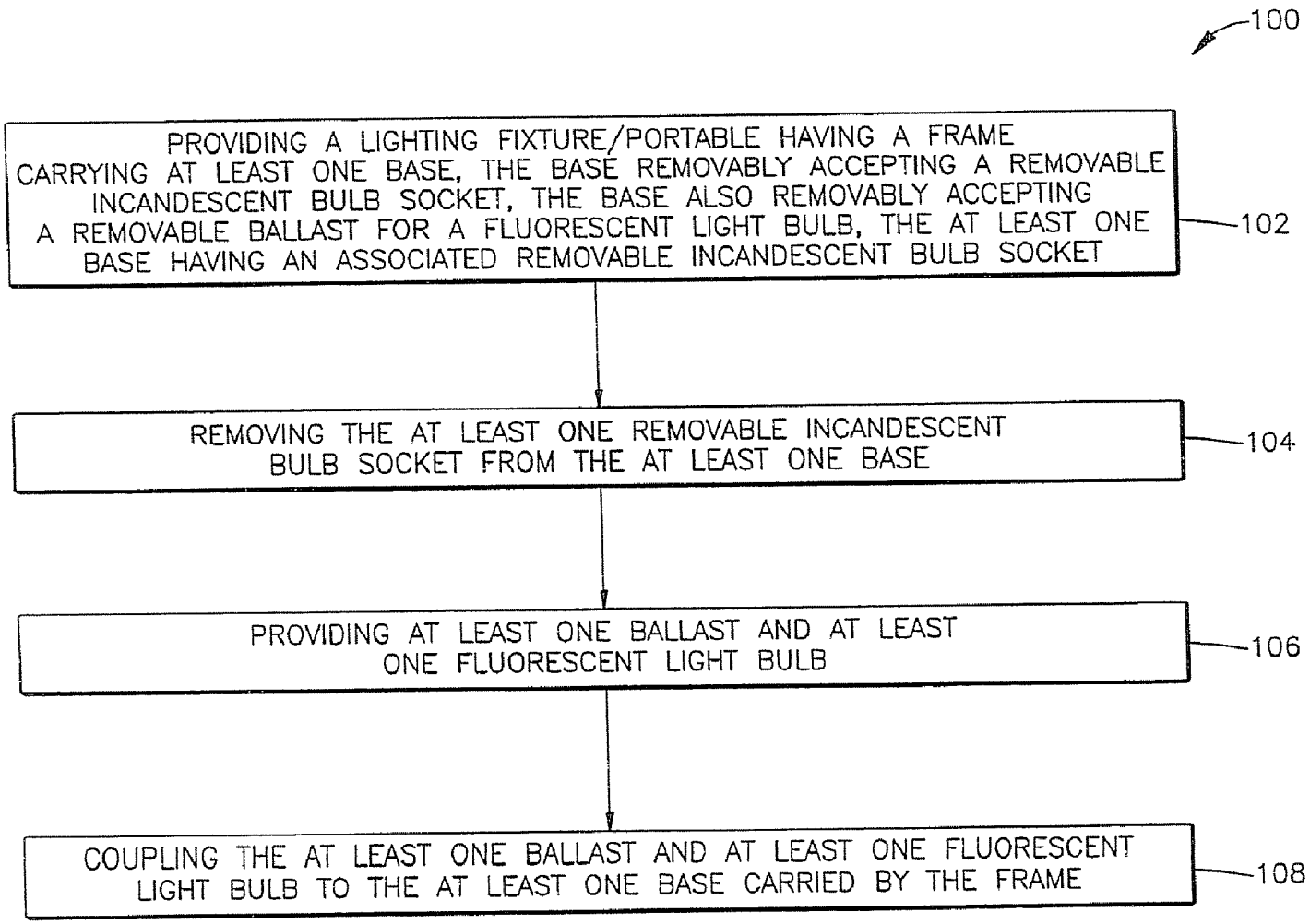
FIG. 10 is an exemplary method of converting an incandescent lighting fixture or portable to a lower power lighting fixture or portable.

FIG. 9 shows an exemplary fixture 10' resulting from performing an exemplary method 100 of the present invention, as shown in FIG. 10. Referring now to FIG. 10, the exemplary method 100 comprises a first step 102 of providing a lighting fixture or portable having a frame carrying at least one base, the base removably receiving a removable incandescent bulb socket, the base also removably receiving a ballast for a fluorescent light bulb, the at least one base having an associated removable incandescent bulb socket. Exemplary lighting fixtures resulting from this step are shown in FIGS. 3A and 3B (and in FIG. 2 with associated removable incandescent bulb sockets). Next at 104, the method continues by the at least one removable incandescent bulb socket being removed from the at least one base, resulting in a fixture exemplified by FIG. 2. Next, at step 106, at least one ballast and at least one fluorescent light bulb is provided, preferably one for each base 16. Finally, at step 108, the at least one ballast and at least one fluorescent light bulb is coupled to the at least one base carried by the frame.

The resulting exemplary fixture 10' shown in FIG. 9 has a frame 11, having a body 12 and three arms 13*a*, 13*b*, and 13*c*, with each arm 13*a*, 13*b*, and 13*c* carrying a bobeche 14 (referred to as bobeche 14*a*, 14*b*, and 14*c*, respectively), each of which bobeche 14 in turn carries an electrical lighting base 16 (referred to as base 16*a*, 16*b*, and 16*c*, respectively). Thus, the frame 11 carries at least one electrical lighting base 16, with each of the three arms 16 carrying an electrical lighting base 16. In the configurations of FIGS. 3A and 3B, the bases 16*a*, 16*b*, and 16*c* are shown coupled to three fluorescent ballasts 60*a*, 60*b*, and 60*c*, and in turn, the three fluorescent ballasts 60*a*, 60*b*, and 60*c* are receiving three fluorescent light bulbs 62*a*, 62*b*, and 62*c*.

Preferably the removable incandescent bulb socket 18 may be removed from the base 16 and replaced with a fluorescent ballast 60, preferably a removable ballast 60. The removable incandescent bulb socket 18 and the removable ballast 60 may be freely exchanged, with one being removed from the base 16 and the other being coupled to the base 16 in its place. In the alternative, according to the present invention it may be helpful, e.g., for energy-efficiency certification, to prevent a removable incandescent bulb socket 18 from being reconnected to the electrical lighting base 16 when either (i) the removable incandescent bulb socket 18 has been removed from the electrical lighting base 16 or (ii) a fluorescent lighting ballast has been coupled to the electrical lighting base 16, or (iii) both the removable incandescent bulb socket 18 has been removed from the electrical lighting base 16 and a fluorescent lighting ballast has been coupled to the electrical lighting base 16. This may be accomplished by any one or more means for preventing a removable incandescent bulb socket from being reconnected to the electrical lighting base, e.g., (a) any one or more spring-loaded electrical contacts associated with the base 16 and/or socket 18 and/or ballast 60 that initially provide electricity to the bulb 20, but that extend or retract when any of the three foregoing conditions are met to effectively prevent a removable incandescent bulb socket 18 from being mechanically and/or electrically reconnected to the electrical lighting base 16; and/or (b) any one more spring-loaded pins, cams, guides, or other structures associated with the base 16 and/or socket 18 and/or ballast 60 that initially are out of the way, but that extend or retract to physically interfere with other structures when any of the three foregoing conditions are met to effectively prevent a removable incandescent bulb socket 18 from being mechanically and/or electrically reconnected to the electrical lighting base 16; and/or (c) a bulb socket 18 that separates into two or more pieces, rendering it unusable, during the process of meeting any of any of the three foregoing conditions, e.g., the socket 18 breaks into two or more pieces when it is removed from or released from the base 16; and/or (d) any one more spring-loaded pins, cams, guides, or other structures associated with the base 16 and/or socket 18 and/or a non-removable ballast that initially are out of the way, but that extend or retract to physically interfere with other structures when any of the three foregoing conditions are met to effectively prevent the non-removable ballast from being removed from the base 16 (in this case the removable incandescent bulb socket 18 is prevented from being reconnected to the electrical lighting base 16 by the fluorescent ballast 60, which is prevented from being removed and which blocks the socket 18 from being re-coupled to the base 16); and/or (e) any one more rings, bridges, ties, tape, films, or other structures associated with the base 16 and/or socket 18 that initially affix the socket 18 to the base 16 so that the socket 18 is mechanically and electrically coupled to the base 16, which are rings, bridges, ties, tape, films, or other structures cut or otherwise severed or disengaged when any of the three foregoing conditions are met (e.g., in order to do so) so that there is not sufficient structure to re-connect the removable incandescent bulb socket 18 in mechanical connection and/or electrical reconnection to the electrical lighting base 16; and/or (f) electronic circuitry in the base 16 and/or socket 18 (and/or perhaps somewhere else in the lighting product, e.g., in the base portion of a portable or in the plate of a fixture) that prevents an incandescent light bulb socket from properly functioning once one of the three foregoing conditions has been met (all not shown). This circuitry may detect energy usage levels of the lighting product, or a part thereof, and/or detect signals generated by a functioning fluorescent lighting ballast, and responsively thereafter prevent higher-energy usage, as would be expected to permit an incandescent light bulb to function.

In the exemplary method of the present invention shown in FIG. 10, it is preferable for any bases 16 and/or any removable incandescent light bulb sockets 18 and/or any fluorescent light ballasts 60 to include one or more of the foregoing means for preventing a removable incandescent bulb socket from being reconnected to the electrical lighting base when either (i) the removable incandescent bulb socket 18 has been removed from the electrical lighting base 16 or (ii) a fluorescent lighting ballast has been coupled to the electrical lighting base 16, or (iii) both the removable incandescent bulb socket 18 has been removed from the electrical lighting base 16 and a fluorescent lighting ballast has been coupled to the electrical lighting base 16, or responsive to some other low-energy usage triggering event.

Examples of the structures (a)-(f) discussed above corresponding to the means for preventing a removable incandescent bulb socket from being reconnected to the electrical lighting base are set forth below.

As one example, the base or socket or ballast may have a key lock assembly. For example, the end of the incandescent bulb socket that is removably received by the base may have one or more structures that extend from the incandescent bulb socket in a direction substantially parallel to the longitudinal axis of the incandescent bulb socket when the incandescent bulb socket is released from the base. Preferably, the base is configured or adapted such that it cannot removably receive the incandescent bulb socket once the structures have extended from the incandescent bulb socket. Preferably, the structures irreversibly extend from the base. The structures may be any suitable size and shape and may be made of any suitable material, e.g. plastic or metal, and may be spring-loaded. For example, the structures may be spring-loaded pins.

As another example, the incandescent socket breaks apart after it is removed from the base, and thus cannot be re-coupled to the base.

As yet another example, a band is broken or cut on the incandescent bulb socket in order to remove the incandescent bulb socket. For instance, there might be a piece of removable material substantially surrounding both the base and incandescent bulb socket such that the material couples the incandescent bulb socket to the base. The user then removes the material to remove the incandescent bulb socket, and consequently, the incandescent bulb socket cannot be re-coupled to the base. The material may be made of any suitable material, e.g. plastic, and may have attached thereto a label indicating that the structure is to be removed to release the incandescent bulb socket.

As still another example, the base or socket or ballast may have a spring-loaded cam or reverse cam assembly. For example, the end of the incandescent bulb socket that is removably received by the base has a one-way cam assembly that is, for example, spring-loaded. The user then pushes inward on the cam assembly to remove the incandescent socket, and upon doing so, the cam assembly irreversibly rotates such that the incandescent bulb socket is released from the base and cannot be re-coupled to the base. The cam assembly may be spring-loaded and contain one or two cams.

As yet another example, the end of the base that removably receives the incandescent bulb socket may have one or more structures that extend in a direction substantially parallel to the longitudinal axis of the incandescent bulb socket when the incandescent bulb socket is removed from the base. The structures may be spring loaded and preferably, the structures irreversibly extend from the incandescent bulb socket. The end of the incandescent bulb socket that is removably received by the base preferably lacks one or more indentations such that it cannot be re-coupled to the base. Preferably, however, once the incandescent bulb socket has been removed, a user may then couple a fluorescent ballast having, for example, one or more indentations on the end of the ballast that receives the base that correspond to the structures. The structures may be any suitable size and shape and may be made of any suitable material, e.g. plastic or metal, and may be spring-loaded. For example, the structures may be spring-loaded pins.

As still another example, the end of the incandescent bulb socket that is removably received by the base may have one or more structures that extend in a direction substantially perpendicular to the longitudinal axis of the incandescent bulb socket when the incandescent bulb socket is removed from the base. Preferably, the base is configured or adapted such that it cannot removably receive the incandescent bulb socket once the structures have extended from the incandescent bulb socket. Preferably, the structures irreversibly extend from the incandescent bulb socket. The structures may be any suitable size and shape and may be made of any suitable material, e.g. plastic or metal, and may be spring-loaded. For example, the structures may be spring-loaded pins.

As another example, the end of the base that removably receives the incandescent bulb socket may have one or more structures that extend in a direction substantially perpendicular to the longitudinal axis of the incandescent bulb socket when the incandescent bulb socket is removed from the base. The structures preferably extend in a direction from the base such that they would interact with the incandescent bulb socket if a user would attempt to re-couple the incandescent bulb socket to the base. Preferably, the structures irreversibly extend from the incandescent bulb socket. The end of the incandescent bulb socket that is removably received by the base preferably lacks one or more indentations such that it cannot be re-coupled to the base. Preferably, however, once the incandescent bulb socket has been removed, a user may then couple a fluorescent ballast having, for example, one or more indentations on the end of the ballast that receives the base that correspond to the structures. The structures may be any suitable size and shape and may be made of any suitable material, e.g. plastic or metal, and may be spring-loaded. For example, the structures may be spring-loaded pins.

Figure 11B:
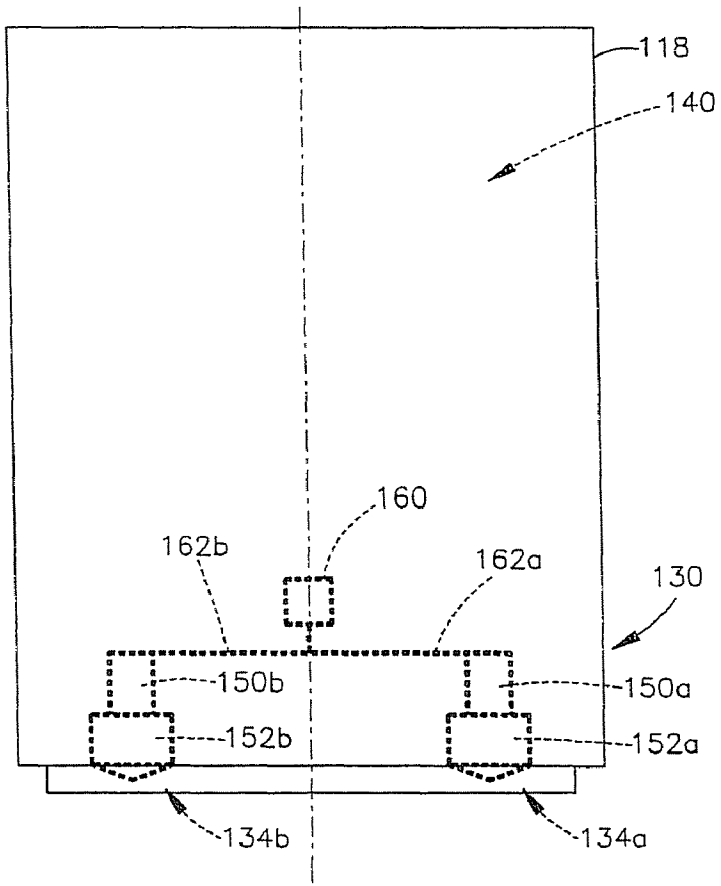
FIGS. 11A and 11B are side views of an exemplary means for preventing a removable incandescent bulb socket or non-threaded incandescent bulb from being re-coupled to an electrical lighting base.
Figure 11A:
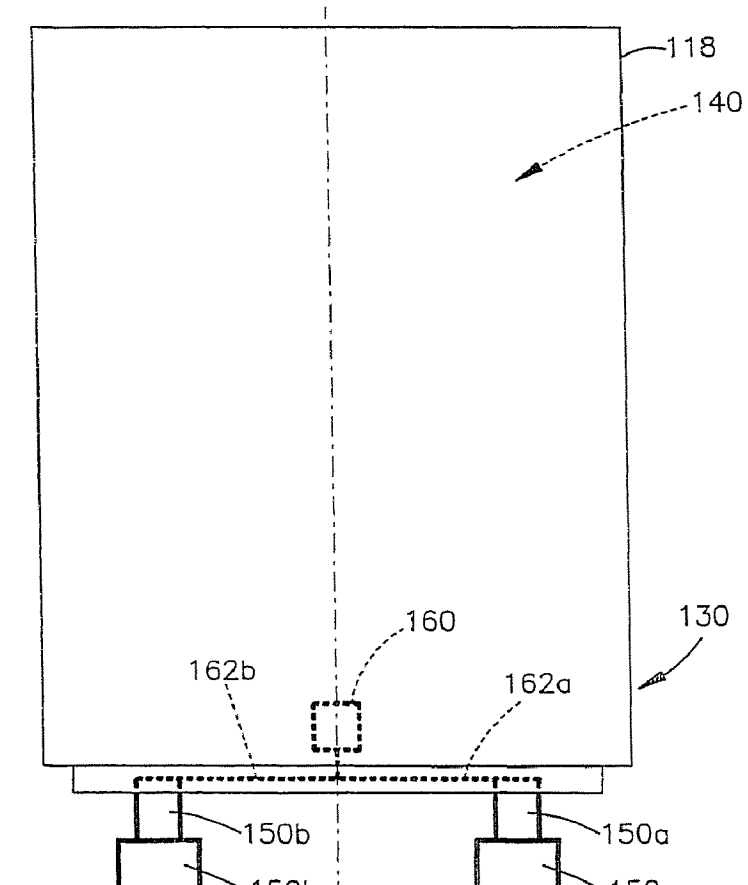

One such example is shown in FIGS. 11A and 11B, which show a removable incandescent bulb socket 118, which preferably is configured so that it may be used with certain commercially available electrical lighting bases, e.g., VIVA GREEN LIGHTING brand model 3.07.03.30025(6) base portion of VIVA GREEN LIGHTING brand removable fluorescent ballasts/base pairs, e.g., VIVA GREEN LIGHTING brand models SU13, SU16, SU23, etc. The exemplary removable incandescent bulb socket 118 is substantially the same as removable incandescent bulb socket 18 described above, having a pair of electrical contact pins 134*a*, 134*b* which are substantially the same as pins 34*a*, 34*b* described above, and having threads 140 which are substantially the same as threads 40 described above. Socket 118 as shown includes means for preventing the removable incandescent bulb socket 118 from being re-connected to an electrical lighting base 16. More specifically, electrical contacts 134*a*, 134*b* of bulb socket 118 are spring-loaded electrical contacts 134*a*, 134*b* that are spring-biased to retract into openings in one end 130 of removable socket 118.

FIG. 11A shows the socket 118 with the electrical contacts 134*a*, 134*b* extended, as would be the case when the socket 118 has been installed into a base 16 (the narrow portion 56 of the openings 36 prevent the spring-loaded electrical contacts 134*a*, 134*b* from retracting). FIG. 11B shows the socket 118 with the electrical contacts 134*a*, 134*b* retracted, as would be the case when the socket 118 is removed from the base 16. When the socket 118 is removed from the base 16, the spring-loaded electrical contacts 134*a*, 134*b* retract, preventing the socket 118 from being readily re-coupled to the base 16. The pins 134*a*, 134*b* need not retract all the way into the socket 118; it is sufficient if they withdraw enough that they cannot be readily extended into the configuration of FIG. 11A for re-coupling to the base 16.

The removable incandescent bulb sockets 118 are preferably coupled to their respective bases 16 during manufacture or assembly. Thus, any lighting product using the exemplary removable incandescent bulb sockets 118 are preferably shipped with the sockets 118 already coupled to their respective bases 16. In the alternative, those in the lighting product distribution channel may couple the sockets 118 to the bases 16. During coupling to the base 16, the electrical contacts 134*a*, 134*b* are extended so that the socket 118 has the configuration of FIG. 11A. A corresponding tool may be used by personnel coupling the sockets 118 to the bases 16. Electrical contacts 134*a*, 134*b* may be spring-loaded before or after the socket 118 is coupled to the base 16. With the electrical contacts 134*a*, 134*b* held in the configuration of FIG. 11A, e.g., with the corresponding tool, the socket 118 may be coupled to the base 16 by aligning the socket 118 with a base 16, inserting the electrical contacts 134*a*, 134*b* into openings 36*a*, 36*b* of base 16, and rotating at least one of the base 16 and the socket 118 with respect to the other. Any corresponding tool used to hold electrical contacts 134*a*, 134*b* in the configuration of FIG. 11A could then be withdrawn. If the electrical contacts 134*a*, 134*b* are not spring-loaded prior to the socket 118 being coupled to the base 16, one or more springs may be operatively connected to the electrical contacts 134*a*, 134*b* to provide a spring force that tends to force them into the configuration of FIG. 11B prior to finishing assembly of the socket 118 after being coupled to base 16. If the electrical contacts 134*a*, 134*b* are spring-loaded prior to the socket 118 being coupled to the base 16, the spring-loaded electrical contacts 134*a*, 134*b* may have an associated pin 160, which can be used to cause the springloaded electrical contacts 134*a*, 134*b* to move into the extended configuration of FIG. 11A. Pin 160 may have an operative link 162*a* between the pin 160 and the one spring-loaded electrical contacts 134*a* and an operative link 162*b* between the pin 160 and the other spring-loaded electrical contacts 134*b* operatively connecting the pin 160 to the electrical contacts 134*a*, 134*b* so that when the pin 160 is pushed downward, the spring-loaded electrical contacts 134*a*, 134*b* are moved into the extended configuration of FIG. 11A for assembly. Of course, these operative links 162*a*, 162*b* should not short out the contacts 134*a*, 134*b*, which must remain electrically isolated. Similarly, the pin 160 should not be placed in a position that would interfere with the central contact (not shown) of socket 118. The operative links 162*a*, 162*b* may require more than one action be performed to permit the pin 160 from being pushed to extend the electrical contacts 134*a*, 134*b*, e.g., one opening has a first, spring-loaded pin that must be pushed in half-way before a second pin in a second opening can be pushed to operate the operative links 162*a*, 162*b* to extend the electrical contacts 134*a*, 134*b* into the position of FIG. 11A for coupling to base 16 (not shown). In the foregoing configuration, pushing the first pin more or less than a nominal amount will lock out the second pin from extending the contacts 134*a*, 134*b*. Many configurations are possible, e.g., mechanisms that much be pushed, pulled, slid, twisted, and/or rotated, etc. before a pin may be actuated to extend contacts 134*a*, 134*b*. To help further prevent someone from re-coupling a socket 118 that has been removed to a base 16, whichever opening(s) (not shown) is/are used to either (i) insert the corresponding electrical contact springs or (ii) access the pin 160 during manufacturing are preferably covered, e.g., by positioning a cover or contact (e.g., the central contact 44) over the opening and affixing it in place, e.g., by adhesive, soldering, heat welding, ultrasonic welding, solvent welding, etc. Additionally, such openings are preferably small enough and configured (e.g., small, cylindrical openings) to prevent a user from extending the electrical contacts 134*a*, 134*b* by merely inserting a screw driver into an opening and pushing or twisting.

Figure 12B:
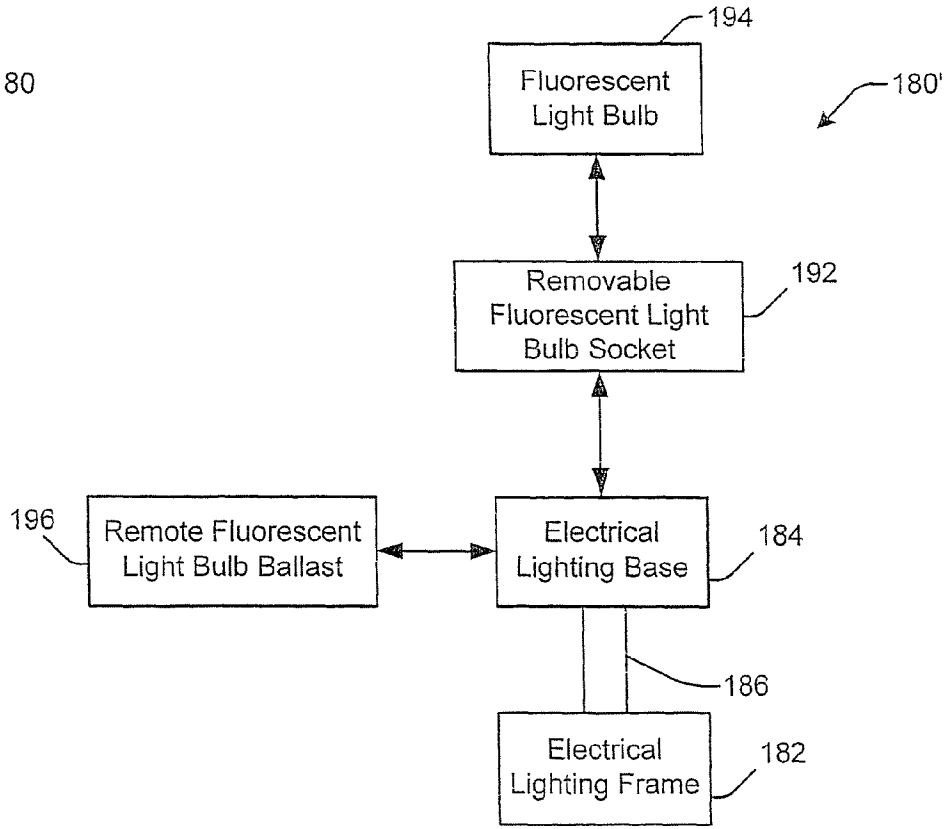
FIGS. 12A, 12B, and 13 are schematic block diagrams of additional exemplary lighting products according to the present invention having remote fluorescent light bulb ballasts.
Figure 12A:
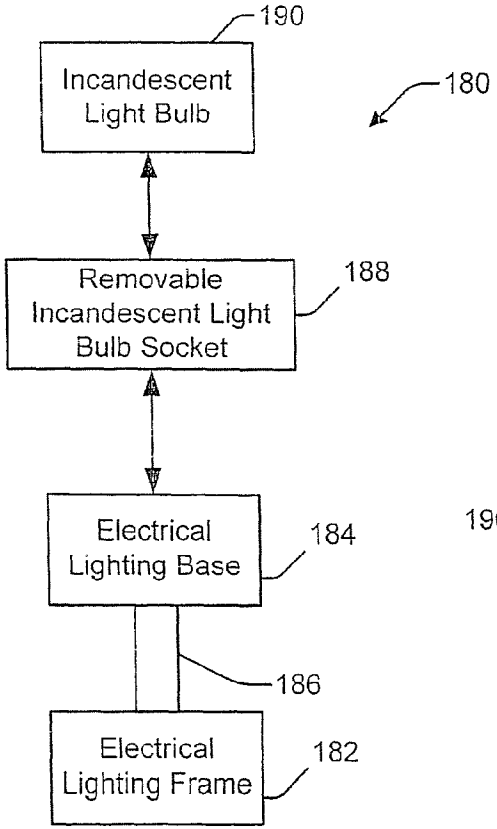

FIGS. 12A and 12B are high-level block diagrams showing additional exemplary lighting products 180 and 180' according to the present invention having remote fluorescent light bulb ballasts. Exemplary lighting products 180 and 180' comprises a frame 182 carrying at least one electrical lighting base 184. The at least one base 184 may be carried by one or more structures, e.g., carried by at least one arm 186, of the lighting product 180, 180'. The at least one base 184 removably receives, and is electrically coupled to, a removable incandescent bulb socket 188 (FIG. 12A), which accepts an incandescent light bulb 190. Electricity powering the incandescent light bulb 190 is provided via the electrical lighting base 184 to the socket 188. As shown in FIG. 12B, the electrical lighting base 184 also removably receives a removable fluorescent light bulb socket 192 for a fluorescent light bulb 194. The fluorescent light bulb 194 is powered by a remote fluorescent light bulb ballast 196 via electrical lighting base 184 and removable fluorescent light bulb socket 192. The remote fluorescent light bulb ballast 196 is preferably positioned away from the base 184, e.g., behind a back plate, behind a canopy (ceiling cover plate), or within a wiring box associated with the lighting product 180'. The remote fluorescent light bulb ballast 196 may also be built-in behind a wall, e.g., proximate the fixture. Preferably, the electrical lighting base 184 is both mechanically coupled and electrically coupled to the removable incandescent bulb socket 188 and/or the removable fluorescent light bulb socket 192, e.g., the base 184 has openings for accepting and retaining electrical contacts of the removable incandescent bulb socket 188 and the removable fluorescent light bulb socket 192 (not shown in FIGS. 12A and 12B; examples are shown in FIGS. 2-8). In the alternative, the electrical lighting base 184 may be mechanically coupled to the removable incandescent bulb socket 188 and/or the removable fluorescent light bulb socket 192, with electricity being provided by additional conductors (not shown), e.g., external wires extending to the base 184 and/or the removable incandescent bulb socket 188 and/or the removable fluorescent light bulb socket 192.

Figure 13:
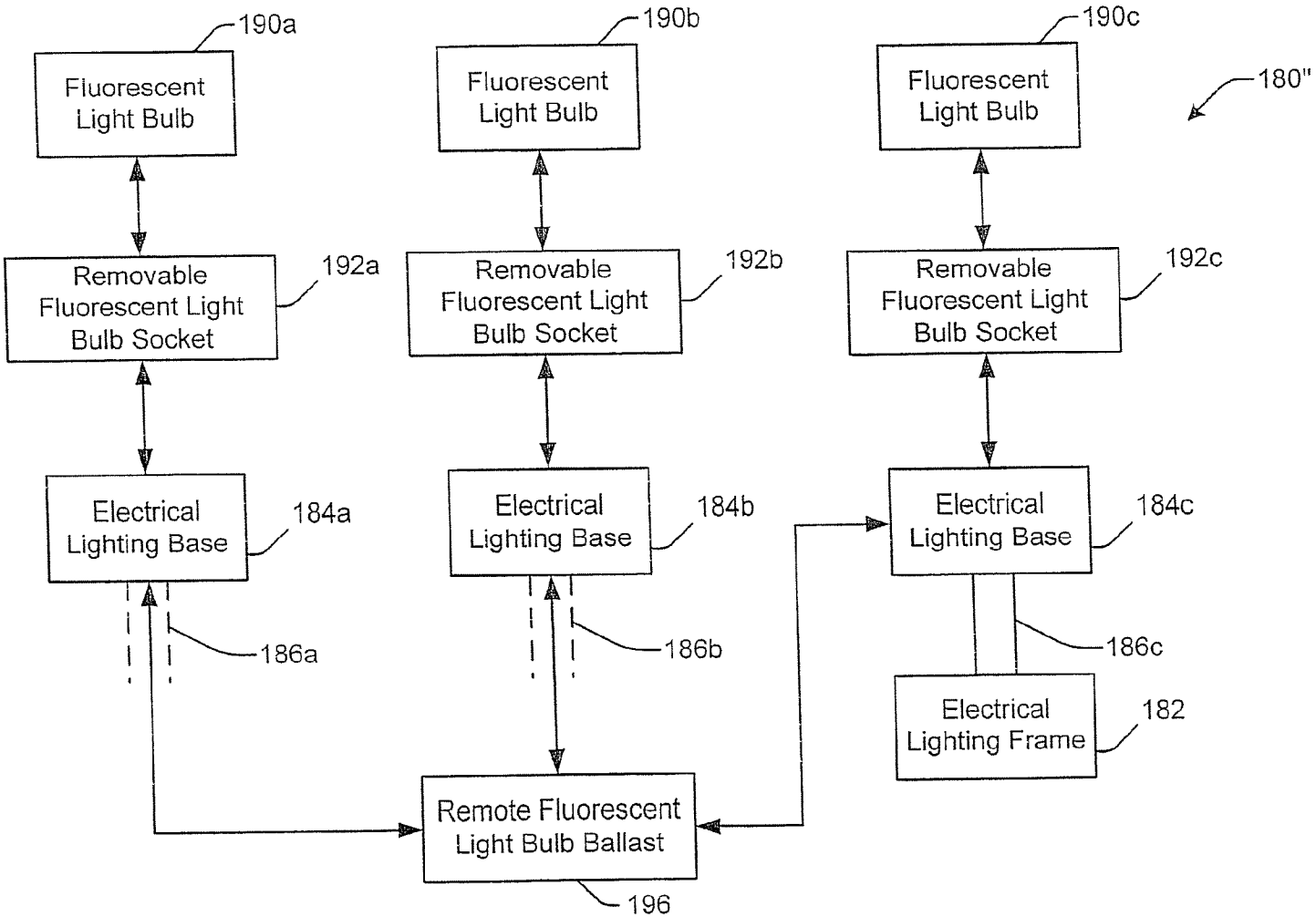

FIG. 13 shows a lighting product 180" very similar to lighting product 180', with the remote fluorescent light bulb ballast 196 providing electricity to a plurality of fluorescent light bulbs 194*a*, 194*b*, 194*c* via a plurality of removable fluorescent light bulb sockets 192*a*, 192*b*, 192*c* carried by a plurality of electrical lighting bases 184*a*, 184*b*, 184*c*. As with the embodiment of FIG. 12B, preferably, the electrical lighting bases 184*a*, 184*b*, 184*c* are both mechanically coupled and electrically coupled to the removable incandescent bulb sockets 188*a*, 188*b*, 188*c* and/or the removable fluorescent light bulb sockets 192*a*, 192*b*, 192*c*, e.g., the bases 184*a*, 184*b*, 184*c* have openings for accepting and retaining electrical contacts of the removable incandescent bulb sockets 188 and the removable fluorescent light bulb sockets 192*a*, 192*b*, 192*c* (not shown in FIG. 13; examples are shown in FIGS. 2-8). In the alternative, the electrical lighting bases 184*a*, 184*b*, 184*c* may be mechanically coupled to the removable incandescent bulb sockets 188 and/or the removable fluorescent light bulb sockets 192*a*, 192*b*, 192*c*, with electricity being provided by additional conductors (not shown), e.g., external wires extending to the bases 184*a*, 184*b*, 184*c* and/or the removable incandescent bulb sockets 188 and/or the removable fluorescent light bulb sockets 192*a*, 192*b*, 192*c*. The bases 184*a*, 184*b*, 184*c* may each be carried by one or more structures, e.g., carried by at least one arm 186*a*, 186*b*, 186*c*, of the lighting product 180".

In accordance with the discussion above, it may be preferable for any bases 184*a*, 184*b*, 184*c* and/or any removable incandescent light bulb socket(s) 188 and/or any removable fluorescent light bulb sockets 192*a*, 192*b*, 192*c* to include one or more of the foregoing means for preventing a removable incandescent bulb socket from being reconnected to the electrical lighting base when either (i) the removable incandescent bulb socket has been removed from the electrical lighting base or (ii) a fluorescent light bulb socket has been coupled to the electrical lighting base, or (iii) both the removable incandescent bulb socket has been removed from the electrical lighting base and a removable fluorescent light bulb sockets has been coupled to the electrical lighting base, or responsive to some other low-energy usage triggering event.

More specifically in the context of FIGS. 12A, 12B, and 13, this may be accomplished by any one or more means for preventing a removable incandescent bulb socket 188 from being reconnected to the electrical lighting base 184, e.g., (a) any one or more spring-loaded electrical contacts associated with the base 184 and/or socket 188 and/or socket 192 that initially provide electricity to the bulb 190, but that extend or retract when any of the three foregoing conditions are met to effectively prevent a removable incandescent bulb socket 188 from being mechanically and/or electrically reconnected to the electrical lighting base 184; and/or (b) any one more spring-loaded pins, cams, guides, or other structures associated with the base 184 and/or socket 188 and/or socket 192 that initially are out of the way, but that extend or retract to physically interfere with other structures when any of the three foregoing conditions are met to effectively prevent a removable incandescent bulb socket 188 from being mechanically and/or electrically reconnected to the electrical lighting base 184; and/or (c) a bulb socket 188 that separates into two or more pieces, rendering it unusable, during the process of meeting any of any of the three foregoing conditions, e.g., the socket 188 breaks into two or more pieces when it is removed from or released from the base 184; and/or (d) any one more spring-loaded pins, cams, guides, or other structures associated with the base 184 and/or socket 188 and/or a non-removable socket 192 that initially are out of the way, but that extend or retract to physically interfere with other structures when any of the three foregoing conditions are met to effectively prevent the non-removable socket 192 from being removed from the base 184 (in this case the removable incandescent bulb socket 188 is prevented from being reconnected to the electrical lighting base 184 by the fluorescent socket 192, which is prevented from being removed and which blocks the socket 188 from being re-coupled to the base 184); and/or (e) any one more rings, bands, bridges, ties, tape, films, or other structures associated with the base 184 and/or socket 188 that initially affix the socket 188 to the base 184 so that the socket 188 is mechanically and electrically coupled to the base 184, which rings, bands, bridges, ties, tape, films, or other structures are cut or otherwise severed or disengaged when any of the three foregoing conditions are met (e.g., in order to do so) so that there is not sufficient structure to re-connect the removable incandescent bulb socket 188 in mechanical connection and/or electrical reconnection to the electrical lighting base 184; and/or (f) electronic circuitry in the base 184 and/or socket 188 (and/or perhaps somewhere else in the lighting product, e.g., in the base portion of a portable or in the plate of a fixture) that prevents an incandescent light bulb socket from properly functioning once one of the three foregoing conditions has been met (all not shown in FIGS. 1A and 1B). This circuitry may detect energy usage levels of the lighting product, or a part thereof, and/or detect signals generated by a functioning fluorescent lighting socket 192, and responsively thereafter prevent higher-energy usage, as would be expected to permit an incandescent light bulb to function. These means have been discussed in the context of FIGS. 12A, 12B, and 13; however, these means may also be used in connection with the other embodiments described herein, in the sense that the removable fluorescent ballasts herein, e.g., ballast 60, may include a ballast in circuit communication with a socket accepting a fluorescent bulb, as shown in FIG. 7.

In an exemplary method of the present invention, it is preferable for any bases 184 and/or any removable incandescent light bulb sockets 188 and/or any fluorescent light sockets 192 to include one or more of the foregoing means for preventing a removable incandescent bulb socket 188 from being reconnected to the electrical lighting base 184, responsive to any of the three listed low-energy usage triggering events or responsive to some other low-energy usage triggering event.

Another example of structure corresponding to means for preventing a removable incandescent bulb socket (or non-threaded incandescent bulb) from being reconnected to an electrical lighting base is shown schematically in FIG. 1C. A lower portion of a removable incandescent bulb socket 118*c* is provided with one or more spring loaded fingers 120*c* that extend from a surface of the socket that coincides with a surface of the lighting base when the socket is detached from the lighting base. The extended fingers interfere with the coinciding surface of the lighting base to prevent reassembly of the socket to the base. Alternatively or additionally, the lighting base may be provided with spring-loaded fingers (not shown) that extend from the base upon disassembly of the incandescent socket, while a fluorescent bulb or removable ballast may be provided with openings or other recesses to accommodate the extended fingers.

In another example, shown schematically in FIG. 11D, a rigid protrusion, such as, for example, a dummy pin 120*d*, is provided on the bottom connecting surface of the incandescent bulb socket 118*d* (or non-threaded incandescent bulb). The dummy pin 120*d* aligns with a corresponding opening or slot 20*d* in the lighting base 16*d* when the bulb socket is initially assembled with the lighting base. When the incandescent bulb socket is disassembled from the lighting base, an obstruction, such as a spring 25*d* or some other spring-loaded member disposed in the lighting base, moves to align with a portion of the slot to prevent re-insertion of the dummy pin 120*d* into the slot. A fluorescent ballast, socket, or bulb, provided without a dummy pin (not shown), may still be assembled to the lighting base regardless of the position of the spring 25*d* in the slot 20*d*.

In yet another example, shown schematically in a partially exploded view in FIG. 11E, the incandescent bulb socket 118*e* may be assembled to the lighting base with straight contact pins 134*e* insertable into openings 36*e* and one or more tamper-resistant screws 50*e* with left handed threads that secure the socket 118*e* to the base 16*e* such that the straight pins 134*e* engage electrical contacts (not shown) in the base 16*e*. The tamper resistant screw 50*e* is adapted so that it may be loosened to remove the socket 118*e* from the base 16*e*, but it may not be re-tightened to reassemble the socket to the base. Additionally, a spring 150*e* may be provided on the bottom surface of the socket to prevent the socket 118*e* from being loosely placed on the base 16*e* for subsequent use as an incandescent product.

Figure 16A:
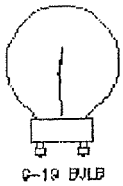
FIGS. 16A-16U are front views of exemplary non-threaded incandescent light bulbs.
Figure 16B:
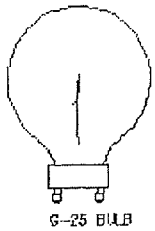
FIG. 16V is an enlarged front view of the exemplary light bulb of FIG. 16M.
Figure 16C:
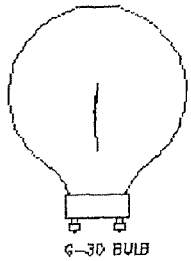
Figure 16D:
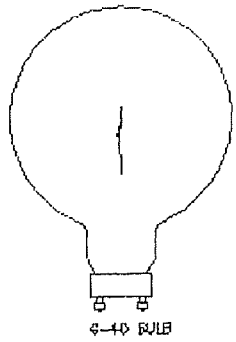
Figure 16E:
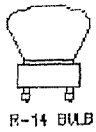
Figure 16F:
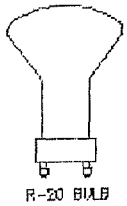
Figure 16G:
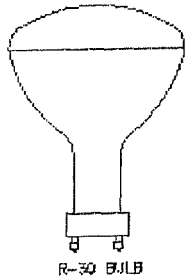
Figure 16H:
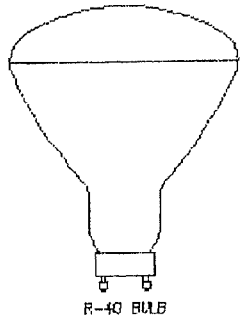
Figure 16I:
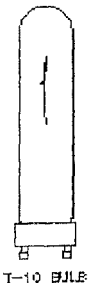
Figure 16J:
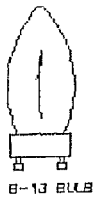
Figure 16K:
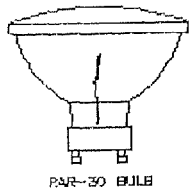
Figure 16L:
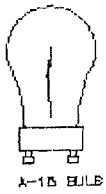
Figure 16M:
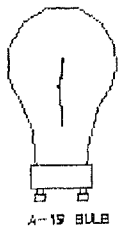
Figure 16N:
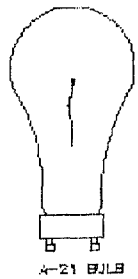
Figure 16O:
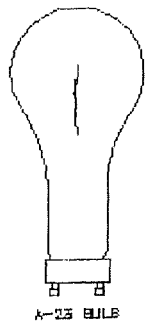
Figure 16P:
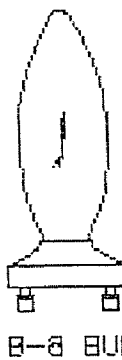
Figure 16Q:
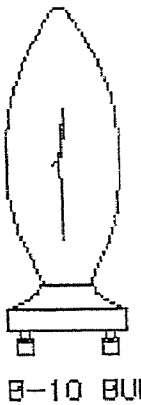
Figure 16R:
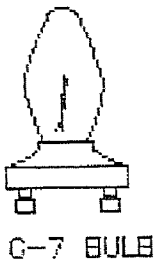
Figure 16S:
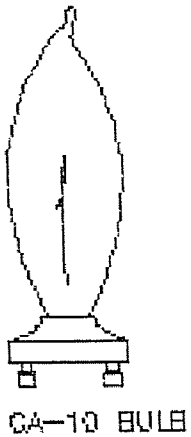
Figure 16T:
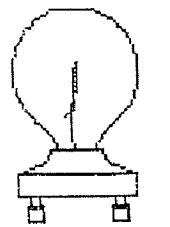
Figure 16U:
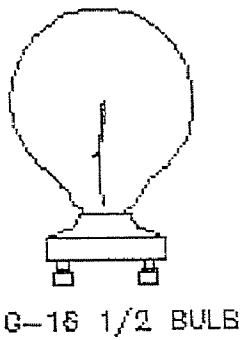

As discussed above, one exemplary means for preventing a removable incandescent bulb socket (or non-threaded incandescent bulb having a special connector, e.g., the bulbs of FIGS. 16A-U) from being re-coupled to the electrical lighting base is by providing a socket that breaks into two or more pieces when it is removed from or released from the base. In one exemplary embodiment, shown schematically in FIGS. 11F-G, a non-reusable socket 118*f* may be provided with an upper socket portion 128*f* for receiving an incandescent light bulb, and a lower socket portion 138*f* for connecting the socket 118*f* to the electrical lighting base. The upper and lower portions are connected by break-away tabs 150*f*, and when assembled to the lighting base, deformable protrusions 136*f* proximate to the contact pins 134*f* are tightly received into the openings 36*f* for electrical and mechanical engagement. The position of the lower socket portion 138*f* in the base may prevent grasping the lower portion to disassemble the socket 118*f* from the base 16*f*, and the force required to remove the protrusions 136*f* from the slots 36*f* is sufficient to shear the break-away tabs 150*f* when grasping the upper socket portion 128*f*, severing both mechanical and electrical connections between the upper and lower socket portions 128*f*, 138*f*. Once the upper socket portion 128*f* is broken off, the lower socket portion 138*f* may be broken away from the base 16*f*, allowing the lighting base to be reused with a fluorescent base, ballast, and/or bulb (not shown).

Figure 11H:
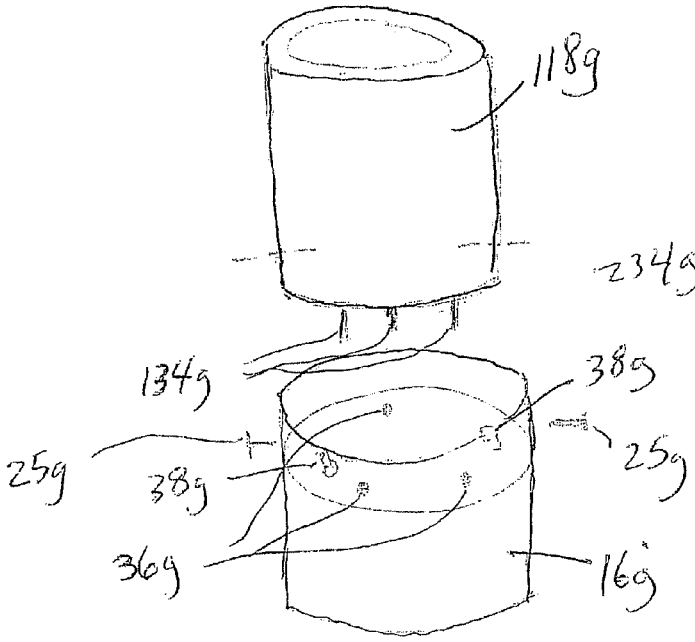
FIGS. 11H and 11I are schematic isometric views of an additional exemplary means for preventing a removable incandescent bulb socket or non-threaded incandescent bulb from being re-coupled to an electrical lighting base.
Figure 11I:
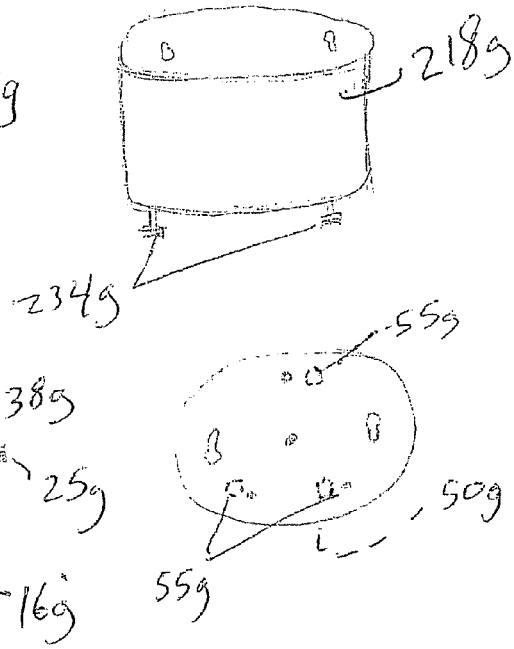

In another example, shown schematically in FIGS. 11H and 11I, an incandescent bulb socket 118*g* (or non-threaded incandescent bulb) is provided with straight pin external contacts 134*g* for insertion into corresponding openings 36*g* in the base 16*g*. The pins 134*g* pass through the openings 36*g* and through aligned openings 55*g* in a rotating cam or disk 50*g* to engage electrical contacts (not shown) within the lighting base 16*g*. Machine screws 25*g* or other fasteners may be provided to secure the socket 118*g* to the base 16*g* in this engaged condition. After removing the incandescent bulb socket 118*g*, a fluorescent bulb socket or ballast 218*g* may be assembled to the base 16*g*, using the pin and opening configuration shown in FIGS. 4 and 6 and described in greater detail above. When the fluorescent socket or ballast 218*g* is rotated to an engaged position, the pins 234*g* engage and rotate the disk 50*g*, moving the openings 55*g* in the disk out of alignment with the openings 36*g* in the upper surface of the base 16*g*. The resulting misalignment between the upper surface openings 36*g* and the disk openings 55*g* prevents subsequent assembly of the incandescent bulb socket or non-threaded incandescent bulb to the base 16*g*.

Figure 14:
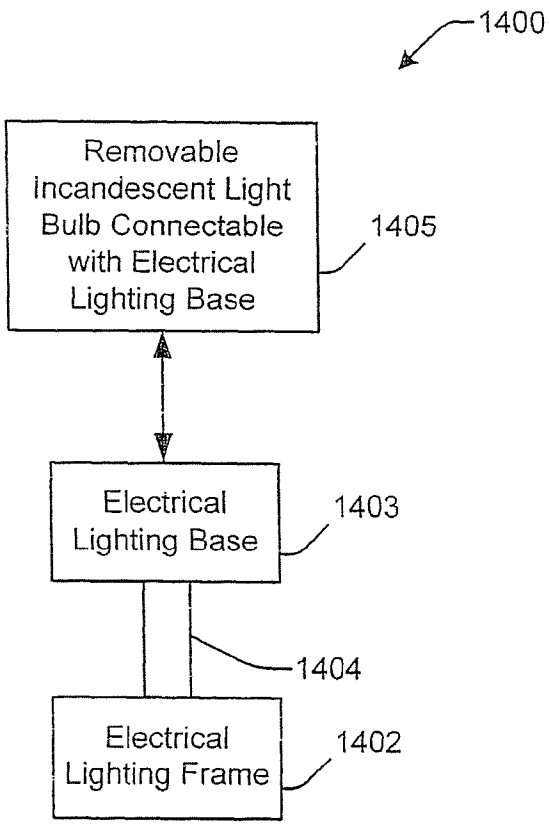

Some of the above systems and methods herein make use of a removable incandescent socket accepting a threaded bulb. These may also be modified to accommodate additional incandescent sources of illumination, such as a non-threaded incandescent light bulb having connectors capable of connecting directly to a lighting base without an intervening threaded socket. For example, FIG. 14 is a high-level block diagrams showing an exemplary lighting product 1400 (i.e., a lighting fixture/portable) according to an alternative exemplary embodiment of the present invention. Exemplary lighting product 1400 comprises a frame or body 1402 directly or indirectly carrying at least one electrical lighting base 1403. The base 1403 may be carried by one or more structures, e.g., carried by at least one arm 1404, of the lighting product 1400. The base 1403 may be the same as any of bases 3, 16, etc. discussed above or below, and may be configured to accept the bottom pins or other connectors of any of the various sockets, bulbs, and ballasts herein. The base 1403 removably receives, and is electrically coupled to, a removable, non-threaded incandescent light bulb 1405 connectable with the electrical lighting base. Electricity powering the incandescent light bulb 1405 is provided via the electrical lighting base 1403 directly to the light bulb 1405. In accordance with the teachings above, the non-threaded incandescent light bulb 1405 connectable with the electrical lighting base bay be provided along with the frame 1402 and at least one electrical lighting base 1403, or may be provided separately therefrom.

The teachings above with respect to converting lighting product 1 of FIG. 1A to the lighting product 1' of FIG. 1B may also be applied to converting the lighting product 1400 to the lighting product 1' of FIG. 1B (in which case the frame 1402 may be the same as frame 2, the electrical lighting base 1403 may be the same as lighting base 3, and the at least one arm 1404 may be the same as the at least one arm 4). Thus, the removable, non-threaded incandescent light bulb 1405 may be removed in accordance with any of the various methods taught herein and replaced with a fluorescent light bulb socket or ballast 7 and coupled to a fluorescent light bulb 8 to form product 1'. Similarly, the teachings above with respect to converting lighting product 180 of FIG. 12A to the lighting product 180' of FIG. 12B and the lighting product 180" of FIG. 13 may also be applied to converting the lighting product 1400 to the lighting product 180' of FIG. 12B and/or the lighting product 180" of FIG. 13 (in which case the frame 1402 may be the same as frame 182, the electrical lighting base 1403 may be the same as lighting base 184, and the at least one arm 1404 may be the same as the at least one arm 186). Thus, the removable, non-threaded incandescent light bulb 1405 may be removed in accordance with any of the various methods taught herein and replaced with a fluorescent light bulb socket having a remote ballast.

Figure 15:
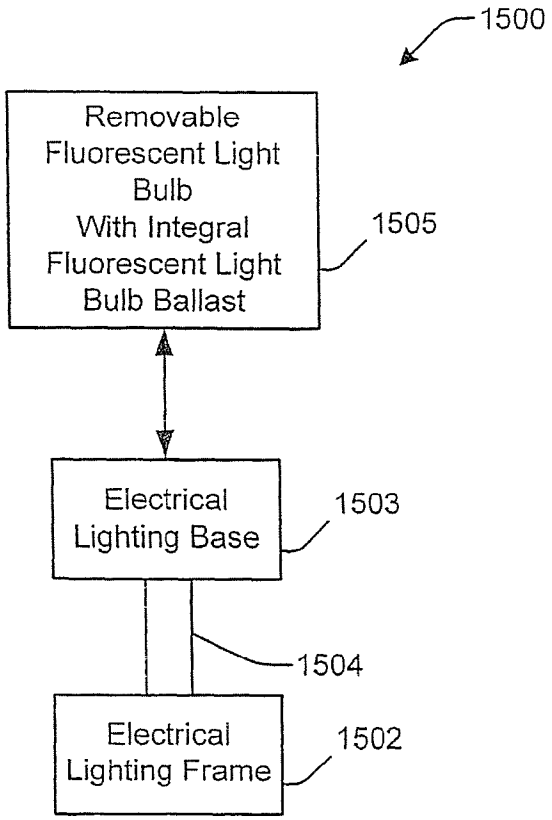
FIGS. 14 and 15 are schematic block diagrams of exemplary lighting products according to the present invention.

Similarly, the lighting product 1400 of FIG. 14 may be converted to the fluorescent lighting product 1500 of FIG. 15 having a fluorescent light bulb integral with a ballast that is accepted by the lighting base. As shown in FIG. 15, exemplary lighting product 1500 comprises a frame or body 1502 directly or indirectly carrying at least one electrical lighting base 1503. The base 1503 may be carried by one or more structures, e.g., carried by at least one arm 1504, of the lighting product 1500. The base 1503 may be the same as any of bases 3, 16, etc. discussed above or below, and may be configured to accept the bottom pins or other connectors of any of the various sockets, bulbs, and ballasts herein. The base 1503 removably receives, and is electrically coupled to, a non-threaded fluorescent light bulb with integral fluorescent light bulb ballast 1505. Such a non-threaded fluorescent light bulb with integral fluorescent light bulb ballast 1505 that is accepted by the lighting base may be obtained from Shanghai VIVA Eco. Electronics & Technology Co., Ltd. Electricity powering the non-threaded fluorescent light bulb 1505 is provided via the lighting base 1503 directly to the non-threaded fluorescent light bulb. Preferably, the electrical lighting bases 1403 and 1503 may be both mechanically coupled and electrically coupled to the non-threaded light bulbs 1405 or 1505, respectively, e.g., the bases 1403 and 1503 have openings for accepting and retaining electrical contacts (not shown in FIGS. 14 and 15) of the removable non-threaded light bulbs 1405 and 1505. The teachings above with respect to converting lighting product 1 of FIG. 1A to the lighting product 1' of FIG. 1B may also be applied to converting the lighting product 1400 to the lighting product 1500 of FIG. 15. Thus, the removable, non-threaded incandescent light bulb 1405 may be removed in accordance with any of the various methods taught herein and replaced with a fluorescent light bulb and ballast 1505 (in which case the frame 1402 may be the same as frame 1502, the electrical lighting base 1403 may be the same as lighting base 1503, and the at least one arm 1404 may be the same as the at least one arm 1504).

In one embodiment of the invention, the frames 1402, 1502, the electrical lighting bases 1403, 1503, and the at least one arm 1404, 1504 of FIGS. 14 and 15 are the same, such that the non-threaded incandescent light bulb 1405 may be removed from lighting product 1400 and replaced with the non-threaded fluorescent light bulb 1505, and the non-threaded fluorescent light bulb 1505 may be removed from lighting product 1500 and replaced with the non-threaded incandescent light bulb 1405.

By providing non-threaded light bulbs 1405, 1505 that can be coupled directly to an exemplary electrical lighting base 1403, 1503, such as, for example, the exemplary electrical lighting base 16 of FIG. 4, a lighting product may be provided with fewer parts, and with fewer parts to disassemble and replace when converting the lighting product from one type of lighting, such as incandescent lighting, to a different type of lighting, such as fluorescent lighting. It should be noted that while FIGS. 14 and 15 describe non-threaded incandescent and fluorescent light bulbs for direct assembly to an electrical lighting base, the present invention is also directed toward providing non-threaded light bulbs of virtually any lighting type for conversion of a lighting product of one lighting type to a lighting product of a different lighting type through direct assembly of a non-threaded light bulb of the different lighting type to an electrical lighting base. As such, the high-level block diagrams of FIGS. 14 and 15 may represent exemplary lighting products adapted to use virtually any lighting type, such as, for example, standard incandescent lighting, fluorescent lighting, halogen incandescent lighting, high-pressure sodium lighting, low-pressure sodium lighting, mercury vapor lighting, metal halide lighting, and light emitting diode (LED) lighting.

Figure 16V:
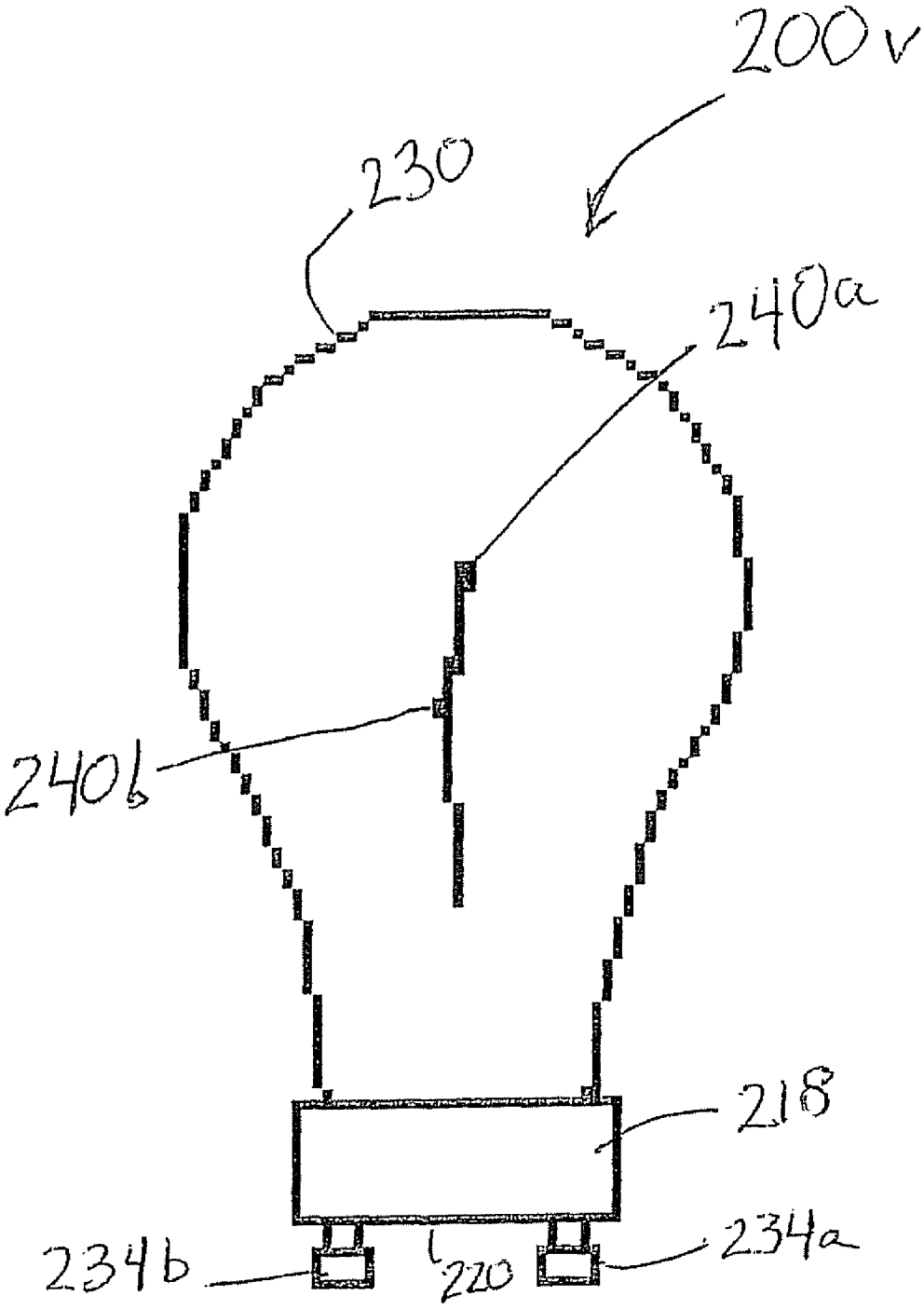

FIGS. 16A-16U illustrate exemplary non-threaded incandescent light bulbs in different sizes and styles, and FIG. 16V is an enlarged view of the exemplary A-19 type light bulb of FIG. 16M. By way of example each of the bulbs of FIGS. 16A-16V may have a base portion 218 adapted to engage with the exemplary electrical lighting base 16 of FIG. 4. In addition, the various methods described herein with respect to a removable incandescent socket may be modified to apply to the various non-threaded incandescent light bulbs shown herein. In addition, all the various low-energy usage triggering events described herein with respect to a removable incandescent socket also apply to the various non-threaded incandescent light bulbs shown herein, such as when (i) a removable non-threaded incandescent light bulb has been removed from the electrical lighting base or (ii) a fluorescent lighting ballast (with or without an integral fluorescent bulb) has been coupled to the electrical lighting base, or (iii) both the removable non-threaded incandescent light bulb has been removed from the electrical lighting base and a fluorescent lighting ballast (with or without an integral fluorescent bulb) has been coupled to the electrical lighting base. Additionally, the bulbs of FIGS. 16A-16V may have a base portion adapted to engage openings (e.g., either the first set of openings 522 or the second set of openings 524) of irreversible base 500 shown in FIGS. 26A-31B to illuminate the light source using electrical contacts associated with corresponding openings inside that lighting base. Referring now specifically to the exemplary non-threaded incandescent light bulb 200*v* of FIG. 16V, as an example, the base portion 218 has two extensions or pins 234*a*, 234*b* extending from an end surface 220 of the base portion 218. In the embodiment shown, the external portion of pins 234*a*, 234*b* are substantially the same configuration (i.e., wider and narrower portions) as pins 34*a*, 34*b* of incandescent bulb socket 18, shown in FIG. 6, and pins 66*a*, 66*b* of removable ballast 60, shown in FIG. 8. The pins 234*a*, 234*b* are preferably electrical conductors that provide electricity from the base 16 directly to the light bulb 200*v*. The pins may be spaced to be accepted by the first set of openings 522 or the second set of openings 524 of irreversible base 500 shown in FIGS. 26A-31B (either of which may be the same as in base 16), or some other spacing. Wiring or other electrical conductors electrically connect one of the pins 234*a* to one end 240*a* of a filament disposed in a bulb portion 230 and separate wiring or other conductors electrically connect the other of the pins 234*b* to the other end of the filament 240*b*. Pins 234*a*, 234*b* preferably both mechanically couple and electrically couple the base 16 to the light bulb 200*v*. In the exemplary configuration shown, the non-threaded light bulb 200*v* is removably coupled to the base 16 by inserting the extensions 234*a*, 234*b* into the openings 36*a*, 36*b* and turning the non-threaded incandescent bulb 200*v* in a clockwise manner relative to the base 16. The electrical contacts of base 16 engage pins 234*a*, 234*b* to provide electricity from the base 16 to the circuitry within the non-threaded incandescent light bulb 200*v*. The base portion 218 of these exemplary bulbs are shown as being relatively short (e.g., on the order of less than a half-inch in height along an axis). In the alternative, the base portion 218 of these exemplary bulbs may be made much taller to provide the appearance that the bulbs have an associated socket (e.g., a base portion that is about an inch-and-a-half or longer in height, or perhaps about two an inch-and-a-half or longer in height), as shown in FIGS. 18A-D. Additionally, the exemplary bulbs—such as the candelabra bulb—may be configured to have a significantly taller, narrower base portion (not shown) to give the appearance of a faux candle as might hold the socket on a traditional chandelier (e.g., a taller, narrower base portion that is about three inches or longer in height, or perhaps about five inches or longer in height, connected to a wider portion carrying the two pins). Any wiring connecting the pins to the filament may be carried inside these longer base portions, which base portions may be hollow to carry such wiring. The base portion of these bulbs (whether taller or shorter) may be generally cylindrical in configuration, to have the appearance of an incandescent light bulb socket or faux candle. Of course, sizes and configurations of light bulbs other than the examples shown may be modified in accordance with the teachings herein to connect to an electrical lighting base.

Figure 17A:
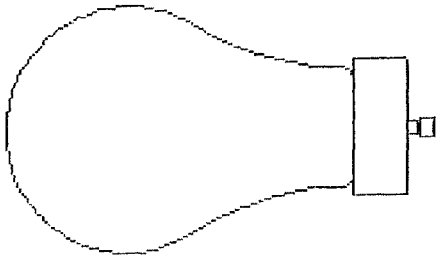
Figure 17B:
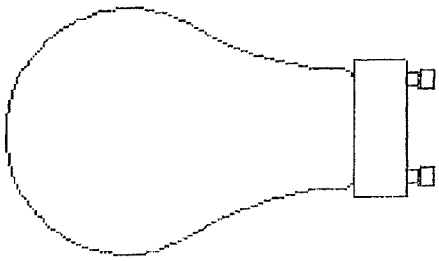
Figure 17C:
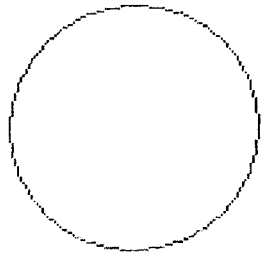
Figure 17D:
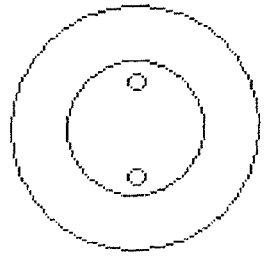
Figure 18A:
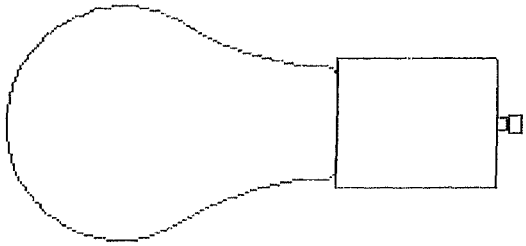
Figure 18B:
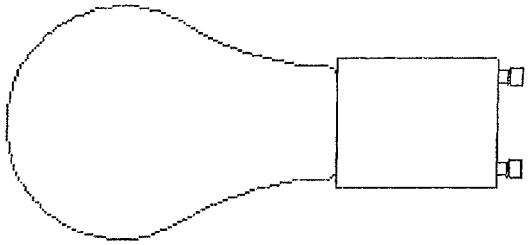
Figure 18C:
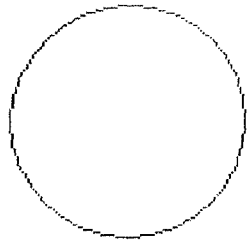
Figure 18D:
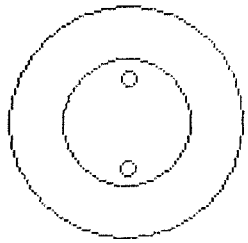
Figure 19A:
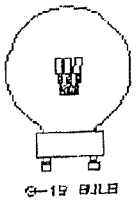
FIGS. 19A-19X are front views of exemplary non-threaded light emitting diode (LED) light bulbs.
Figure 19B:
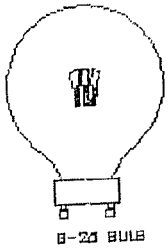
Figure 19C:
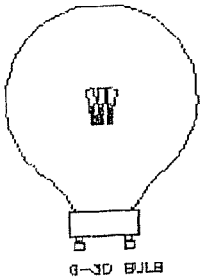
Figure 19D:
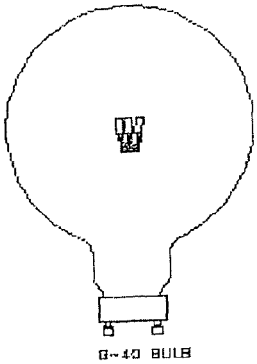
Figure 19E:
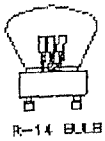
Figure 19F:
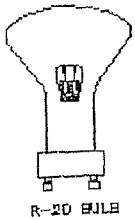
Figure 19G:
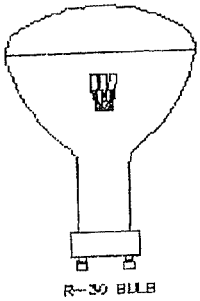
Figure 19H:
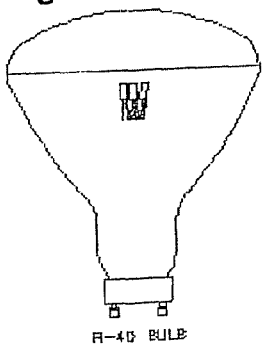
Figure 19I:
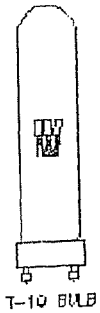
Figure 19J:
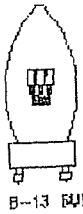
Figure 19K:
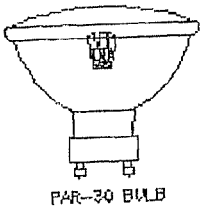
Figure 19L:
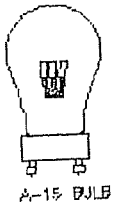
Figure 19M:
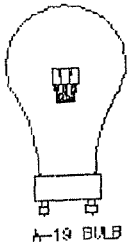
Figure 19N:
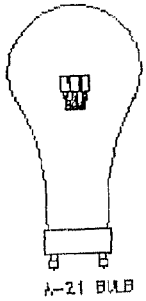
Figure 19O:
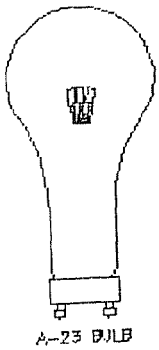
Figure 19R:
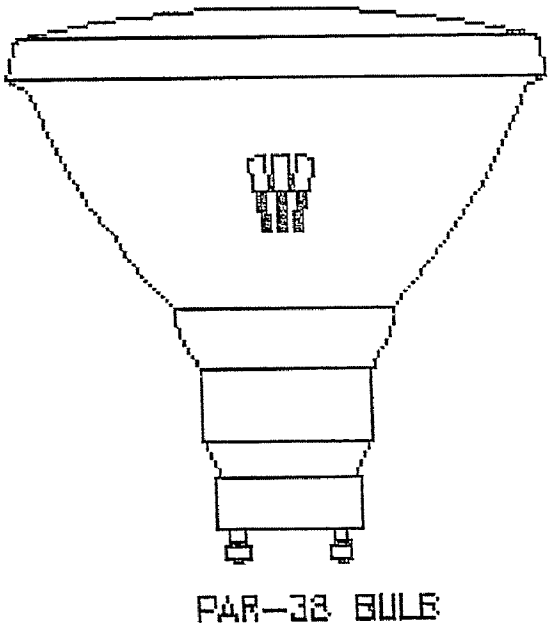
Figure 19Q:
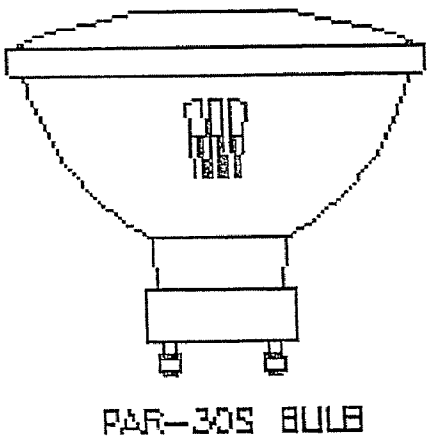
Figure 19P:
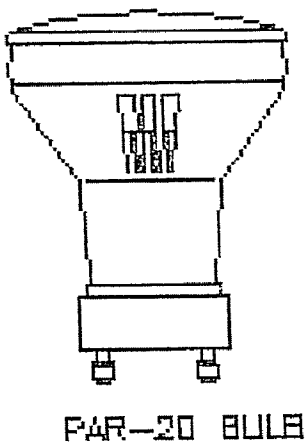
Figure 19S:
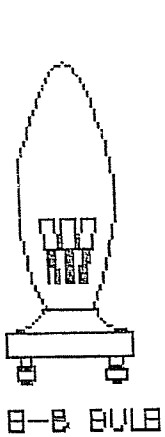
Figure 19T:
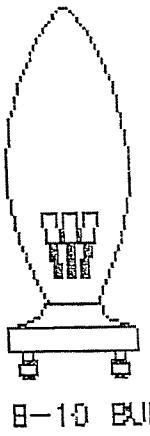
Figure 19U:
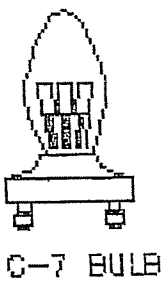
Figure 19V:
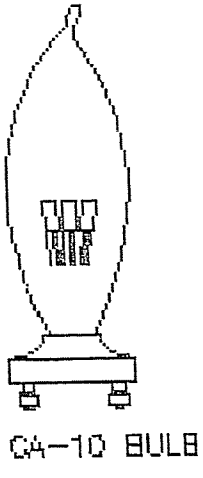
Figure 19W:
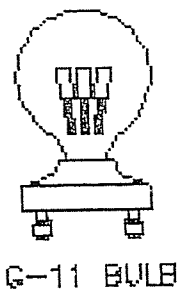
Figure 19X:
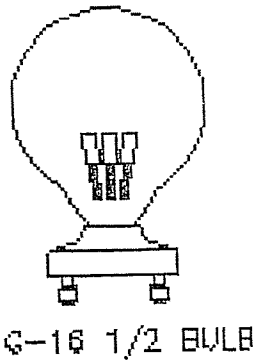
Figure 20A:
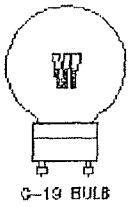
FIGS. 20A-20X are front views of exemplary non-threaded LED light bulbs with integral drivers.
Figure 20B:
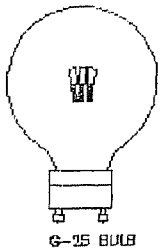
Figure 20C:
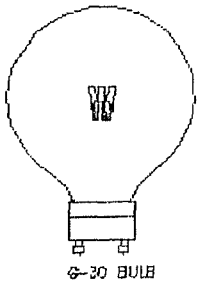
Figure 20D:
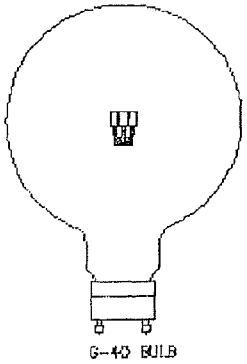
Figure 20E:
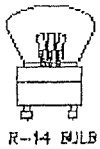
Figure 20F:
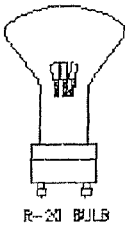
Figure 20G:
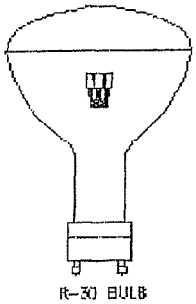
Figure 20H:
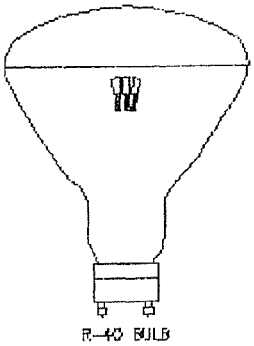
Figure 20I:
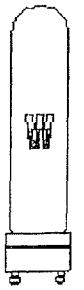
Figure 20J:
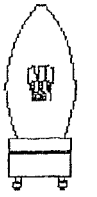
Figure 20K:
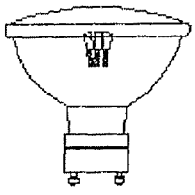
Figure 20L:
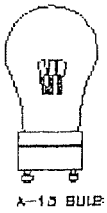
Figure 20M:
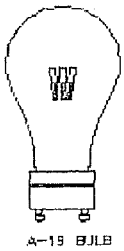
Figure 20N:
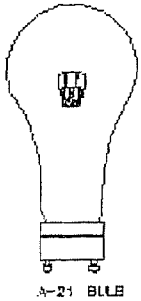
Figure 20O:
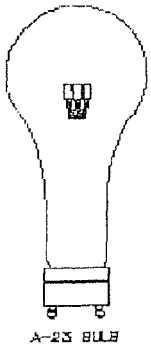
Figure 20R:
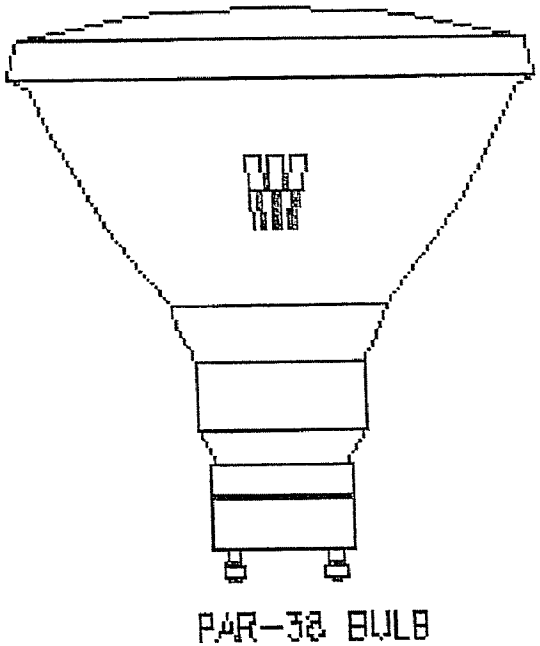
Figure 20Q:
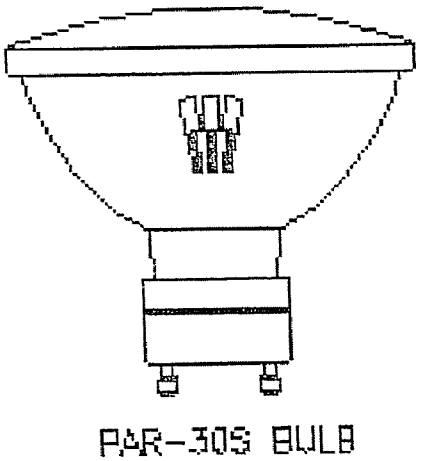
Figure 20P:
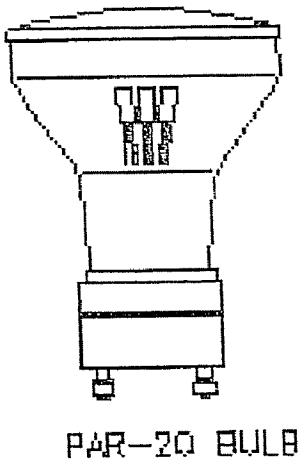
Figure 21C:
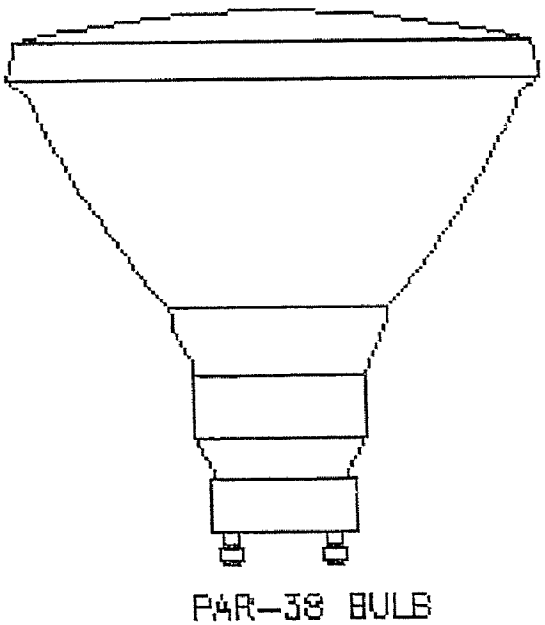
FIGS. 21A-21C are front views of exemplary non-threaded halogen light bulbs.
Figure 21B:
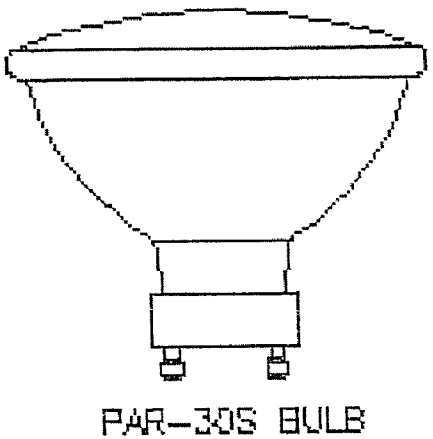
Figure 21A:
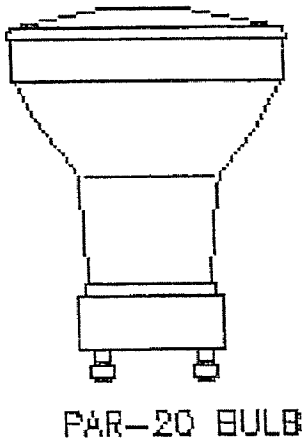

As stated above, the non-threaded bulb configuration is not limited to use with incandescent bulbs. As such, FIGS. 19A-X illustrate exemplary embodiments of non-threaded bulbs of a two-pin, twist-lock configuration having light emitting diode (LED) clusters as a light source. The bulbs may be provided in a medium base type, as shown in FIGS. 19A-R or a candelabra base type, as shown in FIGS. 19S-X, or any suitable bulb type or configuration. Further, as represented schematically in FIGS. 20A-X, the LED bulbs may be provided with integral LED drivers (represented in the additional portion of the base making the base thicker than as shown in FIGS. 19A-19X) for converting electricity from an associated power source to the appropriate voltage and current for powering the LED clusters. FIGS. 21A-C illustrate exemplary non-threaded halogen incandescent bulbs of a two-pin, twist-lock configuration. As indicated above, still other types of lighting products may utilize this type of non-threaded configuration. Additionally, any of the bulbs in any of or FIGS. 16A-16V, or FIGS. 19A-X, or FIGS. 20A-X, or FIGS. 21A-C may have a taller lower portion, as exemplified by FIGS. 18A-18B, to give the appearance that the bulbs have an associated socket, even though there is no socket. From a design standpoint, any of the bulbs in any of FIGS. 16A-16V, or FIGS. 19A-X, or FIGS. 20A-X, or FIGS. 21A-C may have a lower portion that looks the same as the bottom, rectangular portion and pins of either (a) as shown in FIGS. 17A-17B, with a top view that is a circle having a diameter that is the same as the widest portion in horizontal cross section, and with a bottom view that is the same as the inner circle and pins of FIG. 17D and an outer circle having a diameter that is the same as the widest portion in horizontal cross section; or (b) as shown in FIGS. 18A-18B, with a top view that is a circle having a diameter that is the same as the widest portion in horizontal cross section, and with a bottom view that is the same as the inner circle and pins of FIG. 18D and an outer circle having a diameter that is the same as the widest portion in horizontal cross section. From a shading standpoint, the bulbs shown in any of FIG. 16A-16V, or 17A-17D, or FIGS. 18A-18D, or FIGS. 19A-19X, or FIGS. 20A-20X, or FIGS. 21A-21C may be circular in horizontal cross section down to the pins, which may also be circular in horizontal cross section. Of course from a design standpoint, with all these light bulbs, the filaments and LED clusters may or may not form part of the claimed design and preferably do not form part of the design.

Figure 22:
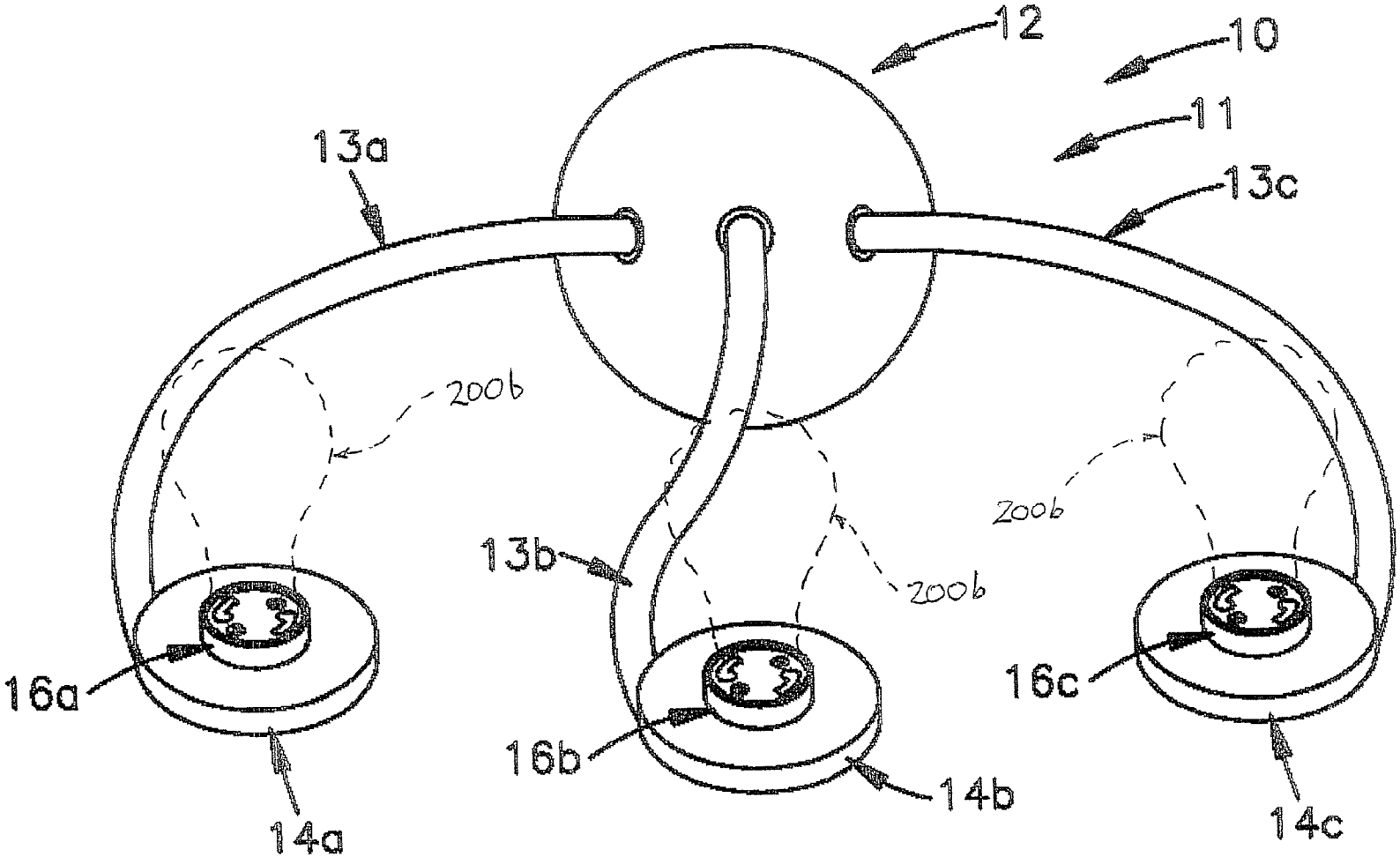
FIG. 22 is a front view of an exemplary lighting fixture.

The exemplary fixture 10 of FIG. 2 may be used in connection with exemplary A-19 bulb 200*v* (FIG. 16V). FIG. 22 shows an exemplary fixture 310 resulting from connecting such bulbs 200*b* directly to the three bases 16*a*-16*c* of fixture 10 of FIG. 2. Such bulbs—or any of the other bulbs taught herein—may be shipped with the fixture (attached or unattached) or separately therefrom.

Figure 23:
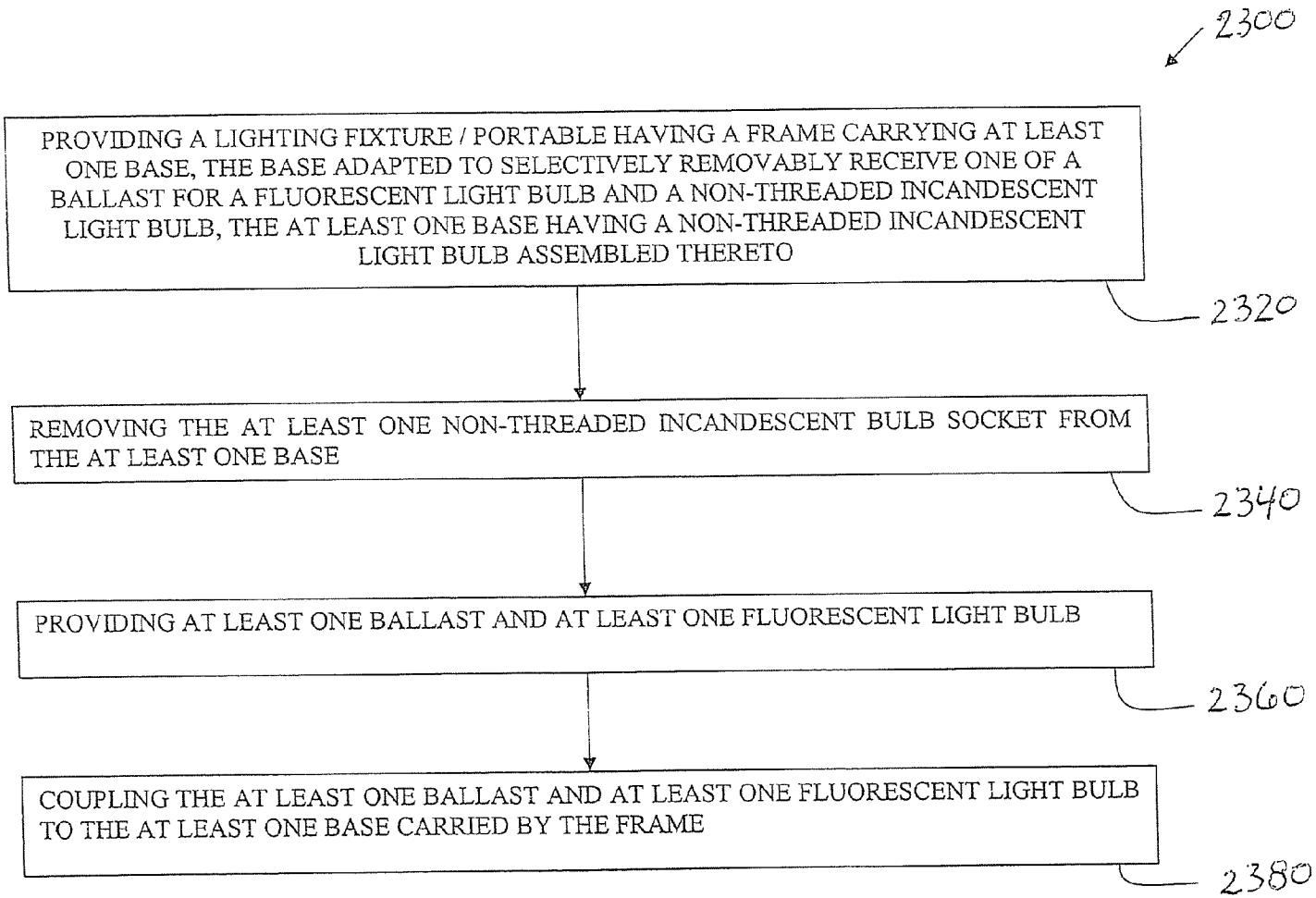
FIG. 23 is an exemplary method of converting an incandescent lighting fixture or portable to a lower power lighting fixture or portable.

Referring now to FIG. 23, the exemplary method 2300 comprises a first step 2320 of providing a lighting fixture or portable having a frame carrying at least one base, the base adapted to selectively removably receive one of a ballast for a fluorescent light bulb, and a non-threaded incandescent light bulb, the at least one base having an associated non-threaded incandescent light bulb assembled thereto. FIG. 22 shown an exemplary three-light fixture resulting from this step (with the three bulbs in place). Next at 2340, the method continues with the at least one non-threaded incandescent light bulb being removed from the at least one base, resulting in a fixture exemplified by FIG. 2. Next, at step 2360, at least one ballast and at least one fluorescent light bulb is provided, preferably one for each base 16. It should be noted that the fluorescent light bulb and ballast may be provided either as separate mating components, as exemplified in FIGS. 7 and 8, or as a fluorescent light bulb with integral fluorescent light bulb ballast, as exemplified schematically in FIG. 15. Finally, at step 2380, the at least one ballast and at least one fluorescent light bulb are coupled to the at least one base carried by the frame, resulting in a fixture depicted schematically in FIGS. 1B and 12B-13 and as exemplified in FIG. 9.

Some embodiments of the lighting products described in FIGS. 14, 15, and 16A-F may allow for reversible interchangeability between non-threaded light bulbs of different types of lighting, for example, unrestricted replacement of a non-threaded incandescent light bulb with a non-threaded fluorescent light bulb (or with a standard fluorescent light bulb and removable ballast) and subsequent replacement with an incandescent light bulb (either the original incandescent light bulb or a new incandescent light bulb). However, in the alternative, according to the present invention, it may be helpful, e.g., for energy-efficiency certification, to prevent a removable non-threaded incandescent light bulb from being coupled to the electrical lighting base when either (i) the removable non-threaded incandescent light bulb has been removed from the electrical lighting base, or (ii) a fluorescent lighting ballast or non-threaded fluorescent light bulb has been coupled to the electrical lighting base, or (iii) both the removable non-threaded incandescent light bulb has been removed from the electrical lighting base and a fluorescent lighting ballast or non-threaded fluorescent light bulb has been coupled to the electrical lighting base, or responsive to some other low-energy usage triggering event. As such, all of the various means and methods described above for preventing a removable incandescent bulb socket from being re-coupled to the electrical lighting base responsive to a low-energy usage triggering event may also be adapted as various means and methods for preventing a removable, non-threaded incandescent light bulb from being re-coupled to the electrical lighting base responsive to a low-energy usage triggering event. The means described as being provided with the removable incandescent bulb socket described above may be adapted to instead be provided with the removable non-threaded incandescent light bulb described herein.

It is recognized that circumstances may arise where incandescent lighting may be preferred or required over fluorescent lighting regardless of the costs and energy efficiency considerations associated with either lighting option. Because fluorescent lamps do not give out a steady light—that is, they flicker or fluctuate greatly in intensity—a fluorescent light source may cause problems for video recording. Additionally, the flicker resulting from fluorescent lighting may act as a trigger for Migraine headaches in individuals that are susceptible to such a condition. Under these and other circumstances, it may be desirable to forego the energy efficiency advantages of fluorescent lighting and temporarily or permanently re-convert a lighting product that had been converted to a fluorescent lighting product back to use as an incandescent lighting product. Alternatively, under some circumstances it may be desirable to temporarily use fluorescent lighting in a convertible incandescent lighting product, as described above, without mechanically converting the incandescent lighting product to a fluorescent lighting product. As such, in additional exemplary embodiments of the invention, non-threaded incandescent or fluorescent light bulbs may be provided which directly connect to the convertible or converted electrical lighting base of the above embodiments regardless of the occurrence of low-energy usage triggering event, such as the conditions described above.

Figure 24:
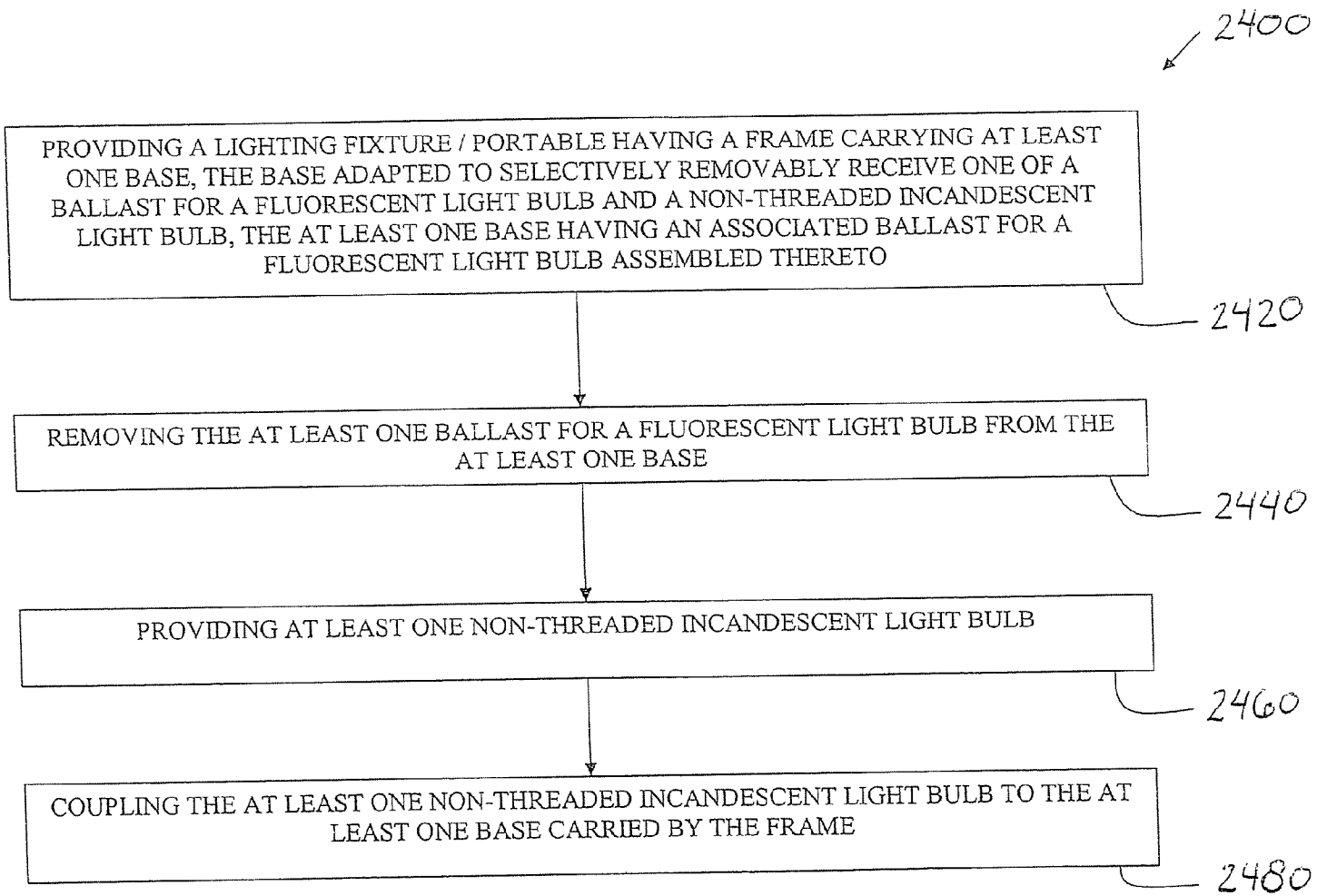
FIG. 24 is an exemplary method of converting a fluorescent lighting fixture or portable to an incandescent lighting fixture or portable.

Referring now to FIG. 24, an exemplary method 2400 for converting the converted fluorescent lighting product back to an incandescent lighting product comprises a first step 2420 of providing a lighting fixture or portable having a frame carrying at least one base, the base adapted to selectively removably receive one of a ballast for a fluorescent light bulb, and a non-threaded incandescent light bulb, the at least one base having an associated ballast for a fluorescent light bulb assembled thereto. It should be noted that the fluorescent light bulb ballast may be provided either as a separate component, as exemplified in FIGS. 7 and 8, or as a fluorescent light bulb with integral fluorescent light bulb ballast, as exemplified schematically in FIG. 15. Next at 2440, the method continues with the at least one ballast for the fluorescent light bulb being removed from the at least one base, resulting in a fixture exemplified by FIG. 2. Next, at step 2460, at least one non-threaded incandescent light bulb is provided, preferably one for each base 16. Finally, at step 2480, the at least one non-threaded incandescent light bulb is coupled to the at least one base carried by the frame, as exemplified by FIG. 22 (with the three bulbs in place).

In some exemplary embodiments of the invention (not shown), a non-threaded light bulb according to the present invention may be adapted to allow assembly to a convertible electrical lighting base, as described above, that has been converted to prevent the assembly of an incandescent light bulb socket, as described above. As such, a non-threaded light bulb may be provided with an adaptive interface for engaging a spring-loaded member disposed on the electrical lighting base that has been activated in response to a low-energy usage triggering event, such as, for example, those spring-loaded members and energy usage triggering events described in the above exemplary embodiments. The adaptive interface may include one or more holes or indentations adapted to align with one or more spring-loaded pins, cams, guides or other structures on the electrical lighting base that have been activated to interfere with reassembly of the associated removable incandescent bulb socket. The adaptive interface may additionally or alternatively include a pin, key, or other such member adapted to deactivate or retract any one or more of the above referenced spring-loaded mechanisms. In still other exemplary embodiments of the invention, a non-threaded light bulb according to the present invention may be provided with a connecting structure such as any one or more rings, bridges, ties, tape, films or other structure adapted to complete a connection with the electrical lighting base after a corresponding one or more rings, bridges, ties, tape, films or other structure adapted to complete a connection with the electrical lighting base, as described, for example, in the exemplary embodiments above, has been removed, severed, or disengaged from either or both of the electrical lighting base and the associated removable incandescent bulb socket. The use of such an adaptive interface or connecting structure may make it possible to utilize a non-threaded light bulb, for example, a non-threaded incandescent light bulb, after the lighting product has been converted to prevent reassembly of the associated removable incandescent bulb socket.

Figure 25A:
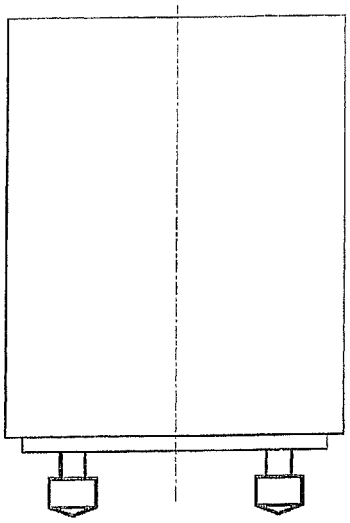
FIGS. 25A-25J are schematic front and side views of socket bases having a variety of exemplary electrical contact pin configurations.
Figure 25C:
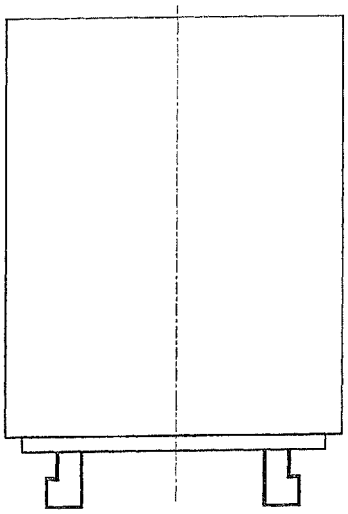
Figure 25E:
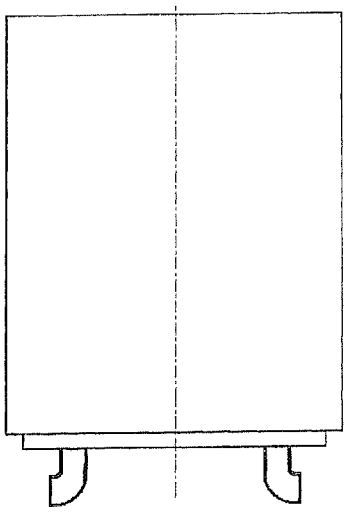
Figure 25B:
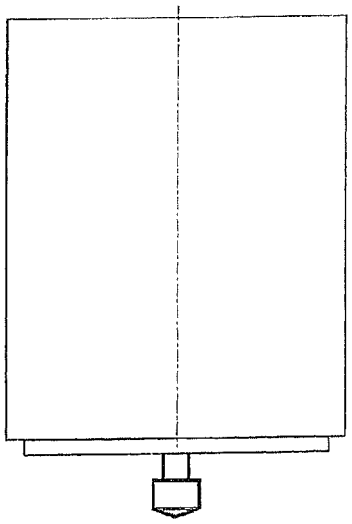
Figure 25D:
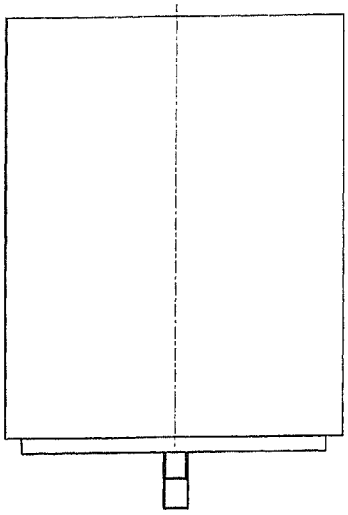
Figure 25F:
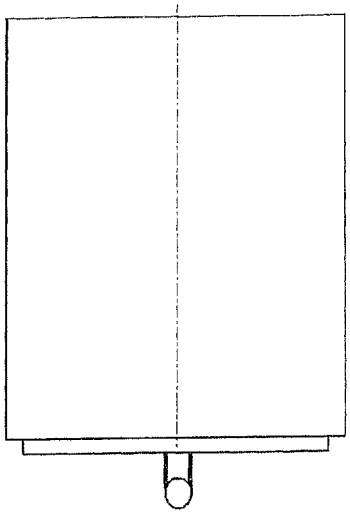
Figure 25G:
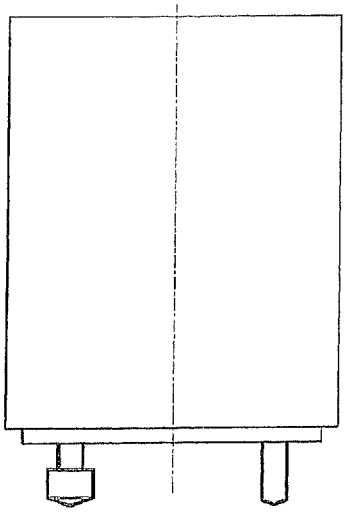
Figure 25I:
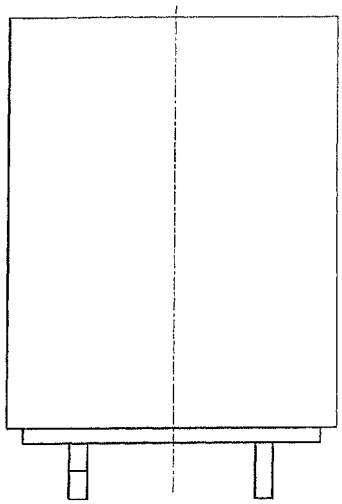
Figure 25H:
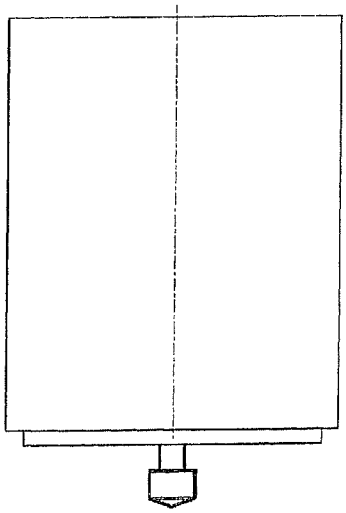
Figure 25J:
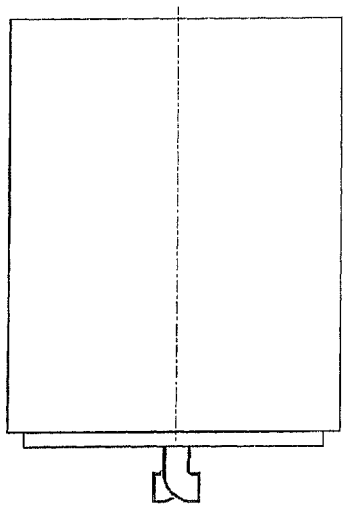

As discussed above, the base 16 may be adapted to removably receive a first end 30 of an incandescent bulb socket 18 (or non-threaded incandescent bulb having a special connector, e.g., the bulbs of FIGS. 16A-U) to preferably both mechanically couple and electrically couple the socket 18 to the base 16. In the exemplary configuration shown in FIG. 4, the first end 30 of the incandescent bulb socket 18 has two extensions (pins or pillars 34*a* and 34*b*) extending from the first end 30 of the incandescent bulb socket 18. In the particular embodiment shown, the longitudinal axes of the pins 34*a* and 34*b* are preferably substantially parallel to the longitudinal axis of the incandescent bulb socket 18, as also shown in FIGS. 25A-B. That said, as discussed above, the first end 30 of socket 18 may be adapted to be removably received by the base 16 in any desirable manner. Accordingly, other pin configurations may be acceptable to fasten the socket 18 and the base 16 together. Examples of incandescent bulb sockets similar to socket 18 or socket 118, but having different pin configurations are shown in FIGS. 25C-25J. For example, a variety of pins or other projections may be used to provide a twisting and locking type engagement, such as, for example, pins that are skewed with respect to the longitudinal axis of the incandescent bulb socket 18, shown in FIGS. 25C-D and 25E-F (each pin still having a wider portion and a narrower portion), pins having a flat, blade-like configuration, shown in FIGS. 25I-J, or pins having a notch or hook configured to engage corresponding notches, hooks, or other latches in the socket base portion (not shown). As such, in some embodiments, it may not be necessary to provide narrower portions of the corresponding openings in the lighting base for retaining the pins, such as with the blade-like pins of FIGS. 25I-J. Further, in some embodiments, a mechanical connection between the bulb socket or non-threaded bulb and the electric lighting base may be maintained by providing structure for mechanical attachment on only one of the two pins, as shown in FIGS. 25G-H. In such an embodiment, while both pins provide electrical contacts for providing electricity to the bulb, only one of the two pins provides an engaged or rigid mechanical connection.

As discussed above, one exemplary means for preventing a removable incandescent bulb socket (or non-threaded incandescent bulb having a special connector, e.g., the bulbs of FIGS. 16A-U) from being re-coupled to the electrical lighting base is one more cams associated with the base that initially are out of the way, but that extend or retract to physically interfere with other structures when any of the three listed conditions are met to effectively prevent a removable incandescent bulb socket (or non-threaded incandescent bulb having a special connector) from being mechanically and/or electrically re-coupled to the electrical lighting base. In an exemplary embodiment of the invention, a lighting base with a moving cam may be used to permit use of the lighting socket base with an incandescent bulb socket or non-threaded incandescent bulb when the cam is in a first position, while preventing use of the lighting base with an incandescent bulb socket or non-threaded bulb after the cam has been moved to a second position. In one embodiment, the cam may be moved from the first position to the second position in response to a triggering event, such as any of the low-energy usage triggering events described above. In another embodiment, the lighting base may be configured such that once the cam has been moved from the first position to the second position, the cam is prevented from being returned to the first position.

An electrical lighting base that prevents a removable incandescent bulb socket (or non-threaded incandescent bulb having a special connector, e.g., the bulbs of FIGS. 16A-16V, or FIGS. 17A-17D, or FIGS. 18A-18D, or FIGS. 19A-X, or FIGS. 20A-X, or FIGS. 21A-C) from being re-coupled to the electrical lighting base in response to a triggering event, such as any of the low-energy usage triggering events described above, will be referred to herein as an "irreversible" base or an "irreversible" electrical lighting base. The base 16 shown above has a single set of at least one opening to electrically couple and mechanically couple to bulbs, ballasts, and/or sockets. In some exemplary embodiments, an irreversible base is provided having two sets of at least one opening—one set for coupling to and powering fluorescent lighting (or other low-energy lighting) and one set for coupling to and powering incandescent (or other higher-power lighting). Thus exemplary irreversible electrical lighting base embodiments may have a first set of opening(s) for electrical connection and/or physical connection to a removable incandescent bulb socket (or non-threaded incandescent bulb having a special connector, e.g., the bulbs of FIGS. 16A-16V, or FIGS. 17A-17D, or FIGS. 18A-18D, or FIGS. 19A-X, or FIGS. 20A-X, or FIGS. 21A-C) and a second set of opening(s) for electrical connection and/or physical connection to a removable fluorescent ballast or fluorescent bulb with integral ballast. In these exemplary irreversible base embodiments, in response to a triggering event, such as any of the low-energy usage triggering events described above, the first set of opening(s) for electrical connection and/or physical connection to a removable incandescent bulb socket or non-threaded incandescent bulb is at least partially closed (or associated electrical contacts are otherwise moved or deactivated) to either prevent a removable incandescent bulb socket or non-threaded incandescent bulb from being coupled to the irreversible base, or (if permitted to couple) prevent the removable incandescent bulb socket or non-threaded incandescent bulb from being powered by the base. For example, responsive to a fluorescent ballast (with or without an integral bulb) being coupled to the exemplary irreversible base, the first set of opening(s) for electrical connection and/or physical connection to a removable incandescent bulb socket or non-threaded incandescent bulb is at least partially closed (or associated electrical contacts are otherwise moved or deactivated) to either prevent a removable incandescent bulb socket or non-threaded incandescent bulb from being coupled to the irreversible base, or (if permitted to couple) prevent the removable incandescent bulb socket or non-threaded incandescent bulb from being powered by the base. This configuration permits removable sockets and non-threaded incandescent bulbs to be changed and interchanged, until a fluorescent ballast (with or without an integral fluorescent bulb) is coupled to the exemplary irreversible base. The opening(s) may be partially or completely closed with a cam operable by the pins of the fluorescent ballast (with or without an integral fluorescent bulb).

Figure 28:
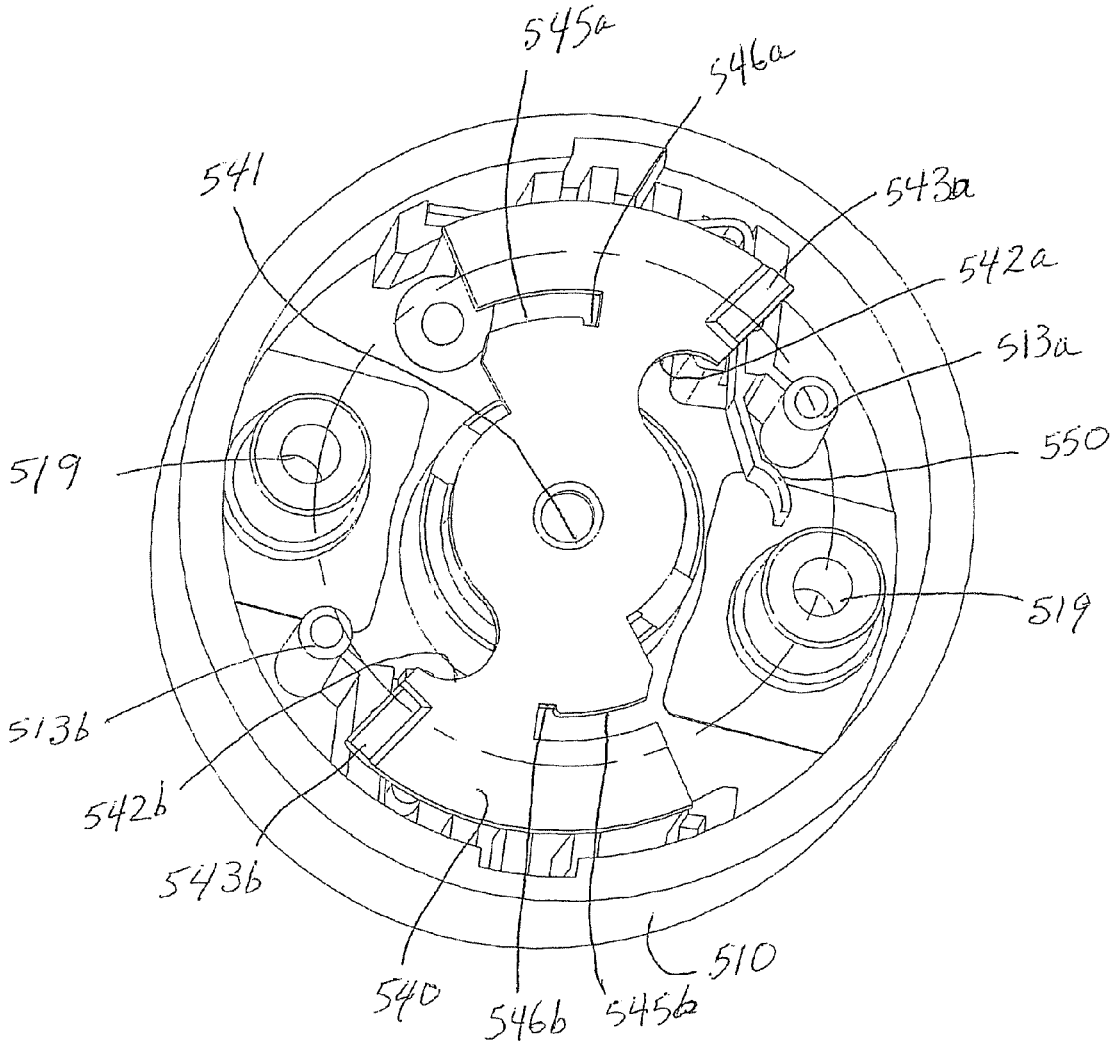
FIG. 28 is an upper isometric view of a cam, electrical contact, and housing of the electrical lighting base of FIG. 26A.
Figure 29:
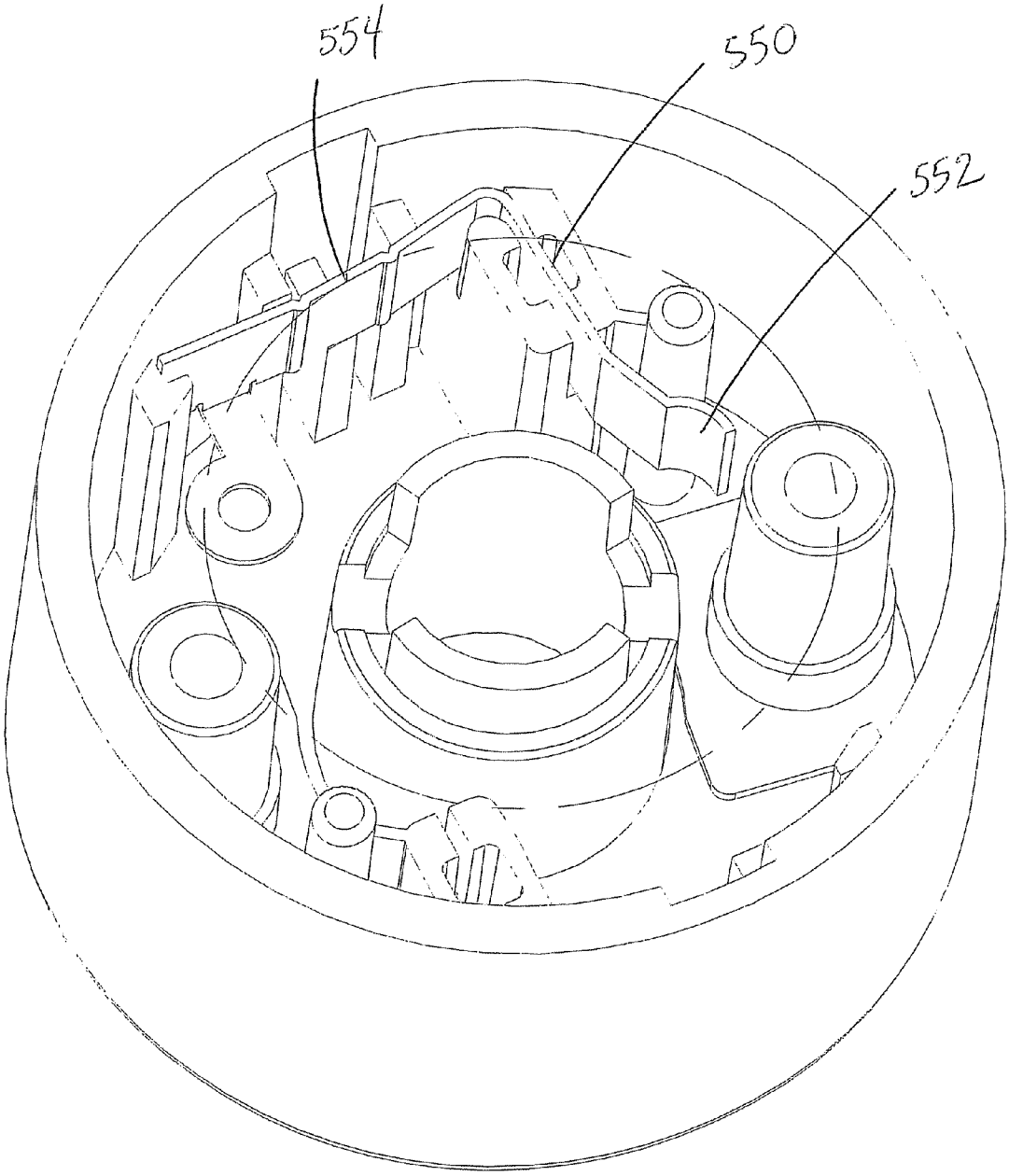
FIG. 29 is an upper isometric view of an electrical contact and housing of the electrical lighting base of FIG. 26A.
Figure 30:
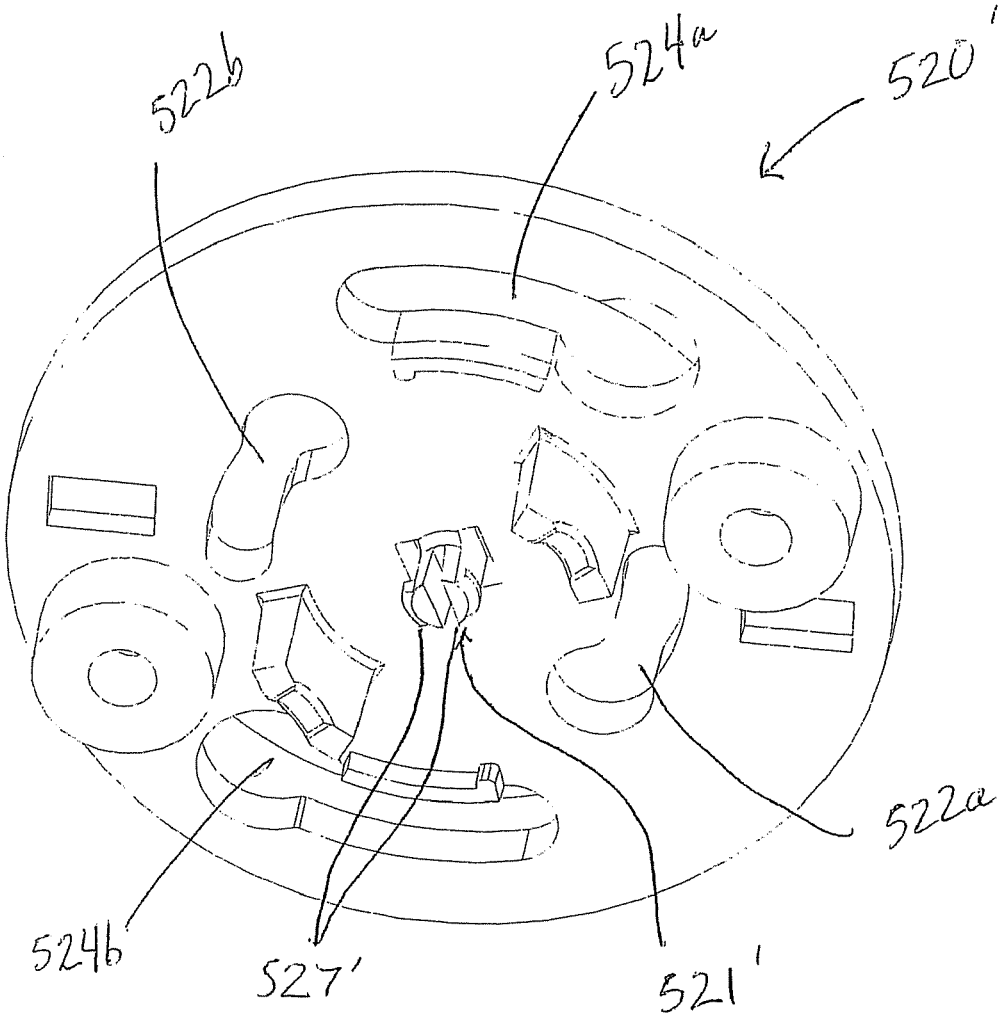
FIG. 30 is a lower isometric view of a cap portion of an electrical lighting base.

In one such exemplary embodiment, as shown in FIGS. 26A-31B, exemplary irreversible lighting base 500 is provided with rotating cam 540 disposed within housing 510. The cam 540 may be disposed beneath an end portion of end cap 520 adapted to receive electrical contacts, such as external pins, from an associated incandescent light bulb socket, such as, for example, the exemplary incandescent light bulb socket of FIGS. 5 and 6, or from an associated non-threaded incandescent light bulb, such as, for example, the exemplary non-threaded incandescent light bulbs of FIGS. 16A-U and the others. The cam 540 of the illustrated embodiment is provided with a central opening 541 that aligns with a hub 521 on the inner surface of the end cap 520. In one embodiment, as shown in FIG. 30, the hub 521' of the cap portion 520' may include one or more flexible fingers 527' for loosely retaining the cam 540 (see FIG. 27) on the hub 521', which may facilitate assembly of the base 500. Similar to the lighting bases depicted in FIGS. 2 and 4, the end cap 520 may be provided with two openings 522*a* and 522*b* adapted to removably receive pins extending from the incandescent bulb socket or non-threaded bulb. The openings 522*a*, 522*b* may be provided with wider portions and narrower portions, for receiving and retaining the pins, respectively, similar to the openings 36*a*, 36*b* of the lighting bases of FIGS. 2 and 4.

Figure 26A:
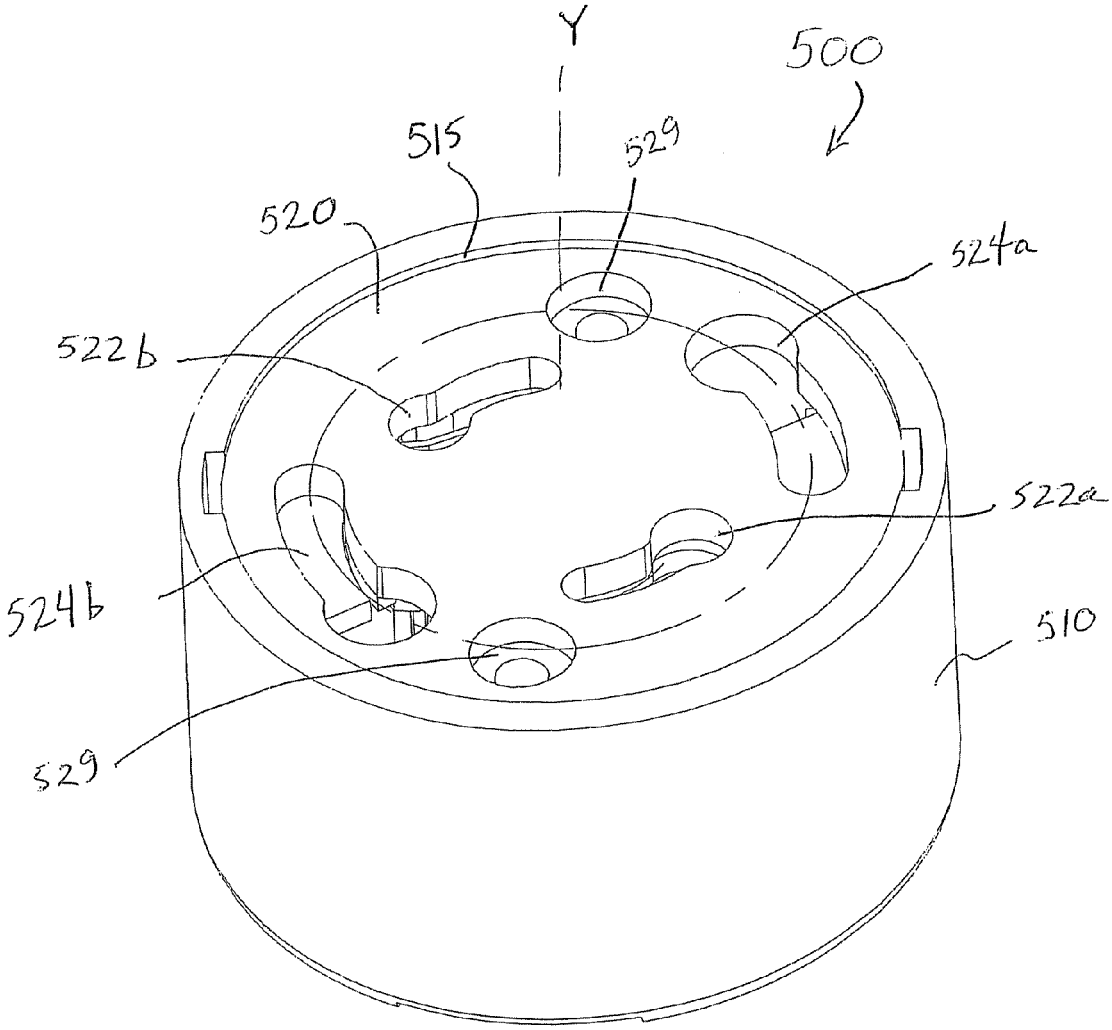
FIG. 26A is an upper isometric view of an exemplary electrical lighting base.
Figure 26B:
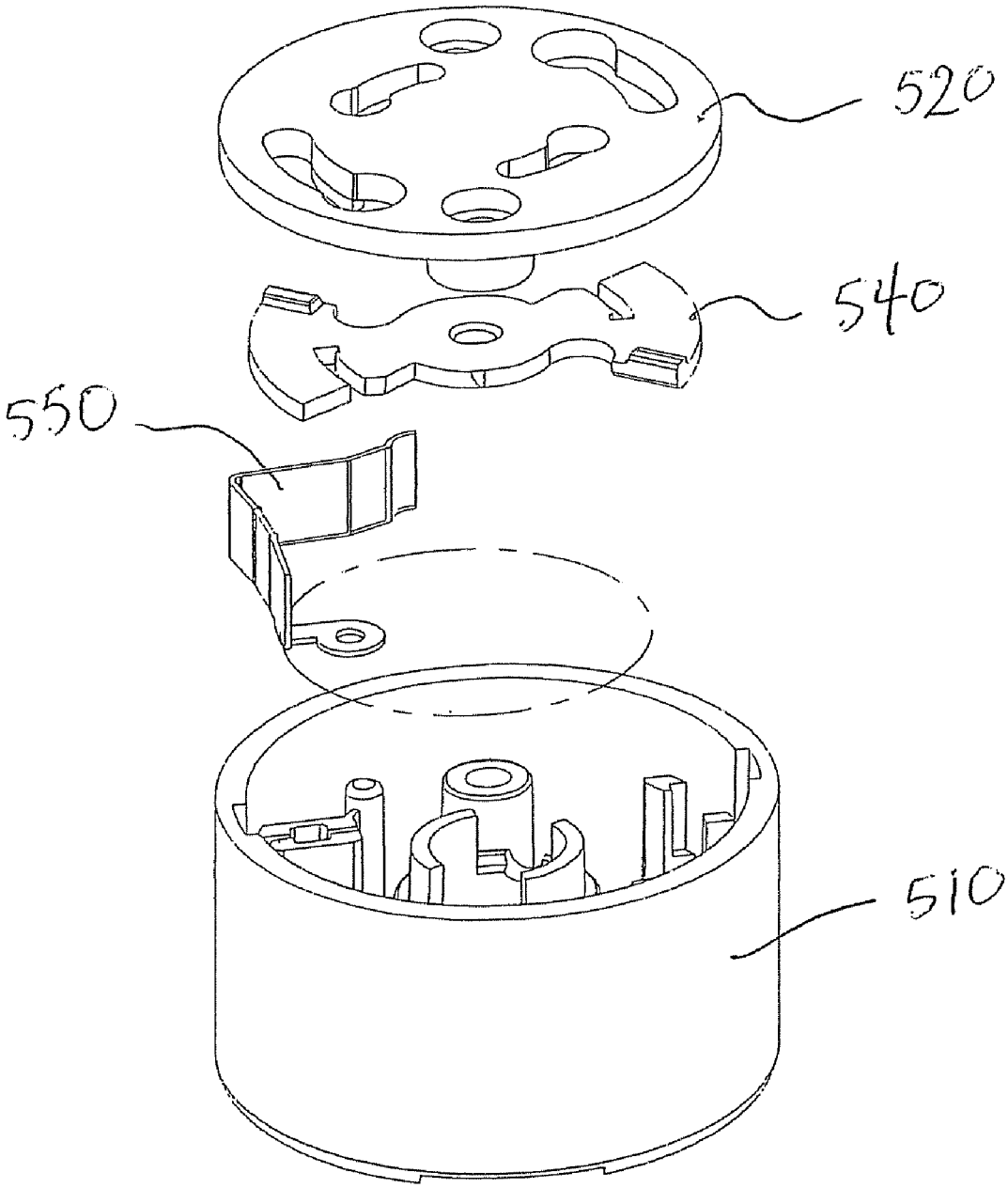
FIG. 26B is a partial exploded isometric view of the electrical lighting base of FIG. 26A.
Figure 26C:
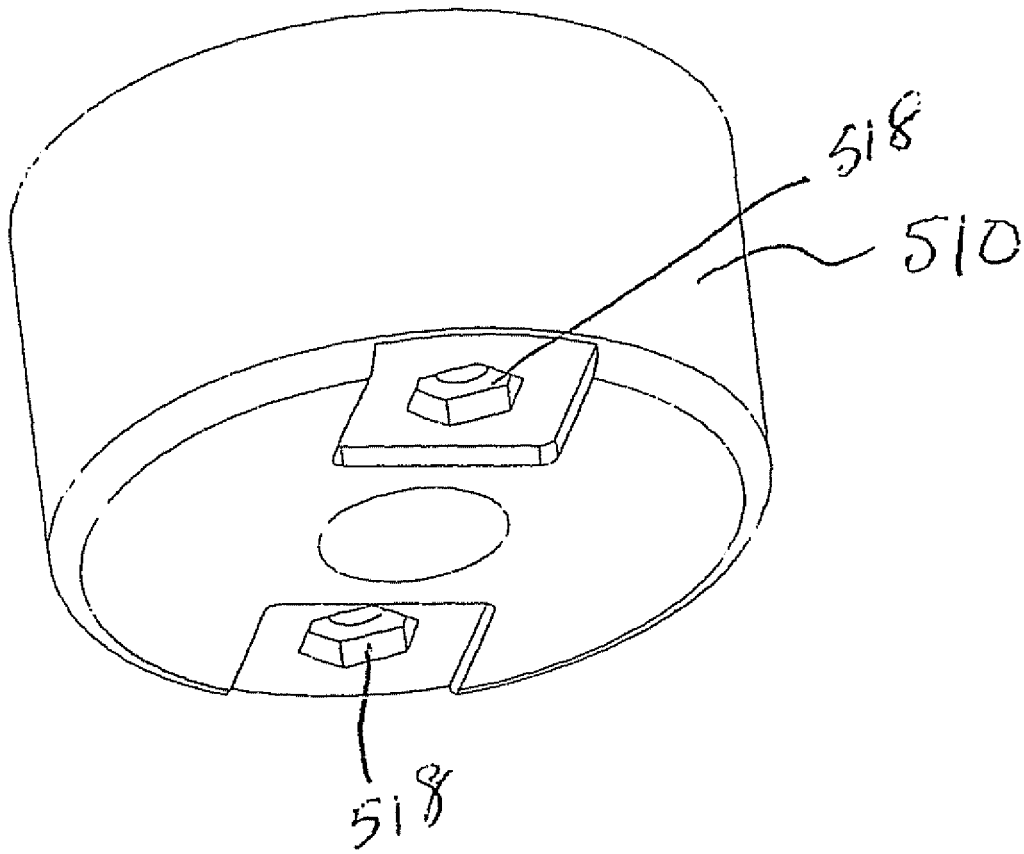
FIG. 26C is a lower isometric view of the electrical lighting base of FIG. 26A.
Figure 26D:
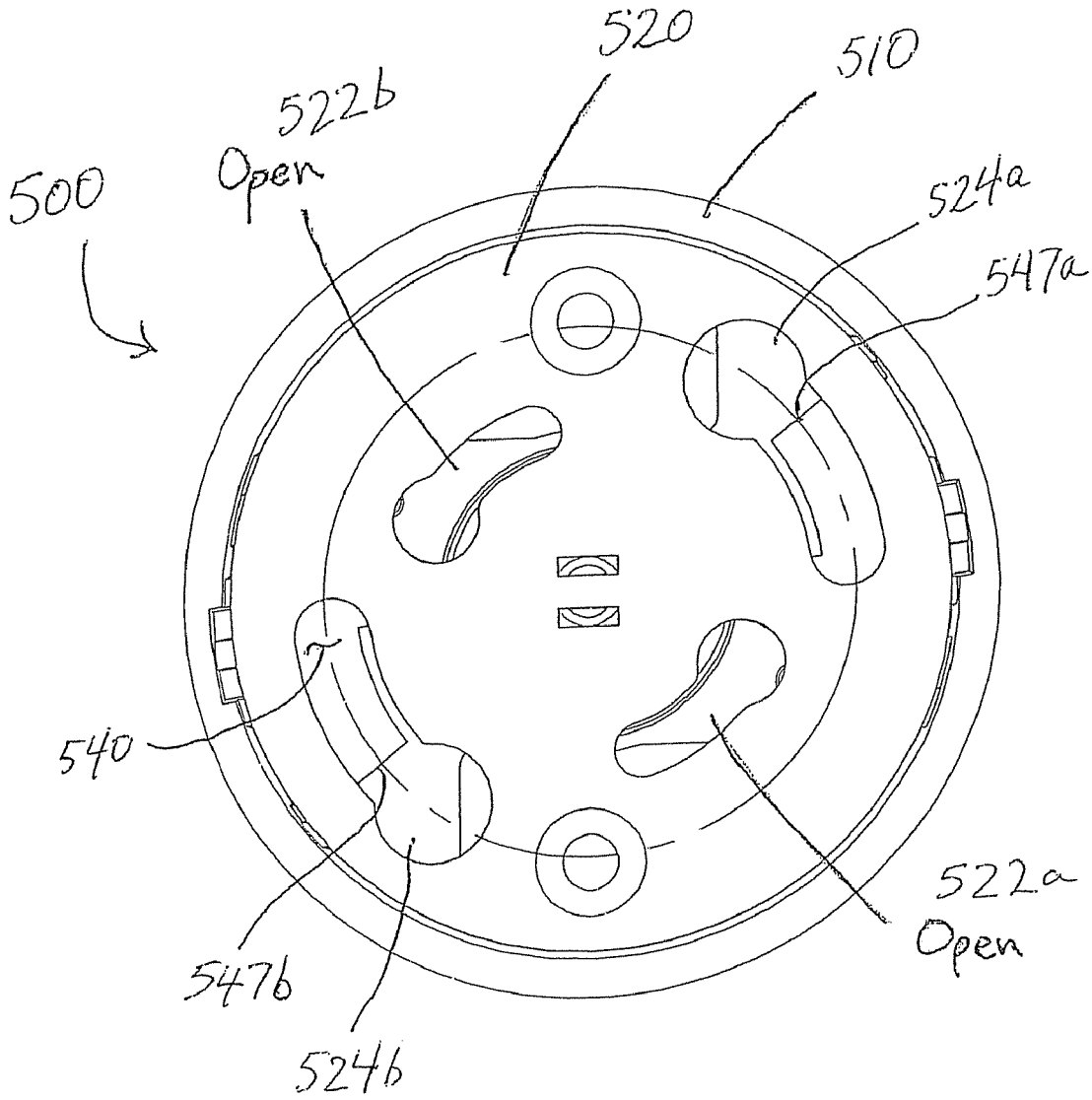
FIG. 26D is a top view of an exemplary electrical lighting base with a cam in an unconverted orientation.
Figure 26E:
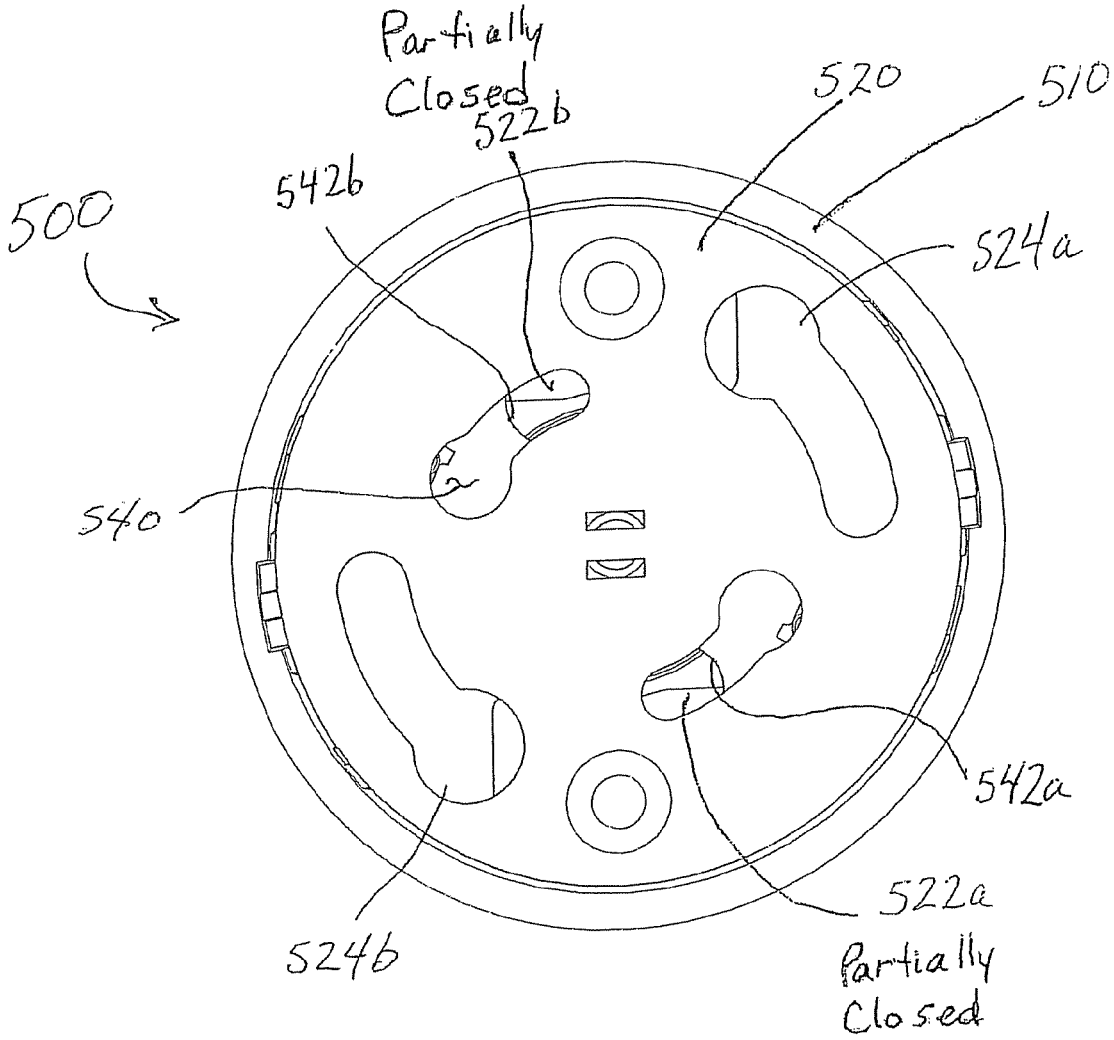
FIG. 26E is a top view of the exemplary electrical lighting base of FIG. 26D with the cam in a converted orientation.
Figure 27:
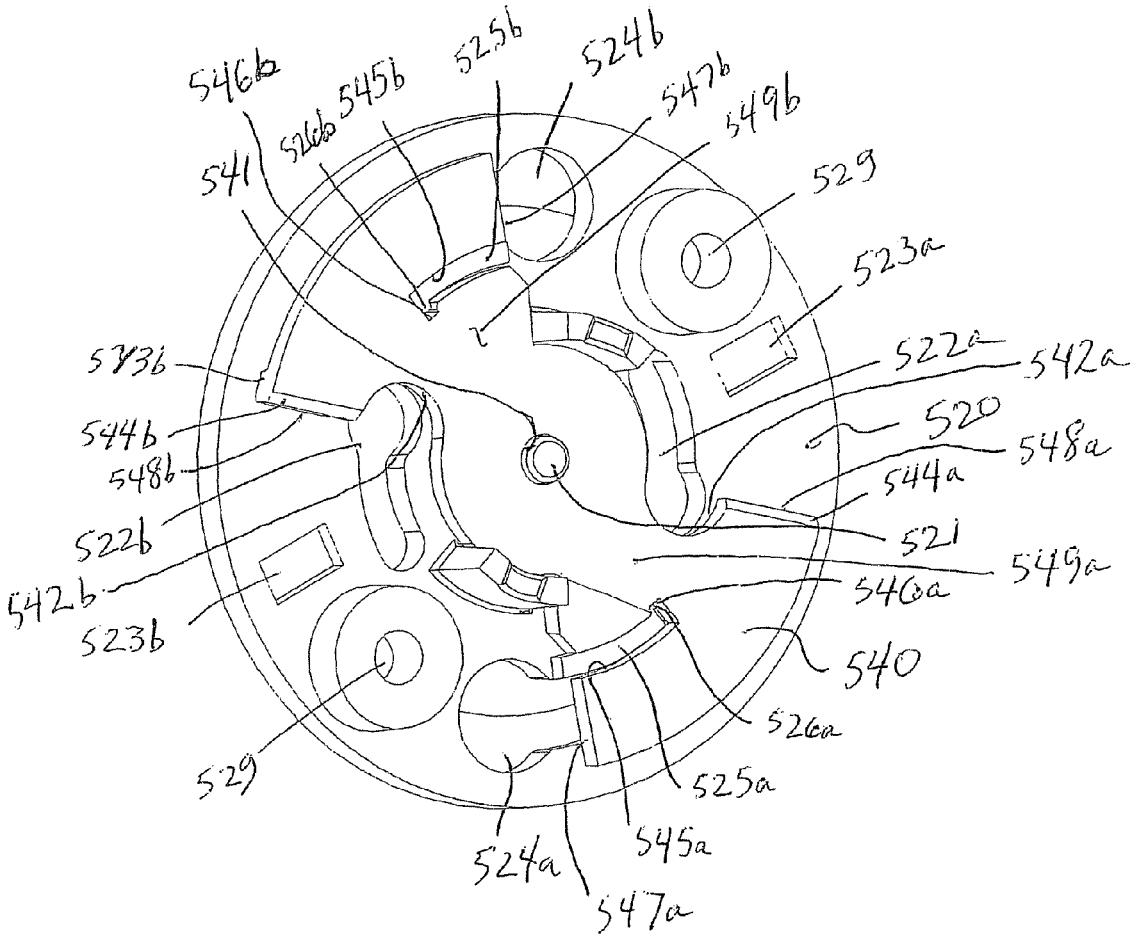
FIG. 27 is a lower isometric view of a cam and cap portion of the electrical lighting base of FIG. 26A.
Figure 29B:
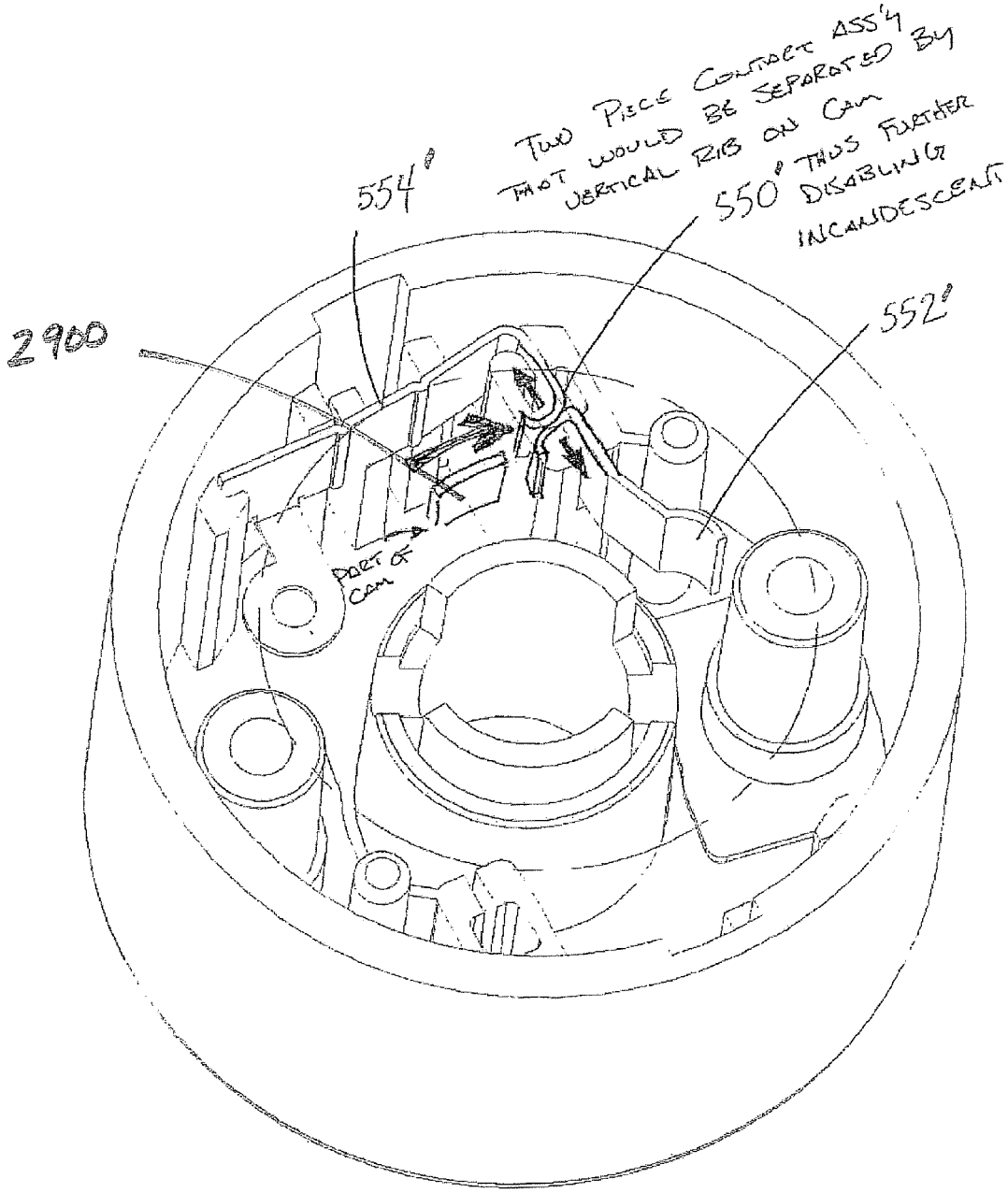
FIGS. 29B and 29C show exemplary ribs extending from exemplary alternate cam embodiments.
Figure 29C:
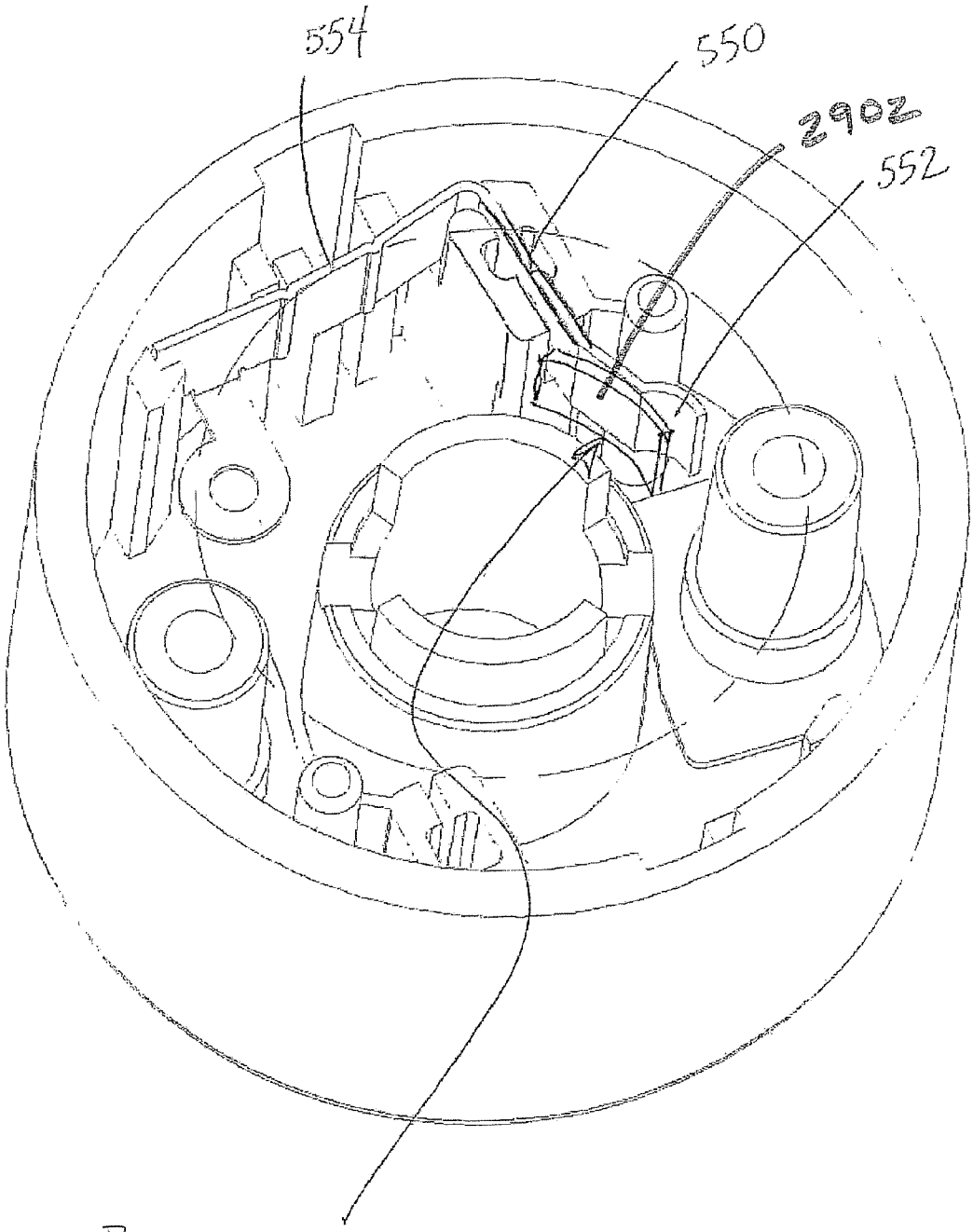

In the embodiment of FIGS. 26A-31B, the cam 540 is provided with cut-outs 542*a*, 542*b* that align with openings 522*a*, 522*b* when the cam 540 is in a first or unconverted position, consistent with the orientation shown in FIGS. 26A, 27, and 28. In this orientation, the pins of an incandescent bulb socket or non-threaded bulb may be inserted through the openings 522*a*, 522*b* in the end cap 520 and turned to engage electrical contacts 550 disposed in the lighting base 500. It should be noted that while only one electrical contact 550 is shown in FIGS. 26B, 28, and 29 for simplicity, two electrical contacts may preferably be used, with the second electrical contact 550 disposed opposite the illustrated electrical contact 550 within the housing. The lighting base may be provided with separate electrical contacts for each of the pin openings in the end cap, for example, two electrical contacts for engagement with pins from an incandescent component and two separate electrical contacts for engagement with pins from a fluorescent component. However, in an exemplary embodiment of the invention, electrical contacts may be sized and configured to engage pins from both sets of openings, or both fluorescent product pins and incandescent product pins. In the exemplary embodiment of FIGS. 26A-31B, as shown most clearly in FIG. 29, an electrical contact 550 includes a first portion 552 positioned to align with a pin retained in one of the first set of openings 522*a*. The electrical contact 550 also includes a second portion 554 positioned to align with a pin retained in one of the second set of openings 524*a*. The electrical contacts 550 may be provided with springs positioned to bias the electrical contacts 550 against the pins (not shown) to maintain both electrical and mechanical engagement of the pins within the base 500. Alternatively, the electrical contacts may be configured within the base so as to flex against the pins, thereby maintaining electrical contact and a mechanical grip on the pins. As shown in FIGS. 29B and 29C, the cam 540 may also optionally include additional flanges, ribs, and other structures to further disable or prevent contact with one or more of the first portions 552 of the electrical contacts 550 associated with the first set of openings 522. FIG. 29B shows an alternate embodiment with a two-piece contact 550' having a first portion 552' associated with one of the first set of openings 522*a* and a second portion 554' associated with one of the second set of openings 524*a*. Of course, as with FIG. 29, two or more of such contacts may be used. Referring back to FIG. 29B, an optional vertical flange or rib 2900 is shown. The rib 2900 may extend from the cam 540 and be configured such that when the cam 540 is rotated from the unconverted position to the converted position, the rib 2900 physically separates the two contact portions 552', 554' thereby electrically isolating the first portion 552' from the second portion 554' to prevent the first portion 552' from energizing any pin from a bulb or socket or ballast thus preventing the bulb or socket or ballast from being energized. This rib 2900 may be used in addition to, or in the alternative to, the portion of the cam that at least partially closes at least one of the first set of openings 522. FIG. 29C shows another alternate embodiment that has a contact that may be the same as contact 550 in FIG. 29. Of course, as with FIG. 29, two or more of such contacts may be used. Referring back to FIG. 29C, an optional vertical flange or rib 2902 is shown. The rib 2902 may extend from the cam 540 and be configured such that when the cam 540 is rotated from the unconverted position to the converted position, the rib 2902 is positioned so as to shield the first portion 552 from any pin from a bulb or socket or ballast thus preventing the bulb or socket or ballast from being energized. The rib 2902 may also be positioned and configured to push the first portion 552 of contact 550 away from the opening 522 to further isolate the contact portion 552 from any pin. This rib 2902 may be used in addition to, or in the alternative to, the portion of the cam that at least partially closes at least one of the first set of openings 522. This rib 2902 may be used in addition to, or in the alternative to, a rib (like rib 2900) that breaks an electrical connection between the two contact portions 552', 554'. Other structures (cams, etc.) may be used to perform these functions of breaking electrical connection between two contact portions, and/or shielding a contact portion from any pin from a bulb or socket or ballast, and/or moving a contact portion to further electrically isolate the contact portion.

In the embodiment of FIGS. 26A-31B, the cap 520 is provided with a second set of openings 524*a*, 524*b* for receiving pins from a removable fluorescent bulb ballast, such as the removable fluorescent bulb ballast 64 of FIGS. 7 and 8, or from a fluorescent bulb with integral ballast. Openings 524*a*, 524*b* may also be provided with wider and narrower portions for similarly receiving and retaining pins from a fluorescent ballast or bulb. The openings 524*a*, 524*b* and cam 540 may be configured such that when the fluorescent ballast/bulb pins are inserted in the openings and turned to an engaged position, the pins push the cam 540 from a first or unconverted position to a second or converted position, wherein the lighting base will no longer connect with an incandescent bulb socket or non-threaded bulb when the cam is in the converted position. In the embodiment of FIGS. 26A-31B, the cam 540 is provided with outward radial trailing edges 547*a*, 547*b* that align with portions of the fluorescent pin openings 524*a*, 524*b* when the cam is in a first or unconverted position. When the pins of a fluorescent ballast or bulb are inserted in the openings and the ballast/bulb is turned to engage with the base, the pins push against the trailing edges 547*a*, 547*b*, causing the cam 540 to rotate to a second or converted position. In the cam's converted position, the openings 522*a*, 522*b* for the incandescent bulb socket or non-threaded bulb do not align with the cut-outs 542*a*, 542*b* in the cam 540, but are instead blocked by solid portions 549*a*, 549*b* of the cam. When the fluorescent ballast/bulb is removed from the lighting base 500, the cam 540 remains in the converted position, thereby blocking openings 522*a*, 522*b* to prevent installation of an incandescent bulb socket or non-threaded bulb. In one embodiment, as shown in FIGS. 26A-31B, the second set of openings 524*a*, 524*b* may be provided at a different distance from a central axis Y of the base 500 than the first set of openings 522*a*, 522*b*. With this embodiment, incandescent bulb sockets and non-threaded bulbs may be provided with pins spaced to engage the first set of openings 522*a*, 522*b*, and fluorescent ballasts and bulbs may be provided with pins spaced to engage the second set of openings 524*a*, 524*b*. Additionally or alternatively, the end cap 520 may be provided with first and second sets of openings having differing sizes or shapes to correspond with differently sized or shaped pins for the incandescent bulb sockets and bulbs and the fluorescent ballasts and bulbs, such that the pins of the incandescent bulb sockets and bulbs may not be installed in the fluorescent pin openings (not shown).

FIG. 26D illustrates electrical lighting base 500 with a cam 540 in an unconverted orientation, in which cut-outs or openings 542*a*, 542*b* (see FIGS. 26E and 27) in the cam 540 provide an open condition for openings 522*a*, 522*b* to allow the pins of an incandescent bulb socket or non-threaded bulb to be inserted and twisted into electrical and mechanical engagement with the electrical contacts 550 (see FIGS. 26B and 29). The trailing edges 547*a*, 547*b* of the cam 540 are aligned with openings 524*a*, 524*b* such that the pins of a fluorescent ballast or bulb, when inserted into the openings 524*a*, 524*b* and twisted, engage the trailing edges 547*a*, 547*b* to rotate the cam 540 into the converted orientation, as illustrated in FIG. 26E. In this converted orientation, a portion of the cam 540 partially blocks the openings 522*a*, 522*b* (the wider portion thereof is completely blocked and a portion of the narrower portion is partially blocked) thereby blocking access of pins from an incandescent bulb socket or non-threaded bulb to the electrical contacts; as shown in FIG. 26E, the edges of the cut-outs 542*a*, 542*b* of the cam 540 are shown extending a little past half-way with respect to openings 522*a*, 522*b* to provide at least a partially closed condition for the openings 522*a*, 522*b*.

In one embodiment (not shown), axially oriented extensions, such as posts or slats, may be provided on the cam to block portions of the electrical contacts when the cam is in the converted position, thereby further preventing lateral access to the electrical contacts by incandescent product pins.

In yet another embodiment (not shown), the fluorescent product may be provided with pins substantially the same shape, cross-sectional size, and spacing as corresponding incandescent product pins, but with a longer wide portion of the pins than that of the incandescent products, such that the end of the longer fluorescent product pin engages a radial edge or other such engaging feature of the cam to turn the cam, while the shorter incandescent product pin does not contact the engaging feature of the cam. In such an embodiment, both incandescent and fluorescent products may use the same set of openings.

Figure 31A:
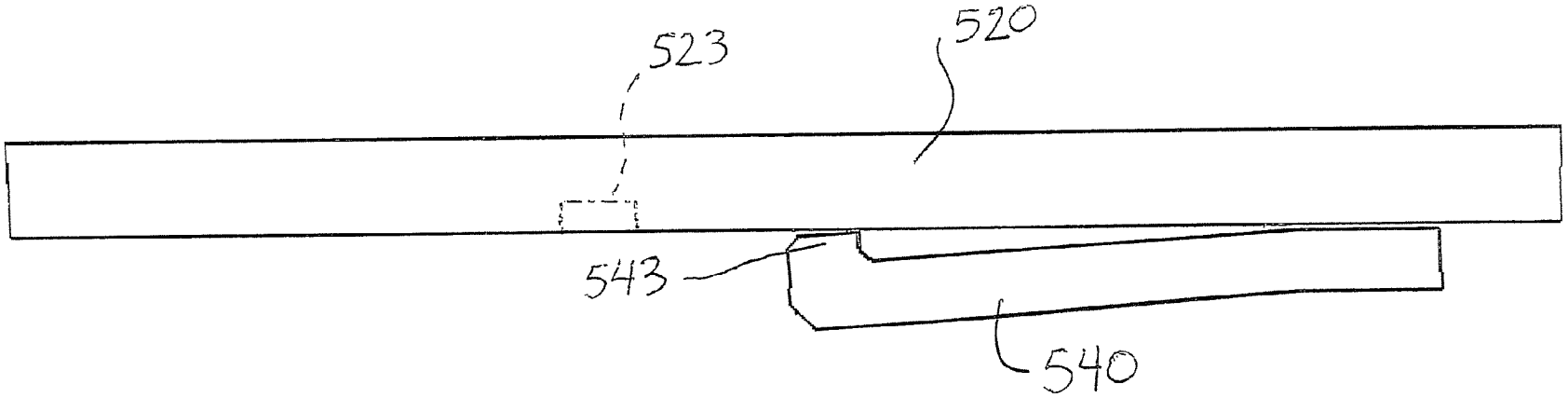
FIG. 31A is a partial side view of a cam and cap portion of the electrical lighting base of FIG. 26A.
Figure 31B:
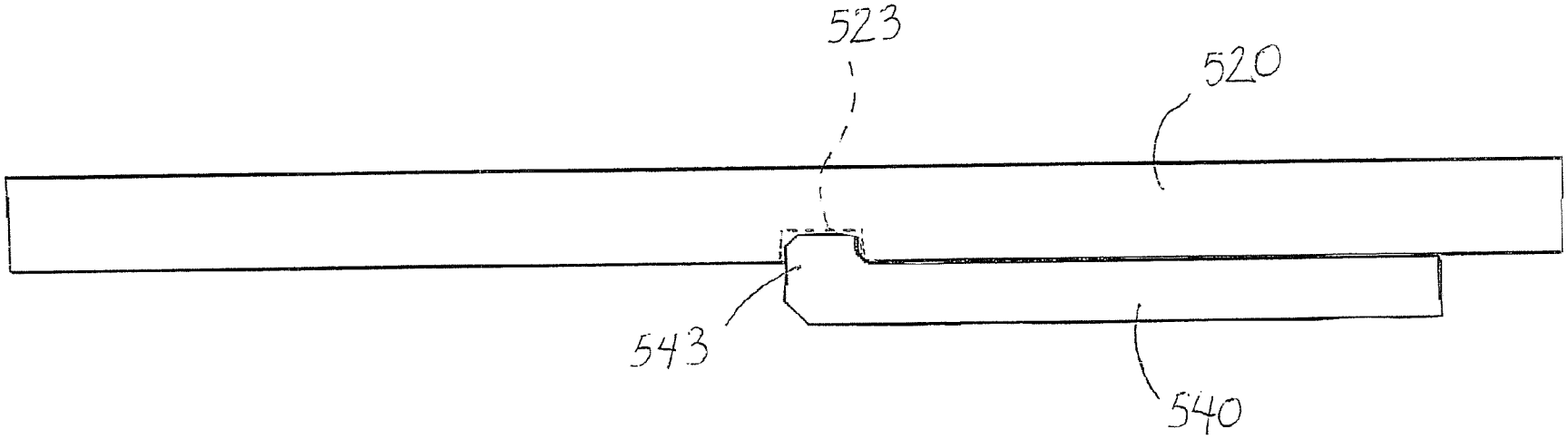
FIG. 31B is another partial side view of a cam and cap portion of the electrical lighting base of FIG. 26A.
Figure 32:
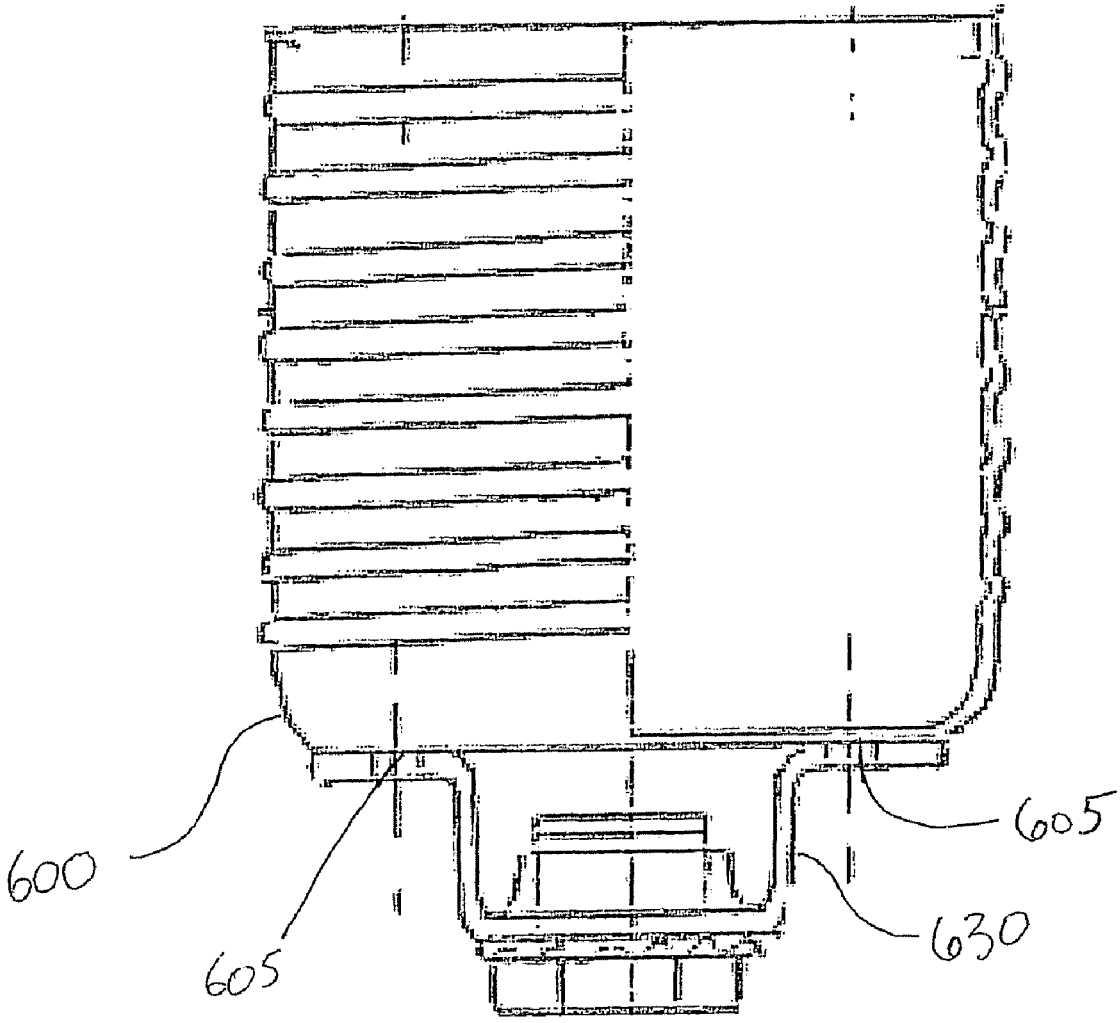
FIG. 32 is a partially cross-sectional front view of a sleeve and bracket.

In an exemplary embodiment of the invention, the lighting base 500 is configured such that a second or converted cam position is a locked position, such that, for example, the cam is not freely movable back to the first or unconverted position. For example, the cam may provided with one or more projections or detents that engage with a corresponding one or more openings, holes, slots, or other such recesses in a mating surface of the housing or cap when the cam is moved to its converted position. By providing the cam in a flexible material, such as, for example, plastic, the cam 540 may be installed in the housing with the projection 543 in a flexed position, i.e., flexed against the cap portion 520, as shown in FIG. 31A, such that the projection snaps into a corresponding recess 523 in the cap portion 520 when the cam 540 is moved to the converted position, as shown in FIG. 31B. In one embodiment, this flexed position is produced by an interference fit of approximately 0.010" to approximately 0.015" between the upper surface of the projection and the bottom surface of the cap.

In the exemplary embodiment of FIGS. 26A-31B, the cam 540 is provided with projections or detents 543*a*, 543*b* on an upper surface of the cam near outward radial leading edges 548*a*, 548*b* of the cam 540, and the bottom surface of the cap 520 is provided with corresponding recesses 523*a*, 523*b* positioned to receive the detents 543*a*, 543*b* when the cam 540 is rotated to the converted position. To secure the cam 540 in this converted position, the base housing 510 may be provided with posts 513*a*, 513*b* or any other support structures suitable for restricting axial movement of the cam 540 away from and out of engagement with the recesses 523*a*, 523*b* in the cap 520. Additionally, the lower surface of the cam 540 may be provided with ramped surfaces 544*a*, 544*b* at the leading edges 548*a*, 548*b* to allow the leading edges to slide over the corresponding posts 513*a*, 513*b* during rotation of the cam 540 from the unconverted to the converted position.

To maintain the cam in a fixed position prior to rotation, one or more protrusions may be provided on the housing or end cap of the lighting base to provide a tight but movable condition for the cam when the cam is in its unconverted position. In the exemplary embodiment of FIGS. 26A-31B, ribs 525*a*, 525*b* are provided on the bottom surface of the cap 520 along inside edges of the fluorescent pin openings 524*a*, 524*b*. The ribs 525*a*, 525*b* may align with corresponding slots 545*a*, 545*b* in the cam 540 when the cam is in the unconverted position. In one embodiment, the ribs 525*a*, 525*b* may have a height of approximately 0.025"Additionally, the ribs 525*a*, 525*b* may be provided with laterally extending fingers 526*a*, 526*b* that align with lateral extensions 546*a*, 546*b* of the slots 545*a*, 545*b* to hold the cam 540 in place prior to rotation of the cam. When the cam 540 is rotated by the fluorescent product pins, the flexible material of the cam allows the finger 526*a*, 526*b* to disengage from the slot extension 546*a*, 546*b* to permit rotation. Additionally, by positioning the rib 525*a*, 525*b* at the inner edge of the fluorescent pin opening, the rib 525*a*, 525*b* may also serve to retain the fluorescent product pin by sizing the end surface of the rib 525*a*, 525*b* to align with the back of the wider portion of the fluorescent product pin.

In the exemplary embodiment of FIGS. 26A-31B, the housing 510 may extend above the cap 520 to produce a ridge or skirt 515 around an outer diameter of the upper surface of the base 500. This skirt 515, which may be sized to match the outer diameter of a corresponding bulb socket or non-threaded bulb, may facilitate proper alignment of the socket 18 with the base 16 during assembly, for engagement of the pins with the corresponding openings 522*a*, 522*b* or 524*a*, 524*b*. In one embodiment, the housing 510 extends above the cap 520 by about 0.085" to produce a skirt 515 sufficient for aligning the bulb socket or non-threaded bulb with the base.

As shown in FIGS. 26A-31B, the housing and cap may be provided with corresponding mounting holes 519, 529 to assemble the cap to the housing conventional fasteners. In some applications, it may be desirable to assemble the lighting base such that it cannot be readily disassembled or tampered with. As such, blind sockets 518, shown in FIG. 26C, may be provided on the bottom surface of the housing to prevent loosening of nuts (not shown). Tamper-proof screws may also be used. Screw heads may be covered with an epoxy or some other type of obstruction to prevent loosening. Additionally or alternatively, a special threaded or other such engagement may be provided between the housing and the cap such that the components may be tightened together but cannot be loosened without damaging the components.

In incorporating an electrical lighting base, such as the exemplary lighting base of FIGS. 26A-31B, into a lighting product, such as, for example, a lighting fixture, portable, or recessed lighting frame, the base may be attached to the associated lighted frame using a wide variety of fasteners, brackets, adhesives, or other such connections. In one exemplary embodiment, as shown in FIGS. 32-34B, the base 500 is received in a sleeve 600 for attachment to a fixture arm (not shown) or other such lighting frame. The base 500 may be coupled to the sleeve 600, for example, by assembling a bracket 630 to a back portion of the base 500 and sleeve 600, with machine screws or other such fasteners passing through holes 605 in the sleeve and into threaded bores 519 in the base (see FIG. 26C), thereby affixing the bracket 630 and sleeve 600 to the base 500. The bracket may be attached directly or indirectly to a lighting frame, such as a fixture arm (not shown), to position the electrical lighting base and the socket 5 and/or bulb 6 received in the base 500, in a desired orientation. In another exemplary embodiment (not shown), the sleeve may be affixed to the base by a threaded nipple, inserted through an opening in the sleeve and threaded into a threaded bore in the base. A lock nut may be assembled to a back end of the nipple, to tighten the base and sleeve together. Further, the back end of the nipple may be threaded onto the lighting frame for attachment of the base to the frame. While many different materials may be used to construct the sleeve, in one embodiment, the sleeve is metal.

Figure 33B:
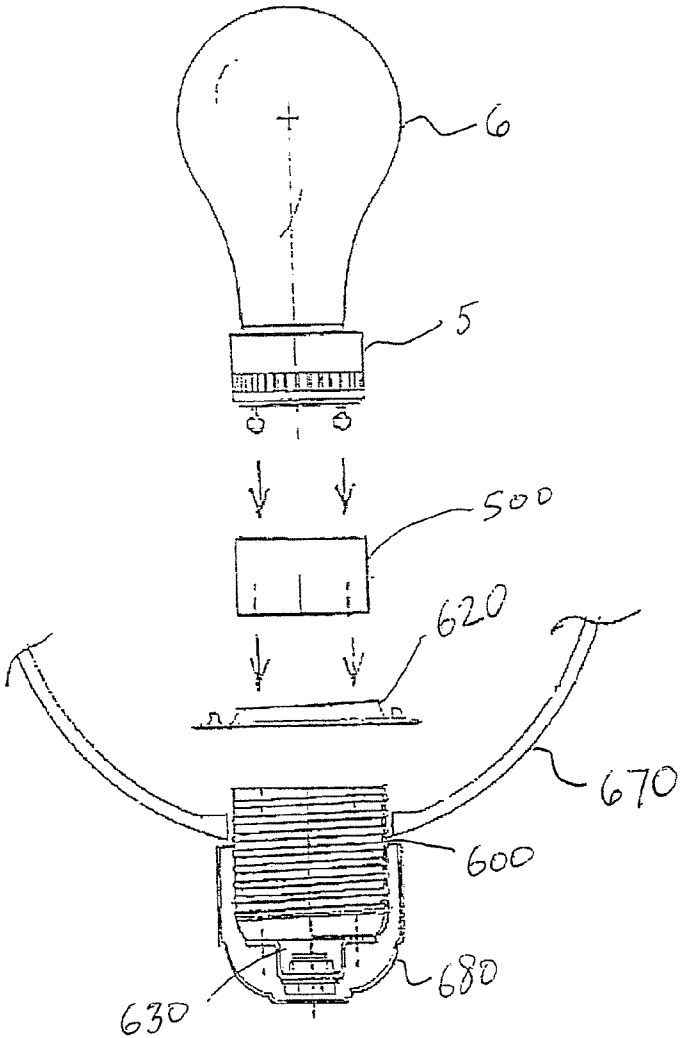
FIG. 33B is an exploded partially cross sectional front view of the lighting product of FIG. 33A.
Figure 33A:
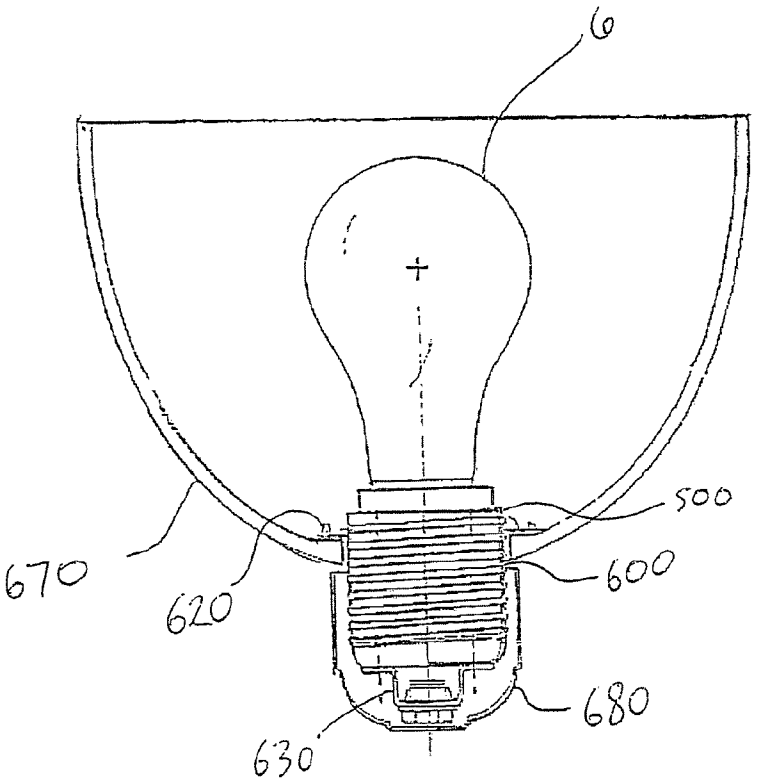
FIG. 33A is a partially cross sectional front view of a lighting product.
Figure 34B:
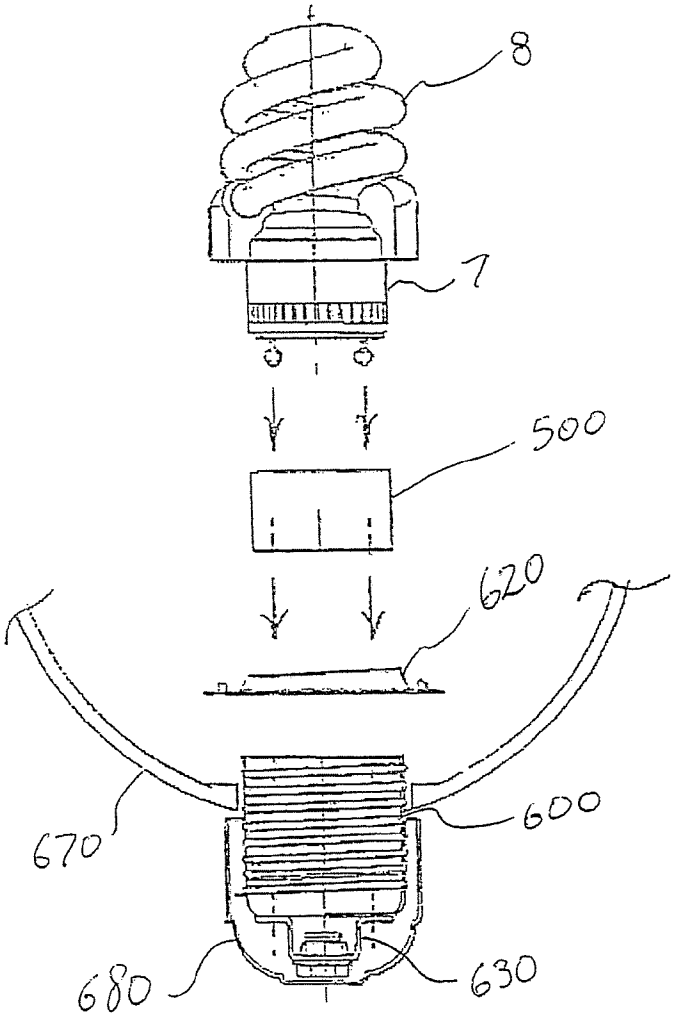
FIG. 34B is an exploded partially cross sectional front view of the lighting product of FIG. 34A.
Figure 34A:
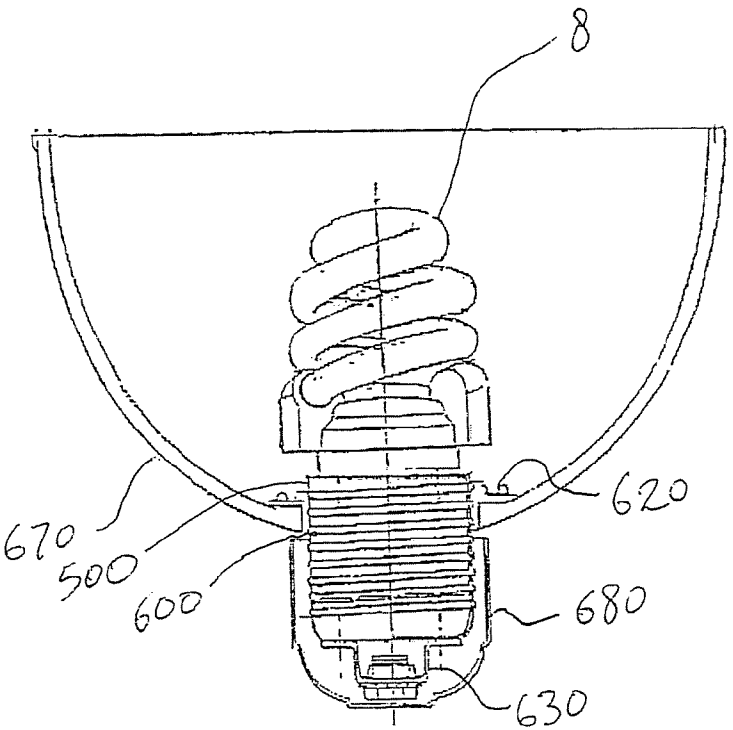
FIG. 34A is a partially cross sectional front view of a lighting product.

As shown in FIGS. 33A-34B, the sleeve 600 may be provided with external threads 606 for assembly of a lamp shade, cup, glass, bobeche, or other structure 670 proximate to the base. The sleeve may be sized and positioned with respect to a non-threaded bulb so as to appear to be an ordinary incandescent light bulb socket. After sliding the shade 670 over the sleeve 600, one or more threaded lock rings 620 may be used to affix the shade 670 to the sleeve 600 proximate to the socket 5 and bulb 6, as shown in FIGS. 33A-B, or the ballast 7 and fluorescent bulb 8, as shown in FIGS. 34A-B. An external cup 680 may be provided with internal threads for assembling over the back of the sleeve 600. The external cup 680 may be provided in metal, Bakelite, porcelain, or some other heat resistant material, for example. Also, the sleeve 600 may be provided with slots, openings or other vents (not shown) to allow heat generated in the bulb, socket, or electrical base to be released.

According to other exemplary embodiments of the present invention, the twist-lock lighting bases discussed herein (both reversible and irreversible) may be added to virtually any other lighting fixture in place of an incandescent light bulb socket, such as in so-called "keyless" fixtures used in construction and remodeling of buildings and used inside device enclosures. Keyless fixtures may be very simple plastic or porcelain light fixtures that merely contain an insulating body that may be directly connected to an electrical box carrying a typical threaded incandescent light bulb socket. Keyless fixtures are typically operated by a remotely-wired switch or by a pull string actuating an internal switch; they are commonly found in basement, closet, crawl space, and attic areas. Exemplary keyless fixtures include an Edison or medium base socket carried by a plastic or porcelain body having means for connecting to an outlet box, an enclosure, or a building structure (e.g., as one or more flanges having an opening through which a fastener is passed or a pair of openings or a threaded opening in the body accepting a nipple or other connector), and means for electrically connecting the Edison or medium base socket to available wiring (e.g., contact screws or push-in terminals). In accordance with exemplary keyless fixtures of the present invention, the Edison or medium base socket is replaced with an insert and twist connector, such as any of the various two-pin twist-lock connectors shown herein. Thus, the exemplary keyless fixtures of the present invention may include either a reversible insert and twist connector (e.g., item 16 in FIG. 2) or an irreversible insert and twist connector (e.g., any of those described above, such as the exemplary irreversible connector shown in FIGS. 26A-31B).

Figure 35:
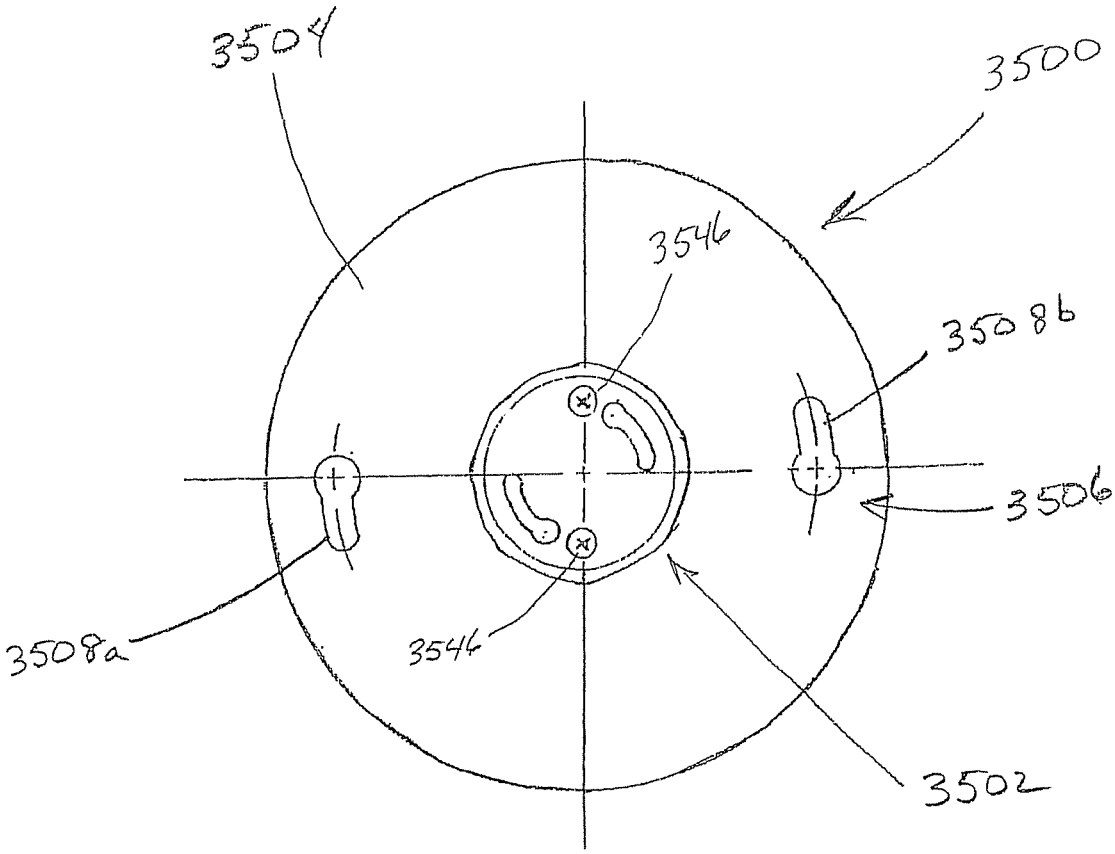
FIG. 35 is an outside view of an exemplary keyless fixture (bottom plan view if mounted on a ceiling; front view if mounted on a wall)
Figure 36:
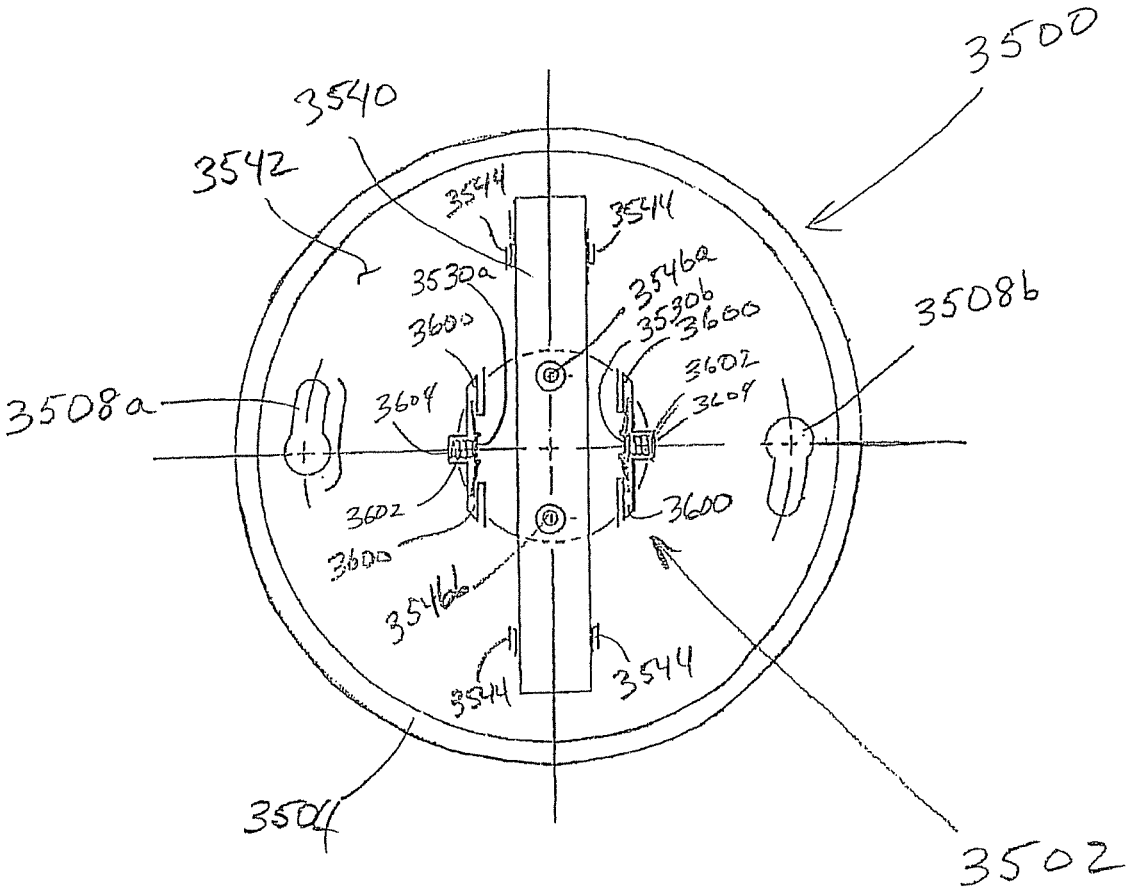
FIG. 36 is an underside view of the exemplary keyless fixture of FIG. 35 (top plan view if mounted on a ceiling; back view if mounted on a wall)
Figures 37, 38:
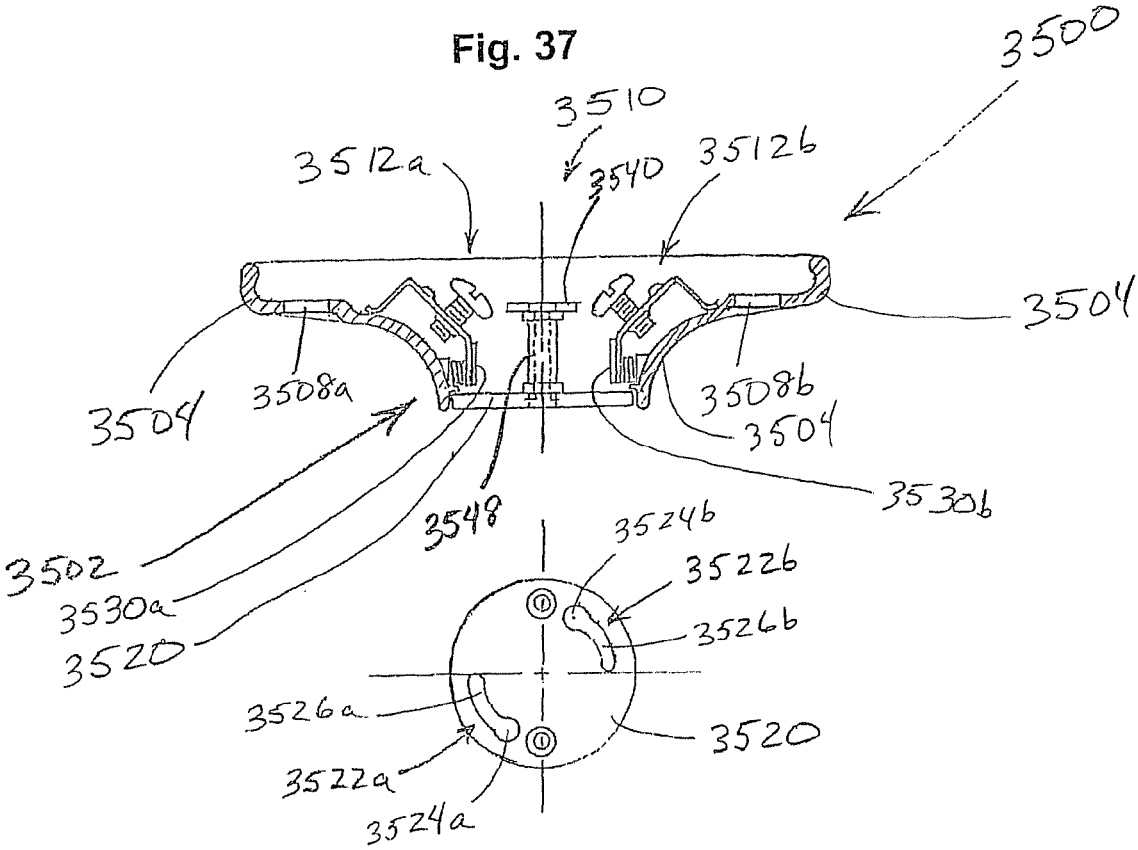
FIG. 37 is a sectional view of the exemplary keyless fixture of FIGS. 35-36.
FIG. 38 is an outside view of an exemplary disc used in the exemplary keyless fixtures of FIGS. 35-37.
Figure 39:
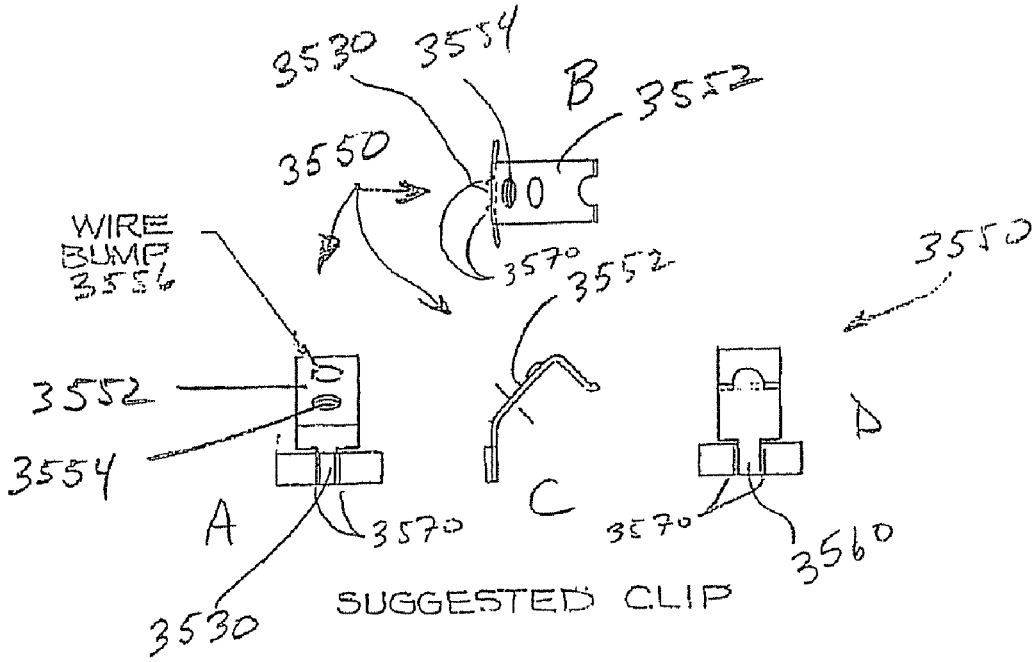
FIGS. 39A-39D are various views of an exemplary electrical contact used in the exemplary keyless fixture of FIGS. 35-37.
Figure 40:
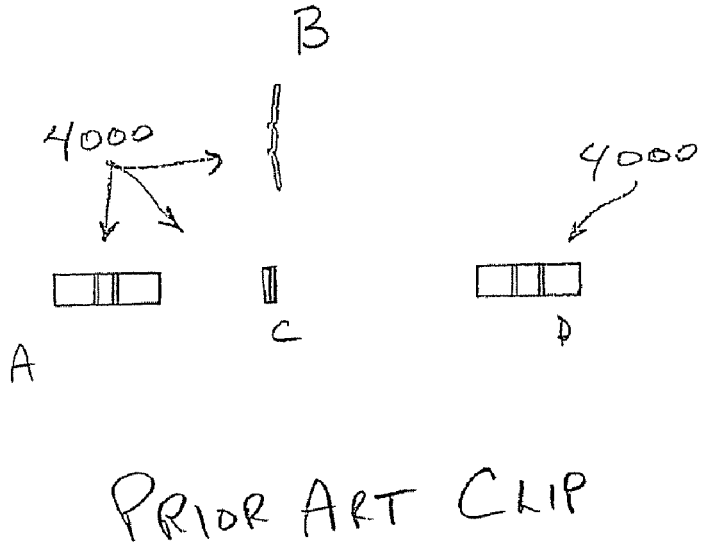
FIGS. 40A-40D are various views of a prior art contact that may be used in exemplary fixtures.

An exemplary keyless fixture 3500 is shown in FIGS. 35-37. Exemplary keyless lighting fixture 3500 has an insert and twist connector 3502 carried by a body 3504 having means for connecting to an outlet box, an enclosure, or a building structure 3506 (here, a pair of openings 3508*a*, 3508*b* for connection to a pair of fasteners (not shown) extending from the outlet box, the enclosure, or the building structure), and having means 3510 (here, contact screws 3512*a*, 3512*b*) for electrically connecting the insert and twist connector 3502 to available wiring (not shown). The body 3504 may be made of plastic (e.g., Bakelite) or ceramic or porcelain or the like and may be tapered from a wider end to an narrower end at the insert and twist connector 3502. The insert and twist connector 3502 may have a disc 3520 (FIG. 38), which may be substantially the same as the disc used in the prior art VIVA GREEN LIGHTING brand model 3.07.03.30025(6) electrical lighting base modified to be made of a material resistant to temperatures generated by ordinary incandescent light bulbs having a tungsten filament (~90° C.), e.g., made of a ceramic material or Bakelite polymer). The disc 3520 may have openings 3522*a*, 3522*b* having a wider portion 3524 and a narrower portion 3526, like openings 36*a*, 36*b* of base 16. The narrower portion 3526 of openings 3522*a*, 3522*b* may be proximate an internal electrical contact 3530 for connection to adequately-sized pins of any of the two-pin sockets, bulbs, ballasts, etc. shown herein, such as pins 34 of socket 30, or pins 66 of ballast 60, or the pins of a ballast having a fluorescent light bulb integrally connected thereto, or pins 134 of socket 118, or the pins of any of the bulbs shown in FIGS. 16A-16V, or the pins of any of the bulbs shown in FIGS. 19A-19X, or the pins of any of the bulbs shown in FIGS. 20A-20X, or the pins of any of the bulbs shown in FIGS. 21A-21C. In the alternative, the internal electrical contact 3530 may be configured to connect to adequately-sized pins of any bulbs or sockets or ballasts having any of the alternative connection configurations shown in FIGS. 25A-25J, or the like. Disc 3520 may be attached to the keyless fixture 3500 by any suitable means, including fasteners, adhesives, welding (ultrasonic or otherwise), etc. In the specific example of FIGS. 35-37, the disc 3520 is held in place by fasteners that connect the disc 3520 to a support or strap 3540 at the underside 3542 of the body 3504 of keyless lighting fixture 3500. The fasteners 3546*a*, 3546*b* may extend through spacers or sleeves 3548 extending between the disc 3520 and the strap 3540 with the disc 3520 and the strap 3540 cooperating to "sandwich" a portion of the body 3504 therebetween. The strap 3540 as shown may be made of any suitable material, e.g., plastic. Additionally, the strap 3540 may have transverse flanges ("ears") extending therefrom (not shown) to help keep contacts 3530 in place (here, to help keep contacts 3530 in corresponding slots 3600). The body 3504 may have associated projections 3544 to prevent rotation of the strap 3540 and perhaps help secure strap 3540 to the body 3504. The contact 3530 may be formed as part of an exemplary clip 3550 (FIGS. 39A-39D). Clip 3550 has a contact portion 3530 and a flange portion 3552, which may have a threaded opening 3554 accepting a contact screw 3512 for electrically connecting the insert and twist connector 3502 to available wiring (not shown). The flange portion 3552 may also have a wire bump 3556 to facilitate securing wiring with a contact screw 3512. The exemplary clip 3550 may be held in place in the body 3504 of exemplary keyless fixture 3500 in slots formed in the body 3504 with pressure from a compression spring 3602 acting against a surface 3604 of body 3504 and a back side 3660 of exemplary clip 3550, with the spring 3602 providing a force to help keep a socket or bulb or ballast connected to exemplary keyless fixture 3500. The exemplary clip 3550 may have a pair of ridges 3570 to help keep the pins of the socket or bulb or ballast centered and in place. In the alternative, the contact 3530 may consist of prior art contact 4000 (FIGS. 40A-40D), which prior art contact 4000 may have a solder tab extending therefrom to which wiring may be soldered. The exemplary keyless fixture may be modified to be a pull-chain keyless fixture by the addition of an integral switch activated by the pull chain. The exemplary keyless fixture may be modified to accept a shade by adding any of the typical means for adding a shade, such as by adding an opening having threaded fasteners accepting a fitter portion of a shade.

Figures 41, 42, 43:
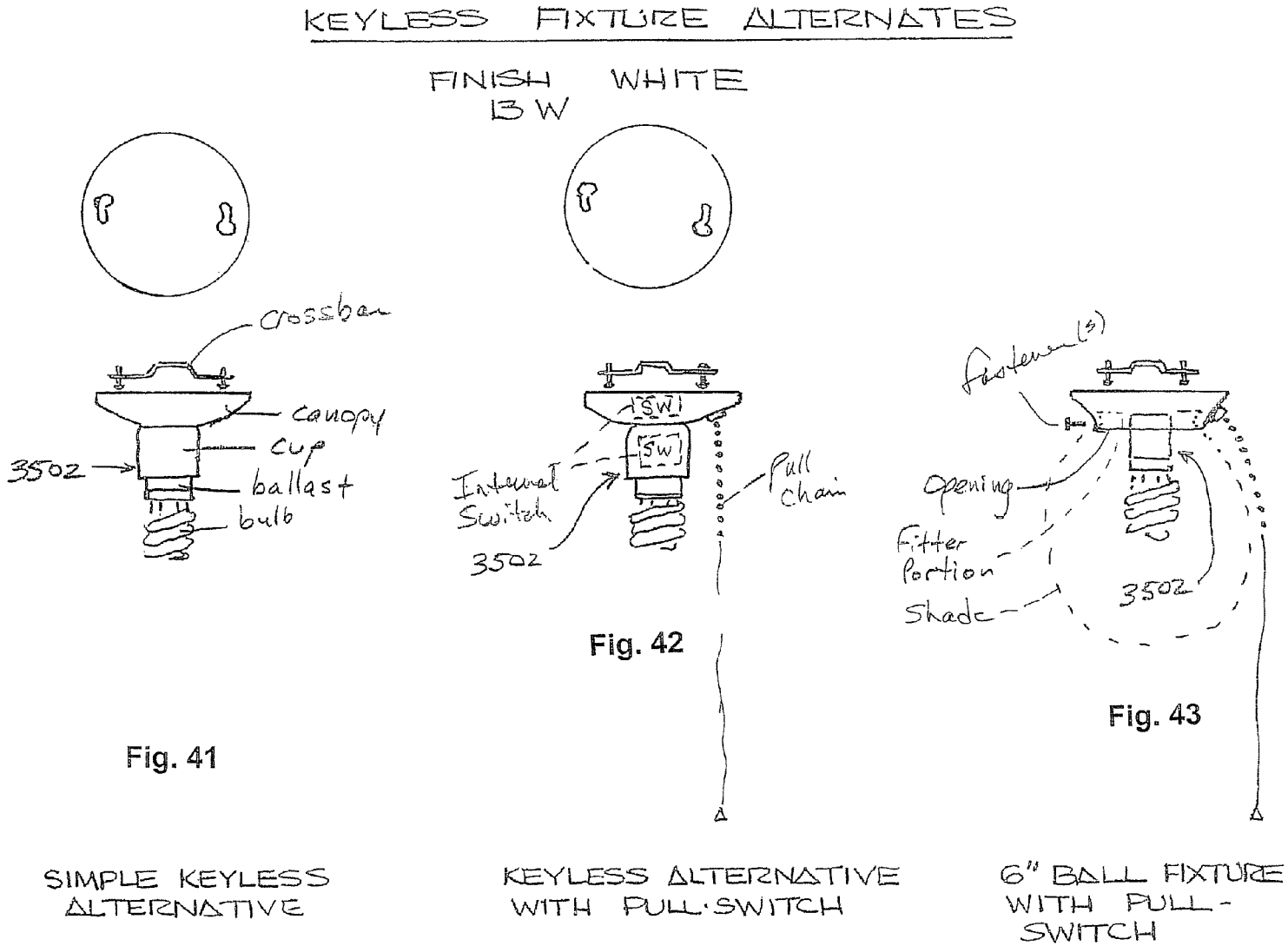
FIGS. 41-43 show other exemplary fixtures that are alternatives to the exemplary keyless fixture of FIGS. 35-37.

Exemplary keyless fixture alternatives are shown in FIGS. 41-43. These lighting fixtures have a canopy and cup, with the cup carrying an insert and twist connection. The canopy and cup may be made of metal or ceramic or suitable plastic (higher temperature plastic like Bakelite if used with any of the various incandescent light bulbs disclosed herein), and if they have a metal canopy and cup, may be grounded as other fixtures in the usual manner with a grounded cross bar (FIG. 41). These fixtures may have an optional pull chain (FIG. 42) activating an internal switch and/or accept a shade (FIG. 43), e.g., by having an opening having threaded fasteners accepting a fitter portion of a glass shade. Each of these fixtures has an insert and twist connection 3502 for connection to any of the various removable incandescent sockets, incandescent bulbs, LED bulbs, fluorescent ballasts (with or without integral fluorescent bulb). The insert and twist connection 3502 in each may be reversible such as base 16 and the base as shown above in FIGS. 35-37 and the prior art VIVA GREEN LIGHTING brand model 3.07.03.30025(6) electrical lighting base modified to be made of a material resistant to temperatures generated by ordinary incandescent light bulbs having a tungsten filament. In the alternative, the insert and twist connection 3502 in each may be irreversible like irreversible base 500 shown in FIGS. 26A-31B. Although shown coupled to a fluorescent bulb having an integral ballast, the various fixtures shown in FIGS. 41-43 may also be configured to accept a removable ballast accepting a removable fluorescent light (exemplified by FIGS. 7 and 8). Of course, as described above, such fixtures may also be configured to accept incandescent bulbs and/or LED bulbs and/or removable incandescent light bulb sockets as discussed herein.

Using the exemplary fixtures having an insert and twist connection ought to be apparent from the discussion above. One or more keyless fixtures may be wired to available wiring and then affixed to an available surface, such as a wall or a ceiling or an enclosure. A bulb (incandescent or fluorescent or LED or the like) or socket or ballast may be connected thereto. If separate, a bulb may be screwed into or otherwise connected to the socket or ballast. The bulbs may be selectively illuminated using a switch, such as a remotely located hard-wired switch or an integral pull switch.

While the present invention has been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art. For example, the teachings herein may be used with virtually any type of lighting products (fixtures or portables), including without limitation Tiffany style lighting, recessed lighting, track lighting, fan lighting, hospitality lighting, landscape lighting, site lighting, accent lighting, ADA lighting (fixtures for mounting on a wall that extend no more than a specified amount, e.g., 4 inches, from the wall to comply with the Americans with Disabilities Act), architectural lighting, built-in lighting, valance lighting, etc. In addition, the embodiments shown include Edison base incandescent light bulbs and sockets accepting Edison base light bulbs; the teachings of the present application can be applied to virtually any size and type of lighting base, e.g., medium base, candle base, 3-way medium base, mogul base, intermediate base, medium base with built in dimmer, and mini can halogen. Additionally, although the teachings of the present invention are recited in the context of conversion from incandescent lighting to fluorescent lighting, the present invention is also directed toward conversion from virtually any lighting type to virtually any other lighting type: standard incandescent lighting, fluorescent lighting, halogen lighting, high-pressure sodium lighting, low-pressure sodium lighting, mercury vapor lighting, metal halide lighting, light emitting diode (LED) lighting, etc. As another example, external pins on removable sockets, bulbs, ballasts, and the like for engagement with internal contacts in an electrical lighting base may be replaced with external pins on an electrical lighting base for engagement with internal contacts in removable sockets, bulbs, ballasts, and the like. Additionally, all of the claims from the corresponding provisional application have been incorporated herein by reference; in addition, in addition to the dependencies expressly recited therein, for purposes of later claiming, each of those claims can be thought of as depending each and every one of the preceding claims. Moreover, the steps of the methods described and claimed in the present application may be performed in any suitable order. Therefore, the invention in its broader aspects is not limited to the specific details, representative apparatus and methods, and illustrative examples shown and described. Accordingly, departures may be made from such details without departing from the spirit or scope of the applicant's general inventive concept.

What is claimed is:

1. An electrical lighting base for removably receiving a removable incandescent bulb or socket, the removable incandescent bulb or socket having first and second external electrical contacts with approximately parallel central axes, with each external electrical contact having a narrow proximal portion and a wider distal portion, the electrical lighting base comprising:

a housing;

a end portion, assembled with the housing, the end portion including first and second openings each disposed a first distance from a central axis of the base, each opening having a wider portion and a narrower portion, wherein the wider portions are configured to accept the wider distal portions of the external electrical contacts, and the narrow portions are configured to accept the narrow proximal portions of the external electrical contacts and to retain the wider distal portions of the external electrical contacts;

first and second internal electrical contacts disposed in the housing such that each of the first and second internal electrical contacts engages a respective one of the first and second external electrical contacts when the external electrical contacts are retained in the narrow portions of the first and second openings; and a cam, disposed in the housing and configured to allow the first and second external electrical contacts to engage the corresponding first and second internal electrical contacts when the cam is in an unconverted orientation, and the cam is further configured to prevent the first and second external electrical contacts from engaging the corresponding first and second internal electrical contacts when the cam is in a converted orientation.

2. An electrical lighting base for removably receiving a removable incandescent bulb or socket, the removable incandescent bulb or socket having first and second external electrical contacts, the electrical lighting base comprising:

a housing;

a end portion, assembled with the housing, the end portion including first and second openings each disposed a first distance from a central axis of the base, wherein each of the first and second openings are configured to accept and retain a corresponding one of the external electrical contacts;

first and second internal electrical contacts disposed in the housing such that each of the first and second internal electrical contacts engages a respective one of the first and second external electrical contacts when the external electrical contacts are retained in the first and second openings; and a cam, disposed in the housing and configured to allow the first and second external electrical contacts to engage the corresponding first and second internal electrical contacts when the cam is in an unconverted orientation, and the cam is further configured to prevent the first and second external electrical contacts from engaging the corresponding first and second internal electrical contacts when the cam is in a converted orientation.

3. The electrical lighting base according to any of claims 1 and 2, wherein the cam is disposed in the housing, and configured to allow the first and second external electrical contacts to engage the corresponding first and second internal electrical contacts when the cam is in an unconverted orientation, and further configured to prevent the first and second external electrical contacts from being inserted into the first and second openings when the cam is in a converted orientation, thereby preventing engagement of the corresponding first and second internal electrical contacts by the first and second external electrical contacts.

4. The electrical lighting base according to any of claims 1 and 2, wherein the cam is disposed in the housing, and configured to allow the first and second external electrical contacts to engage the corresponding first and second internal electrical contacts when the cam is in an unconverted orientation, and further configured to at least partially close at least one of the first and second openings when the cam is in a converted orientation, thereby preventing engagement of the corresponding first and second internal electrical contacts by the first and second external electrical contacts.

5. The electrical lighting base according to any of claims 1 and 2, wherein the cam is disposed in the housing between the end portion and the electrical contacts, and configured to allow the first and second external electrical contacts to engage the corresponding first and second internal electrical contacts when the cam is in an unconverted orientation, and further configured to prevent the first and second external electrical contacts from engaging the corresponding first and second internal electrical contacts when the cam is in a converted orientation.

6. The electrical lighting base according to any of claims 1 and 2, wherein the electrical lighting base is further adapted to removably receive a lower-energy lighting device, further wherein when the lower-energy lighting device is assembled with the electrical lighting base, the cam is moved from the unconverted orientation to the converted orientation.

7. The electrical lighting base according to any of claims 1 and 2, wherein the end portion further comprises third and fourth openings each disposed a second distance from the central axis of the base, the third and fourth openings being configured to accept external electrical contacts from a lower-energy lighting device.

8. The electrical lighting base according to claim 7, wherein the second distance is greater than the first distance.

9. The electrical lighting base according to claim 6, wherein the cam comprises an engaging feature for engaging a contacting portion of the lower-energy lighting device, and further wherein when the lower-energy lighting device is assembled to the electrical lighting base, the contacting portion of the lower-energy lighting device pushes the engaging feature to move the cam from the unconverted orientation to the converted orientation.

10. The electrical lighting base according to any of claims 1 and 2, further comprising a projection on one of the cam and the end portion, and a corresponding recess on the other of the cam and the end portion, wherein the projection is received in the recess when the cam is in the converted orientation.

11. The electrical lighting base according to claim 10, further comprising a support structure for securing the projection in the recess when the cam is in the converted orientation.

12. The electrical lighting base according to any of claims 1 and 2, further comprising a projection on one of the cam and the housing and a corresponding recess on the other of the cam and the housing, wherein the projection is received in the recess when the cam is in the converted orientation.

13. The electrical lighting base according to claim 12, further comprising a support structure for securing the projection in the recess when the cam is in the converted orientation.

14. The electrical lighting base according to any of claims 1 and 2, further comprising means for preventing disassembly of the electrical lighting base.

15. The electrical lighting base according to claim 7, wherein at least a portion of the cam is flexed against the end cap in the unconverted orientation, such that the at least one projection snaps into the at least one recess when the cam is moved to the converted orientation.

16. The electrical lighting base according to claim 9, wherein at least a portion of the cam is flexed against the housing in the unconverted orientation, such that the at least one projection snaps into the at least one recess when the cam is moved to the converted orientation.

17. The electrical lighting base according to claim 6, wherein the low lower-energy lighting device comprises a fluorescent ballast.

18. The electrical lighting base according to claim 6, wherein the lower-energy lighting device comprises a fluorescent ballast having an integral fluorescent light bulb.

* * * * *

UNITED STATES PATENT AND TRADEMARK OFFICE

CERTIFICATE OF CORRECTION

PATENT NO. : 7,748,886 B2
APPLICATION NO. : 11/684401
DATED : July 6, 2010
INVENTOR(S) : Bruce Raymond Pazula et al.

It is certified that error appears in the above-identified patent and that said Letters Patent is hereby corrected as shown below:

Claim 17, Column 36, line 49, after "the" please remove "low".

Signed and Sealed this

Seventeenth Day of August, 2010

David J. Kappos

David J. Kappos
*Director of the United States Patent and Trademark Office*